US007857708B2

(12) United States Patent
Ueda et al.

(10) Patent No.: US 7,857,708 B2
(45) Date of Patent: Dec. 28, 2010

(54) GOLF SWING-DIAGNOSING SYSTEM

(75) Inventors: Masahiko Ueda, Hyogo (JP); Masahide Onuki, Hyogo (JP)

(73) Assignee: SRI Sports Limited, Kobe (JP)

( * ) Notice: Subject to any disclaimer, the term of this patent is extended or adjusted under 35 U.S.C. 154(b) by 863 days.

(21) Appl. No.: 11/089,335

(22) Filed: Mar. 25, 2005

(65) Prior Publication Data

US 2005/0215336 A1 Sep. 29, 2005

(30) Foreign Application Priority Data

Mar. 26, 2004 (JP) ..... 2004-091071
Mar. 26, 2004 (JP) ..... 2004-091216

(51) Int. Cl.
*A63F 9/24* (2006.01)
*A63F 13/00* (2006.01)
*G06F 17/00* (2006.01)
*G06F 19/00* (2006.01)

(52) U.S. Cl. ..... 473/257; 364/551; 273/183 R; 273/77 R; 273/80; 273/167; 473/131; 473/407; 473/233; 473/239; 434/251; 434/247; 434/252; 382/103

(58) Field of Classification Search ..... 434/247–252; 473/151, 266, 219, 267
See application file for complete search history.

(56) References Cited

U.S. PATENT DOCUMENTS 3,353,282 A * 11/1967 Sneed ..... 434/257
3,408,750 A * 11/1968 McCollough et al. ..... 434/252
3,743,296 A * 7/1973 Branz ..... 473/140
3,918,073 A * 11/1975 Henderson et al. ..... 396/335
4,137,566 A * 1/1979 Haas et al. ..... 473/209
5,111,410 A * 5/1992 Nakayama et al. ..... 434/258
5,184,295 A * 2/1993 Mann ..... 473/221
5,249,967 A * 10/1993 O'Leary et al. ..... 434/247
5,297,796 A * 3/1994 Peterson ..... 473/266
5,328,171 A * 7/1994 Saito ..... 473/330
5,333,061 A * 7/1994 Nakashima et al. ..... 358/355
5,342,054 A * 8/1994 Chang et al. ..... 473/156
5,772,522 A 6/1998 Nesbit et al.

(Continued)

FOREIGN PATENT DOCUMENTS

EP 0 447 712 A3 9/1991

(Continued)

*Primary Examiner*—John M. Hotaling, II
*Assistant Examiner*—Paul A. D'Agostino
(74) *Attorney, Agent, or Firm*—Birch, Stewart, Kolasch & Birch, LLP

(57) ABSTRACT

A computer (16) for capturing a colored moving image photographed by photographing means (14, 15) has an extraction means for extracting images having necessary swing postures as check-point images from a large number of still images constituting the color moving image; a means for obtaining a coordinate of a position of each of attention-focused points, which operate, in each of the check-point images, while a golfer (11) is swinging; a means for diagnosing a golfer's swing form by setting a plurality of diagnosis items for each trajectory pattern obtained by a ball motion measuring apparatus (20) to classify behavior of a golf ball and by comparing numerical data generated from data of the coordinate of the position of each of the attention-focused points with a judgement value set in each of a plurality of diagnosis items; and a means for outputting an advice drill corresponding to a result of a diagnosis.

30 Claims, 30 Drawing Sheets

U.S. PATENT DOCUMENTS

| | | | | | |
|---|---|---|---|---|---|
| 5,826,578 | A * | 10/1998 | Curchod | 600/595 |
| 5,846,086 | A * | 12/1998 | Bizzi et al. | 434/247 |
| 5,879,246 | A * | 3/1999 | Gebhardt et al. | 473/409 |
| 5,904,484 | A * | 5/1999 | Burns | 434/252 |
| 5,984,684 | A * | 11/1999 | Brostedt et al. | 434/252 |
| 6,050,963 | A * | 4/2000 | Johnson et al. | 600/595 |
| 6,241,622 | B1 * | 6/2001 | Gobush et al. | 473/199 |
| 6,514,081 | B1 * | 2/2003 | Mengoli | 434/252 |
| 6,537,076 | B2 * | 3/2003 | McNitt et al. | 434/252 |
| 6,561,917 | B2 * | 5/2003 | Manwaring | 473/151 |
| 6,565,448 | B2 * | 5/2003 | Cameron et al. | 473/131 |
| 6,579,190 | B2 * | 6/2003 | Yamamoto | 473/141 |
| 6,602,144 | B2 * | 8/2003 | Manwaring et al. | 473/198 |
| 6,669,571 | B1 * | 12/2003 | Cameron et al. | 473/131 |
| 6,786,730 | B2 * | 9/2004 | Bleckley et al. | 434/247 |
| 7,095,388 | B2 * | 8/2006 | Truxa et al. | 345/7 |
| 7,131,910 | B2 * | 11/2006 | Townsend, II | 473/278 |
| 7,311,611 | B2 * | 12/2007 | Cameron et al. | 473/221 |
| 2002/0064764 | A1 | 5/2002 | Fishman et al. | |
| 2002/0114493 | A1 | 8/2002 | McNitt et al. | |
| 2002/0115047 | A1 | 8/2002 | McNitt et al. | |
| 2002/0187846 | A1 | 12/2002 | Funk | |
| 2003/0054327 | A1 | 3/2003 | Evensen | |
| 2004/0096085 | A1 * | 5/2004 | Matsumoto et al. | 382/107 |
| 2006/0247070 | A1 * | 11/2006 | Funk et al. | 473/222 |

FOREIGN PATENT DOCUMENTS

| | | | |
|---|---|---|---|
| GB | 2 400 568 | A | 10/2004 |
| JP | S62-116195 | A | 5/1987 |
| JP | S63-38478 | A | 2/1988 |
| JP | 08-257191 | A | 10/1996 |
| JP | 08-299518 | A | 11/1996 |
| JP | 2794018 | B2 | 6/1998 |
| JP | 2001-264016 | A | 9/2001 |
| JP | 2002-011132 | A | 1/2002 |
| JP | 2002-119621 | A | 4/2002 |
| JP | 2003-088604 | A | 3/2003 |
| JP | 2003-117045 | A | 4/2003 |
| WO | WO-2004/067099 | A3 | 8/2004 |

* cited by examiner

| | | |
|---|---|---|
| A | B | C |
| D | E | F |
| G | H | I |

| Select trajectory pattern | | |
|---|---|---|
| A | B | C |
| D | E | F |
| G | H | I |

GOLF SWING-DIAGNOSING SYSTEM

This nonprovisional application claims priority under 35 U.S.C. §119(a) on Patent Application No(s). 2004-091071 filed in Japan on Mar. 26, 2004 and 2004-091216 filed in Japan on Mar. 26, 2004, the entire contents of which are hereby incorporated by reference.

FIELD OF THE INVENTION

The present invention relates to a golf swing-diagnosing system and more particularly to a system of automatically and accurately diagnosing a golfer's swing form.

BACKGROUND ART

There are proposed various kinds of apparatuses for photographing a golfer's swing, automatically computing information such as a flight distance (distance from hitting point to drop point), trajectory, and the like of a hit golf ball by a computer, and displaying obtained information for a golfer. These apparatuses allow the golfer to examine the flight distance, trajectory, and the like of the hit ball. However, these apparatuses are incapable of providing information useful for improving the golfer's swing form.

In the swing form-diagnosing apparatus disclosed in Japanese Patent Application Laid-Open No. 2003-117045, a golfer's swing form is photographed to extract images of only specific moving points important for diagnosing the swing form. More specifically, frames regarding the golfer's swing motion are extracted from the golfer's moving image photographed by the photographing means. Specific moving points during the swing motion are judged according to results of analysis of the moving partial images in the differential image obtained by executing differential processing between each frame and the reference image. The frame corresponding to each of the specific moving points is extracted to display the swing image The image at the impact time is regarded as important for diagnosing the swing form. Thus image extraction is executed by giving attention to the impact image.

However, even though the frame corresponding to the specific moving point during the swing motion is extracted, the golfer cannot be provided with the motion of the joints and the like during the swing by merely looking at the extracted image. Therefore it is difficult for the golfer to find defects in her/his swing form and points to be corrected.

In the motion-diagnosing apparatus disclosed in U.S. Pat. No. 2,794,018, to diagnose a person's swing form, a plurality of moving points are provided on a golf club head and on the person to obtain the coordinates of the moving points in a swing moving image. But it is necessary to perform computations for extracting the coordinates of a large number of moving points for all frames of the swing moving image. Therefore the amount of computation is very large, and an erroneous recognition of the coordinates of the positions of the moving points occurs at a high percentage. Further there is a case in which the moving points are hidden with the golfer's arm and the like while the golfer is swinging. In this case, a camera is incapable of recognizing the moving points. Consequently it is impossible to obtain the coordinates of the positions of the moving points. Thus there is a high probability that the swing form is erroneously diagnosed. Another problem of this motion-diagnosing apparatus is that although numerical data such as the angle of the arm and the angle of the golf club is computed from coordinate data obtained by pursuing the moving points $P_1$ to $P_6$, how to utilize the obtained numerical data is not apparent. Such being the case, there is a growing demand for the development of systems capable of diagnosing the swing form and giving golfers advice.

Because the above-described apparatuses are installed at golf shops or the like, users cannot check their swing form for a long time. As such, these apparatuses are not convenient for the users.

Patent document 1: Japanese Patent Application Laid-Open No. 2003-117045

Patent document 2: U.S. Pat. No. 2,794,018

SUMMARY OF THE INVENTION

The present invention has been made in view of the above-described problems. Therefore it is an object of the present invention to provide a convenient golf swing-diagnosing system capable of reducing a computing time period and an erroneous recognition ratio of attention-focused points, diagnosing a swing form, and providing advice for results of a diagnosis.

To solve the above-described problems, there is provided a golf swing-diagnosing system including a computer for capturing a colored moving image in which a golfer swinging by gripping a golf club is photographed. The computer has an extraction means for selectively extracting one or more images each showing a swing posture as check-point images such as an address image, a take-back shaft 8 o'clock image, a take-back shaft 9 o'clock image, a take-back unskillful arm horizontal image, a top image, a downswing unskillful arm horizontal image, a downswing shaft 9 o'clock image, an impact image, a follow-through shaft 3 o'clock image, and a finish image from a large number of still images constituting the color moving image; a means for obtaining a coordinate of a position of each of attention-focused points, which operate, in each of the check-point images, while the golfer is swinging; a means for diagnosing a golfer's swing form by setting a plurality of diagnosis items each including a swing posture and a shaft angle for each trajectory pattern and by comparing numerical data generated from data of the coordinate of the position of each of the attention-focused points in each of the check-point images with a judgement value which is an ideal value inputted to the computer in advance; and a means for outputting an advice drill corresponding to a result of each of the diagnosis from a data base in which a plurality of advice drills prepared as a practicing method for improving a swing form is registered.

In the above-described construction, because diagnosis items are prepared according to each trajectory pattern, the swing form can be diagnosed by using them with high accuracy, and the swing form can be efficiently diagnosed by using only appropriate diagnosis items. For example, hook or slice may occur when the back of the golfer's wrist is bent in the top state. Thus the swing form can be appropriately diagnosed by preparing a plurality of trajectory patterns.

In addition to diagnose as to whether the swing form is good or bad, in accordance with the result of a diagnosis, the golf swing-diagnosing system automatically outputs the advice drill prepared as a practicing method for improving the swing form. Therefore the golf swing-diagnosing system is serviceable for effectively getting higher scores.

After still images (check-point images) useful for diagnosing the golf swing form are selectively extracted, the coordinates of the positions of the attention-focused points on the golfer are obtained. Therefore it is unnecessary to obtain the coordinates of the positions of the attention-focused points on the golfer for all frames (still images) of the moving image obtained by photographing the swing. Thereby it is possible to decrease the computation cost. Further because the above-described construction allows computations to be performed only for the check-point images, the above-described construction contributes to reduction of an erroneous recognition ratio of the attention-focused points. The attention-focused point may also include a golfer's silhouette, a color of a golfer's wear, a golfer's gloves or/and a golfer's skin color. The attention-focused point may be composed of one or more objects selected from among the golfer's silhouette, the color of the golfer's wear, the color of the golfer's gloves, and the golfer's skin color. The golfer's wear and the golfer's gloves mean the wear and the gloves respectively which the golfer has and include buttons or the like originally attached thereto, but do not include marks such as seals bonded thereto when the golf swing is measured. These attention-focused points eliminate the need for attaching marks to the golfer in measuring the golf swing and allow a measuring work to be performed efficiently, thus preventing the golf swing to be erroneously measured.

The above-described colored moving image may be captured by connecting a photographing camera to the computer or via a DV tape. The trajectory pattern may be automatically obtained by a ball motion measuring apparatus that will be described later or the golfer may input her/his trajectory pattern manually.

It is favorable that the trajectory pattern is divided into a pull hook, a pull, a pull slice, a straight hook, a straight, a straight slice, a push hook, a push, and a push slice. It is more favorable that the straight is divided into fade and draw.

The golf swing-diagnosing system has a ball motion measuring apparatus for measuring the behavior of a golf ball hit by the golfer. The trajectory pattern is obtained according to a side spin amount of the golf ball measured by the ball motion measuring apparatus and a deviation angle thereof measured thereby.

The above-described construction allows the trajectory of the hit ball to be obtained from the side spin amount and the deviation angle and allows the swing form to be classified according to the trajectory pattern.

The computer has an inquiry means through which the golfer inputs a trajectory pattern the golfer desires to be diagnosed before the golfer hits a golf ball so that when a trajectory pattern obtained from an actual behavior of the golf ball measured by the ball motion measuring apparatus conforms to or similar to the trajectory pattern inputted through the inquiry means, the computer outputs results of the diagnosis and an advice drill.

In the above-described construction, when the golfer desires to correct her/his trajectory pattern because a golf ball hit by the golfer slices, the golfer inputs "slice" through the inquiry means as the trajectory pattern to be diagnosed. Thereby when a trajectory pattern of the golf ball hit by the golfer is not the trajectory pattern to be diagnosed, the computer does not diagnose the trajectory pattern which is not desired to be diagnosed. On the other hand, when the golf ball hit by the golfer slices, the computer diagnoses the trajectory pattern. In this manner, the golf swing-diagnosing system executes a diagnosis suitable for users' needs.

It is judged that the golfer has a cock motion when a difference between a wrist angle in a predetermined swing posture and a wrist angle in another swing posture is not less than a predetermined value or when the wrist angle in the predetermined swing posture is not less than a predetermined value.

In the above-described construction, it is easy to diagnose whether the golfer has the cock motion which greatly changes the wrist angle between the shaft line of the golf club and the golfer's arm during the golfer's swing. More specifically, when the difference between the golfer's wrist angle in the downswing unskillful arm horizontal image and the golfer's wrist angle in the downswing shaft 9 o'clock image is not less than the predetermined value, the golfer's swing is diagnosed as having made the cock motion. Alternatively, when the golfer's wrist angle in the downswing unskillful arm horizontal image or in the downswing shaft 9 o'clock image is not less than the predetermined value, the golfer's swing may be diagnosed as having made the cock motion.

When a mark set in each of a plurality of diagnosis items satisfies or does not satisfy a judgement value which is an ideal value, the marks are added to each other.

In the above-described construction, by comparing a mark obtained as a result of a current diagnosis with a mark obtained as a result of a previous diagnosis, the golfer can accurately and easily grasp the degree of improvement, in the swing form, accomplished owing to practice which she/he has made in imitation of the advice drill. It is preferable that obtained marks are added to each other when each of them satisfies the ideal value. In this case, the more the total of the obtained marks is, the better the swing form is. It is permissible that obtained marks are added to each other when each of them does not satisfy the ideal value. In this case, the less the total of the obtained marks is, the better the swing form is.

It is preferable that the marks outputted for the respective diagnosis items are added to each other; and a total of the marks is outputted as a result of a diagnosis. Thereby it is possible to learn the entire evaluation of the swing form at a glance.

It is preferable to vary weighting for the mark of each of the diagnosis items by taking the degree of importance of each diagnosis item into consideration. It is preferable to output the total of marks as a golfer's level of skill. Let it be supposed that the total of marks is 100 points. In this case, if the golfer is given 90 points or more, the golfer has skill of a professional class. If the golfer is given 80 to 90 points, the golfer has skill of a high class. If the golfer is given 60 to 80 points, the golfer has skill of an average class. If the golfer is given 60 points or less, the golfer has skill of a beginner.

The present invention provides a golf swing-diagnosing system including a computer for diagnosing a golfer's swing form by setting a plurality of diagnosis items including a golfer's swing posture and a shaft angle by capturing an image in which a golfer swinging by gripping a golf club is photographed and comparing numerical data generated from data of a coordinate of a position of each of attention-focused points, which move when the golfer swings, in each of check-point images with a judgement value of each of a plurality of diagnosis items, which is an ideal value inputted to the computer in advance; and a server connected with the computer through a communication network and receiving swing information having results of a diagnosis on a swing form from the computer. A terminal information apparatus is connected to the communication network so that the golfer can access the server and read the swing information.

In the above-described construction, the golfer whose swing form has been diagnosed by the computer connects the terminal information apparatus (personal computer or portable telephone) to the communication network to access the server. Thereby the golfer can read swing information including the result of the diagnosis and analyze it for herself/himself.

Past swing information obtained is stored in time series in a data base of the server by relating the past swing information to the golfer.

In the above-described construction, the result of the diagnosis on the swing form is stored by relating the past swing information to the golfer like an album. Therefore by comparing a mark obtained as a result of a current diagnosis with a mark obtained as a result of a previous diagnosis, the golfer can easily analyze for herself/himself as to whether she/he has improved her/his swing form and improve her/his swing form efficiently.

The swing information has one or more check-point images, each showing a swing posture, such as an address image, a take-back shaft 8 o'clock image, a take-back shaft 9 o'clock image, a take-back unskillful arm horizontal image, a top image, a downswing unskillful arm horizontal image, a downswing shaft 9 o'clock image, an impact image, a follow-through shaft 3 o'clock image, and a finish image selected from among a large number of still images constituting the color moving image.

The above-described construction allows the golfer to check the still images (check-point images) useful for diagnosing the swing form on the screen of the terminal information apparatus. Therefore this construction is serviceable for visually finding defects of the golfer's swing form.

The swing information has a result of a trajectory of a golf ball hit by the golf club.

The above-described construction allows the golfer to analyze the result of the ball trajectory and the result of the swing form for herself/himself on the screen of the terminal information apparatus by linking both together. For example, the golfer can analyze her/his swing form effectively if a ball hit by her/him slices or hooks, thereby correcting the trajectory effectively.

The swing information has a plurality of advice drills which is prepared in correspondence to each of the diagnosis items as a practicing method for improving a swing form and is selected appropriately in correspondence to a result of a diagnosis on the swing form from a data base in which the advice drills are registered.

The above-described construction allows the advice drill prepared as the practicing method for improving the swing form to be displayed on the screen of the terminal information apparatus as the swing information in correspondence to the result of the diagnosis in addition to the diagnosis as to whether the swing form is good or bad. Therefore the golfer practices in accordance with the advice drill, which is convenient for the golfer in improving her/his swing form.

It is preferable that each of the advice drills has a sample moving image for explaining a practicing method.

Thereby the golfer can practice to improve her/his swing form by merely imitating motions displayed on the sample moving image. The golfer can exercise the advice drill more easily than a practicing method shown by text. Therefore the golfer can correct her/his swing form easily by carrying out a proper method prepared based on the advice drill.

The swing information has contents of inquiry inputted before hitting a golf ball.

The above-described construction allows the golfer to analyze the result of the diagnosis for herself/himself at home, while the golfer is checking the contents of inquiry such as full name, sex, age, height, weight, golf history, trajectory pattern, desired diagnosis content, and style of dress by means of a terminal information apparatus.

It is preferable that the swing information has information of a loft angle of a golf club head selected according to an angle of elevation of a golf ball and a trajectory height thereof measured by a ball motion measuring apparatus.

That is, when it is judged that the measured angle of elevation of the ball and the measured trajectory height thereof are smaller than a predetermined angle of elevation and a predetermined trajectory height respectively, a golf club having a large loft angle should be recommended. On the other hand, when it is judged that the measured angle of elevation of the ball and the measured trajectory height thereof are larger than the predetermined angle of elevation and the predetermined trajectory height respectively, a golf club having a small loft angle should be recommended.

A differential silhouette is obtained by executing differential processing between a top image in which a swing posture of a top state is photographed and an image obtained at a predetermined time period after the top image so that a change-over motion of changing a backswing to a forward swing at the top state (hereinafter referred to as a conversion from backswing to forward swing at top state) is diagnosed by using an area of the differential silhouette. The conversion from backswing to forward swing which is made at the top state is diagnosed.

The above-described construction allows the area of the differential silhouette to be considered as the motion amount of the golfer's body in the conversion from backswing to forward swing which is made at the top state. Therefore it is possible to diagnose that the motion amount of the upper half of the golfer's body is large in the conversion from backswing to forward swing made at the top state or the motion amount of the lower half thereof is small in the conversion from backswing to forward swing made at the top state.

In the above-described construction, the golfer can recognize her/his conversion from backswing to forward swing made at the top state visually by displaying the swing information including the differential silhouette on the screen of the terminal information apparatus.

A conversion from backswing to forward swing made at the top state may be diagnosed based on a difference of an angle formed between a shaft line in a downswing unskillful arm horizontal image and a shaft line in an address image when a golfer is seen rearward therefrom in a ball fly line direction.

The result obtained by diagnosing the swing includes a wrist angle. The swing information has information of an optimum golf club shaft chosen from the result obtained by diagnosing the conversion from backswing to forward swing made at the top state and the wrist angle.

The flexing speed of the golf club shaft and the speed of the golfer's hand speed are main two factors which determine the head speed. The flexing speed of the golf club shaft is maximum when the center of gravity of the golf club head is disposed lowermost in the swing orbit of the golf club shaft. The deformation direction of the golf club shaft varies according to a swing pattern. The center of gravity of the golf club head is disposed lowermost at different times in the impact state. Therefore an optimum golf club shaft is different according to a swing pattern. The hand speed is dependent on a golfer's swing pattern. More specifically, some golfers' swing speeds become suddenly low before the impact time, whereas some golfers' swing speeds become suddenly high before the impact time. To hit the ball when the head speed is highest, a soft golf club shaft is optimum for golfers whose swing speeds become suddenly low before the impact time, whereas a hard golf club shaft is optimum for golfers whose swing speeds become suddenly high before the impact time.

In consideration of the above, the golf swing-diagnosing system provides an optimum rigidity of the golf club shaft, based on a judgement standard prepared in combination of an item of judging whether the conversion from backswing to forward swing made at the top state is performed by a body turn (importance is given to motion of lower half of body) or by an arm turn (importance is given to motion of upper half of body) and an item of judging whether the golfer performs a cock motion.

As apparent from the foregoing description, according to the present invention, because diagnosis items are prepared according to each trajectory pattern, the swing form can be efficiently diagnosed by using only appropriate diagnosis items. Thus the swing form can be diagnosed with high accuracy. In addition to the diagnosis of the golfer's swing form, in accordance with the result of the diagnosis, the advice drill prepared as the practicing method for improving the swing form is automatically outputted. Therefore the golfer can take proper defect-overcoming countermeasures instantly.

After still images (check-point images) useful for diagnosing the golf swing form are selectively extracted, the coordinates of the positions of the attention-focused points on the golfer are obtained. Therefore it is unnecessary to obtain the coordinates of the positions of the attention-focused points on the golfer for all frames (still images) of the moving image. Thereby it is possible to decrease the computation cost and the erroneous recognition ratio of the attention-focused points.

The golfer who has been diagnosed in her/his swing form by the computer connects the terminal information apparatus to the communication network to access the server. Thereby the golfer can read the swing information including the result of the diagnosis and analyze it for herself/himself. In the above-described construction, the result of the diagnosis on the swing form is stored for each golfer in the data base. Therefore by comparing a mark obtained as a result of a current diagnosis with a mark obtained as a result of a previous diagnosis, the golfer can improve her/his swing form.

BRIEF DESCRIPTION OF THE DRAWINGS

FIG. 29 shows extraction of a left shoulder, in which

DETAILED DESCRIPTION OF THE PREFERRED EMBODIMENTS

The embodiments of the present invention will be described below with reference to drawings.

Figure 1:
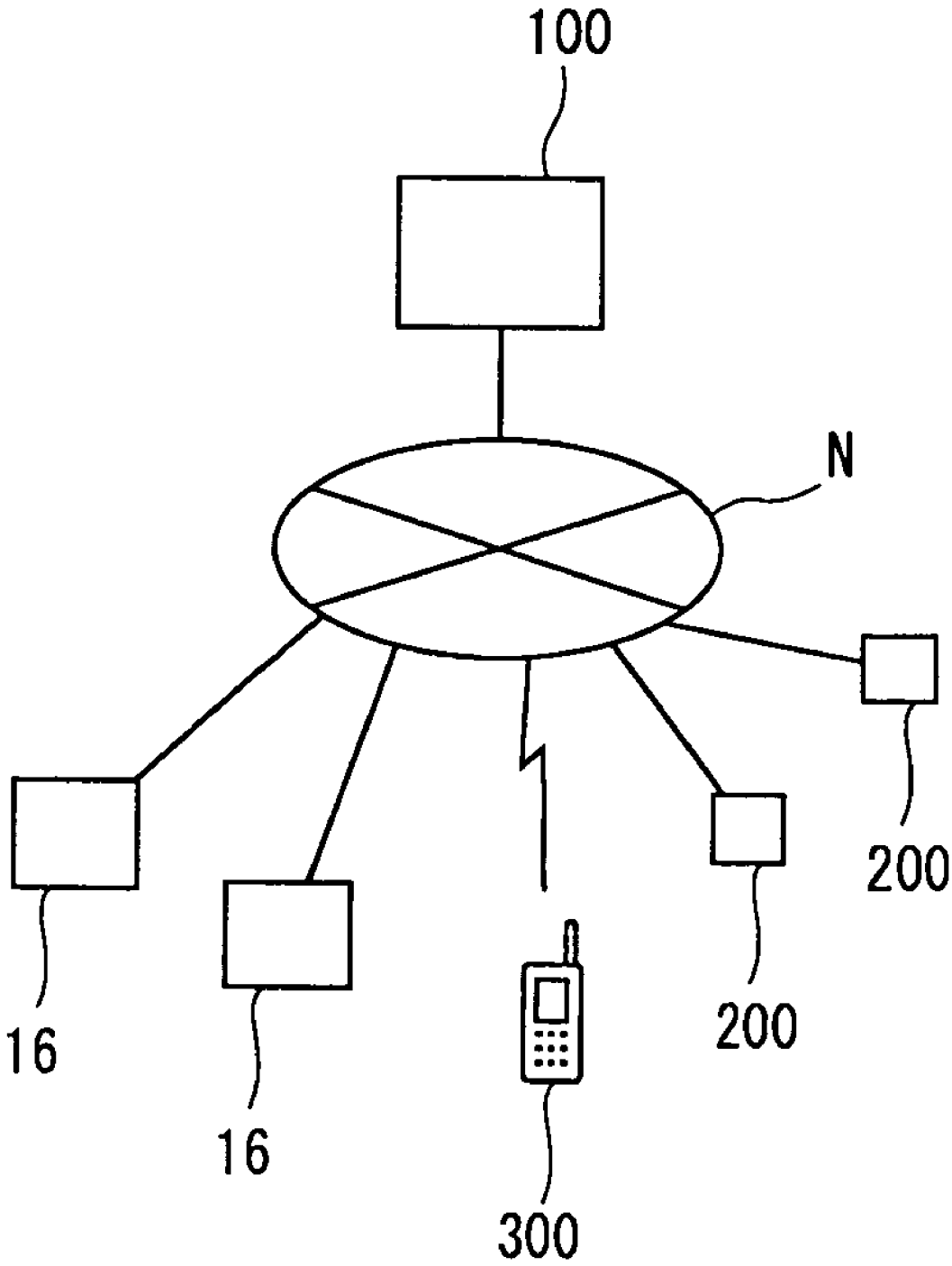
FIG. 1 shows the construction of a golf swing-diagnosing system of an embodiment of the present invention.

FIG. 1 shows a schematic view of the golf swing-diagnosing system. The golf swing-diagnosing system has a computer 16 installed at golf shops or the like; a server 100 having a data base, a personal computer 200 and a portable telephone 300 serving as terminal information apparatuses disposed in the house of a golfer 11 who is a client. The personal computer 200 and the portable telephone 300 can be connected to an internet N.

Figure 2:
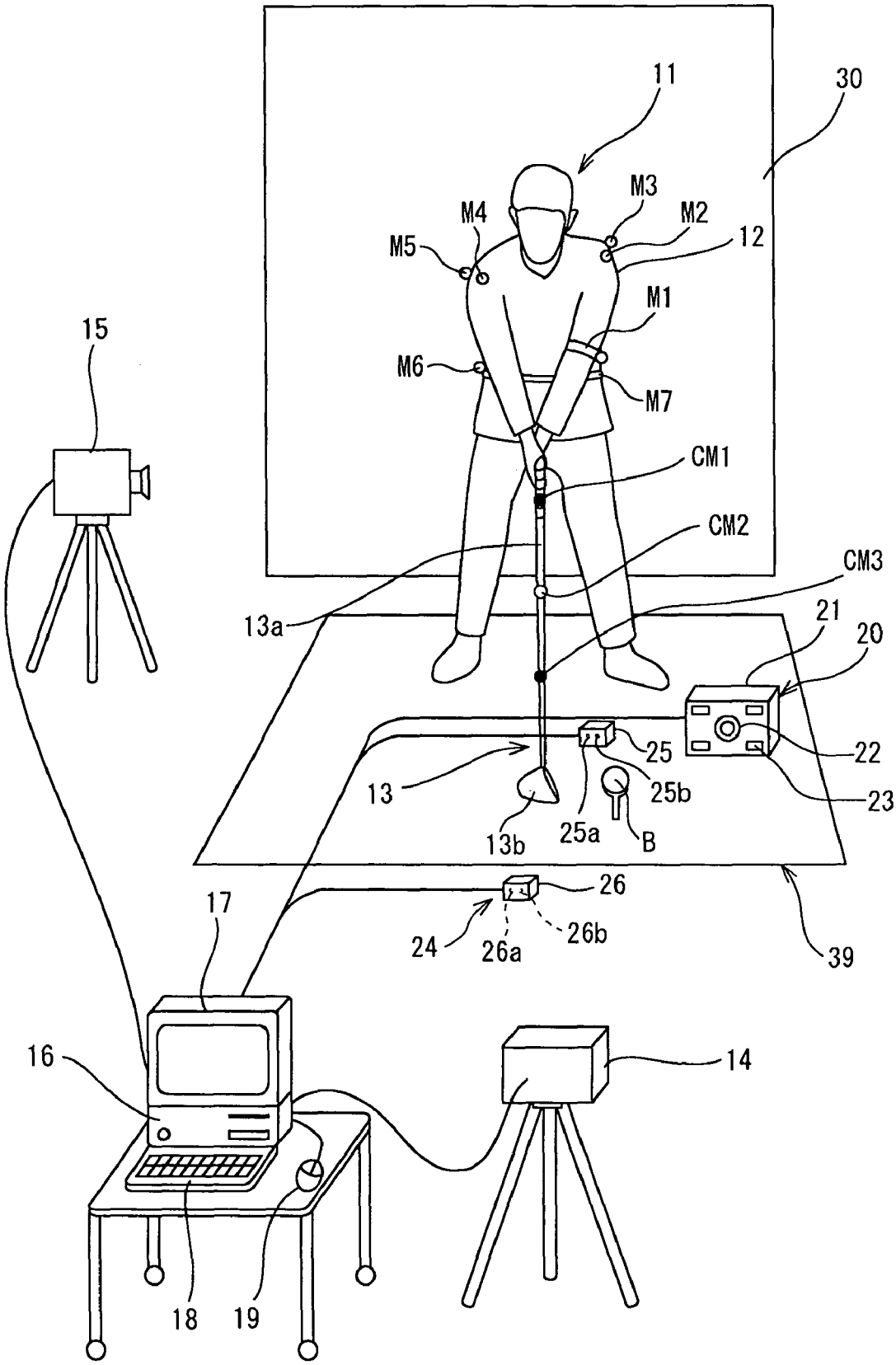
FIG. 2 shows diagnosis of a swing.

As shown in FIG. 2, at golf shops and the like, the golf swing-diagnosing system has a monitor 17 serving as a display means connected to the computer 16; a key board 18 and a mouse 19, serving as input means, which are connected to the computer 16; color CCD cameras 14 and 15, connected to the computer 16, which are installed at a position forward from a golfer 11 and at a position rearward from the golfer 11 in a ball fly line direction (in side view) respectively, and a ball motion measuring apparatus 20. A rectangular frame 39 is installed on the ground at a position surrounding the golfer 11 and a ball B.

In this embodiment, the computer 16 is connected not only with the color CCD cameras 14 and 15 but also with the ball motion measuring apparatus 20. However, to distribute the load for processing to be applied the computer 16, two computers may be prepared.

The ball motion measuring apparatus 20 is the same as that disclosed in Japanese Patent Application No. 2001-264016. The ball motion measuring apparatus 20 has a CCD camera 21 including a multiple shutter 22 which can be successively opened and closed and four stroboscopes 23. The ball motion measuring apparatus 20 and a hitting speed-measuring sensor 24 are connected with the computer 16. The hitting speed-measuring sensor 24 is constructed of a pair of light-projecting devices 25 and a pair of light-receiving devices 26. Each of the light-projecting devices 25 has light-projecting parts 25*a*, 25*b* that radiate infrared light. Each of the light-receiving devices 26 has light-receiving parts 26*a*, 26*b* for detecting the infrared light.

A golfer 11 (right-handed) who is a person to be diagnosed in her/his swing form wears dress 12 over private dress. Colored marks M1 through M7 are attached to attention-focused points of the golfer 11. The dress 12 for measuring her/his swing form are white. A yellow colored mark M1 is attached to the left elbow. A red colored mark M2 and a blue colored mark M3 are attached to the left shoulder. A blue colored mark M4 and a red colored mark M5 are attached to the right shoulder. A blue colored mark M6 is attached to the right shoulder. A red colored mark M7 is attached to the waist. The colored mark M1 at the left elbow is armband-shaped. The colored mark M7 at the waist is belt-shaped. The other colored marks M2 through M6 are button-shaped (spherical). The attention-focused point means golfer's head, neck, shoulder, elbow, waist, knee, ankle, wrist or/and toe. The attention-focused point includes not only the golfer's joints and other parts, but also colored marks mounted on a golf club shaft, a golf ball, and the like useful for diagnosing the swing.

Three colored marks CM1, CM2, and CM3 are mounted at regular intervals on a shaft 13*a* of the golf club 13 gripped by the golfer 11. The colored marks CM1, CM2, and CM3 are mounted on the shaft 13*a* at regular intervals from a grip side to a head side. The colored mark CM1 nearest to the grip is yellow. The colored mark CM2 disposed between the colored marks CM1 and CM3 is pink. The colored mark CM3 disposed nearest to the head 13*b* is yellow. That is, the adjacent color marks have different colors. In this embodiment, the distance between the colored marks CM1 and CM2 and the distance between the colored marks CM2 and CM3 are set to 250 mm respectively. The distance between the grip end and the colored mark CM1 is set to 250 mm.

The computer 16 synchronizes the photographing timing of the color CCD cameras 14 and 15 with each other. When a high-speed digital CCD camera is used, it has not less than 30 frames and favorably not less than 60 frames per second. The shutter speed thereof is set to not more than 1/500s and favorably not more than 1/1000s.

It is necessary to set the brightness of a space (3 m (length)×3 m (width)×2 m (height)) in which a golfer's swing form is photographed to a possible highest lux. If an extremely bright portion is generated in the space, there is a possibility that halation is generated. Therefore as the brightness of the environment in which the golfer swings, it is preferable to set a uniform brightness in the range of not more than 3000 luces. It is preferable that a background 20 of the space in which the swing form is photographed has a color different from the color of the dress of the golfer 11, those of the color marks M1 through M7, and those of the colored marks CM1 through CM3 so that the color marks M1 through M7 and the colored marks CM1 through CM3 can be extracted easily.

The computer 16 is online with the color CCD cameras 14, 15 through a LAN cable, an IEEE1394 or a Camera Link Standard. A moving image (a plurality of still images) of the swing photographed by the color CCD cameras 14, 15 is stored in the hard disk of the computer 16, a memory of the computer 16 or the memory of the board thereof. As will be described later, the computer 16 has a program having a means for executing binarizing processing for each pixel of a plurality of the still images by using a specific threshold of color information and recognizing pixels, of the still images, which satisfy the threshold as a position of each of the colored marks CM1 through CM3 so as to obtain coordinate data of each of the colored marks CM1 through CM3; a means for recognizing the movement of the shaft 13*a*, based on the coordinate data of the colored marks CM1 through CM3; a means for recognizing the movement of the golfer's arm, an image extraction means for selectively extracting the still images necessary for measuring the swing, based on movement data of the shaft 13*a*; and a means for computing the behavior of the ball, based on information obtained by the ball motion measuring apparatus 20.

Figure 3:
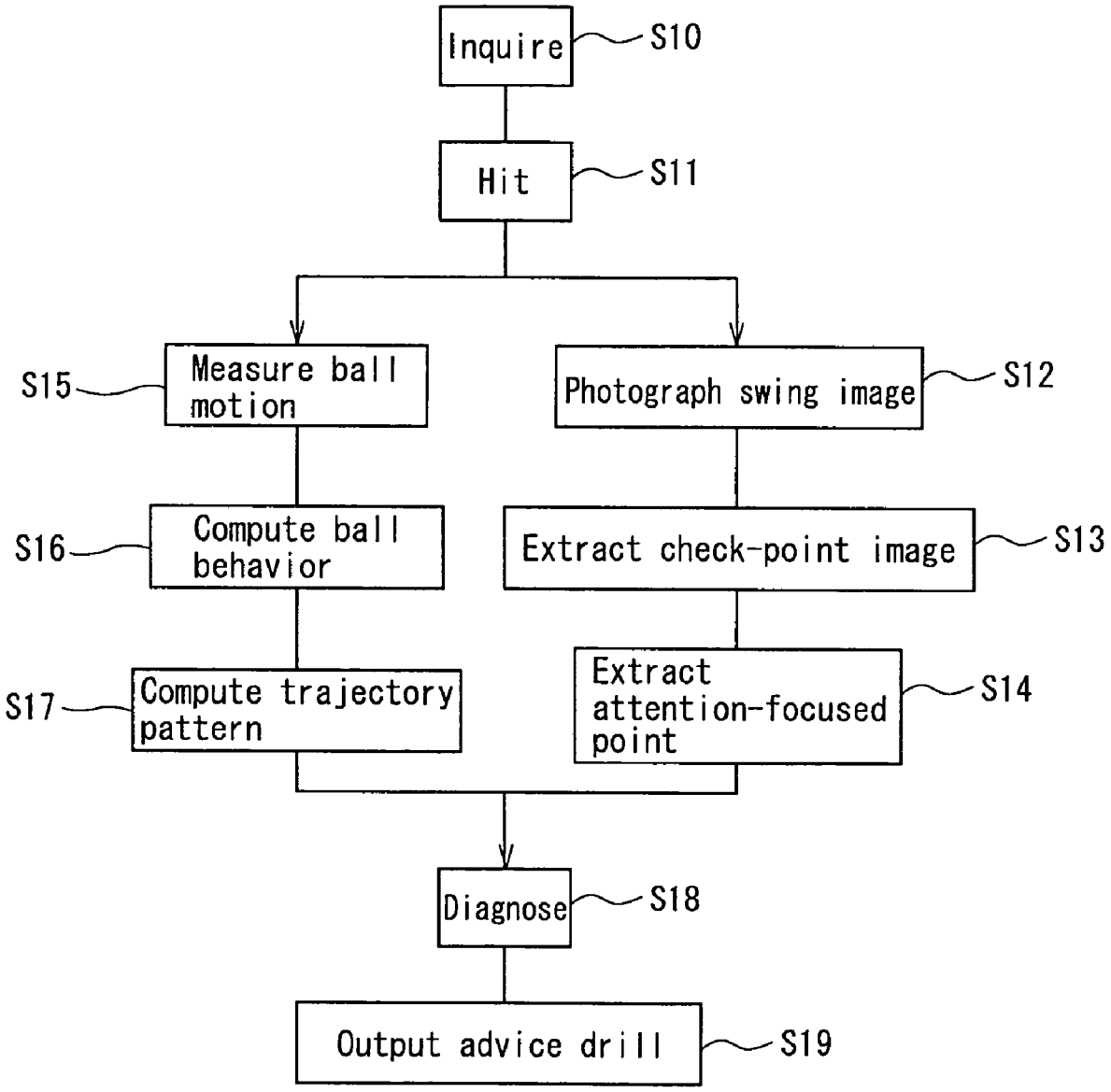
FIG. 3 is a flowchart schematically showing the golf swing-diagnosing system of the embodiment of the present invention.

The golfer's swing is diagnosed based on the flowchart shown in FIG. 3.

Initially, by using the mouse 19 or the key board 18 (or touch panel), the golfer 11 inputs a response for the contents of inquiry displayed on the inquiry screen of the monitor 17 of the computer 16 (step S10). At this time, it is preferable that the color CCD cameras 14 and 15 read a background image in which only the background 30 (the golfer 11 is not present) is photographed.

As the contents of the inquiry, the golfer's full name, sex, age, height, weight, golf history, a path described by a ball hit by the golfer (trajectory pattern), a diagnosis content, a desired mode, and the style of dress are prepared.

Figure 30:
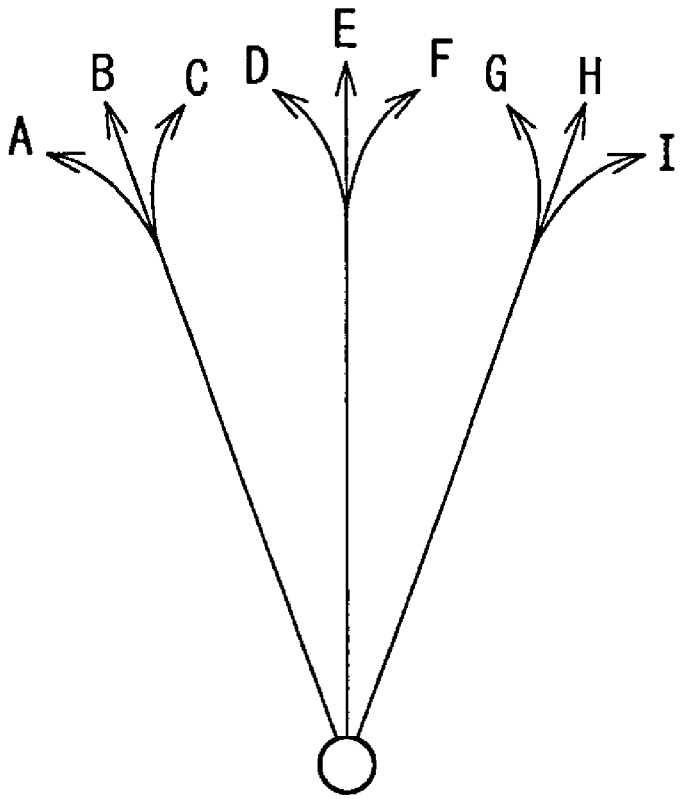
FIG. 30 shows a screen of an terminal information apparatus.

As shown in FIG. 30, as the inquiry about the path described by the ball hit by the golfer 11, the golfer 11 can inquire about her/his trajectory pattern (A through I) of the ball stroked by the golfer 11 such as slice, hook, straight, and nothing particular to inquire are available. As the default, "nothing particular to inquire" is provided.

In the diagnosis content, the following selection items of a diagnosis mode are provided as a diagnosis mode: "I want to hit a ball straight", "I want to increase a flight distance (distance from hitting point to drop point)", and "I have nothing particular to inquire". In addition, in the diagnosis content, "I want to learn the fundamentals of a golf swing" is also provided as the item of an analysis mode. As the default, "I want to hit a ball straight" is provided.

In the diagnosis content of the style of dress, the golfer answers a question of "Please select one style of dress from among dress with half-length sleeves, dress with long sleeves, dress for measuring a swing, and dress (black) for photographing and measuring the swing".

The results of the inquiries and responses are stored in the hard disk of the computer 16 as the initial set file.

Thereafter the golfer 11 hits a ball. A still image for each frame of the swing moving image is captured into the computer 16 from the color CCD cameras 14, 15 and stored in the hard disk, the memory of the computer 16 or the memory of the board thereof (step S12). At this time, the motion of the ball B stroke by the ball motion measuring apparatus 20 is measured (step S15). A diagnosis which will be described below is executed, when a trajectory pattern obtained from an actual behavior of the ball B obtained by the ball motion measuring apparatus 20 after the golfer 11 hits five balls matches or is similar to a trajectory pattern inputted by the golfer 11 in the inquiry. Alternatively, an image to be diagnosed may be selected irrespective of whether the obtained trajectory pattern matches or is similar to the trajectory pattern inputted by the golfer 11 in the inquiry.

Thereafter the following check-point images useful for diagnosing the swing are automatically extracted from a large number of the still images constituting the moving image of the swing: an address image, a take-back shaft 8 o'clock image, a take-back shaft 9 o'clock image, a take-back left arm horizontal image, a top image, a swing direction change-over motion made at the top state image a downswing left arm horizontal image, a downswing shaft 9 o'clock image, an image previous to an impact image, the impact image, an image subsequent to the impact image, a follow-through shaft 3 o'clock image, and a finish image (step S13).

As described above, the check-point images are automatically extracted from a large number of the still images constituting the moving image of the swing. Thus this method has an advantage that computations are performed only for the above-described check-point images in extracting the coordinates of the positions of the attention-focused points attached to the golfer' body 11 by using the colored marks M1 through M7, the contour processing, and the like which are executed in a subsequent step.

The method of automatically extracting each check-point image is described below.

Address Image

Initially, the method of extracting the address image is described below. The address image means a still image in the state in which the golfer 11 takes an address posture.

When photographing of the moving image of the swing starts from the address state, an initial image is set as the address image. When a sound generated at the impact time and a signal outputted from an impact sensor are obtained as a trigger signal and when the moving image in a predetermined period of time before and after the impact time is obtained, the initial image is not necessarily the address image. This is because the initial image includes the image of a waggle (operation of swinging golf club head as a preparatory operation before addressing ball). Thus in this case, differential processing is executed between frames (still images). A frame having a minimum differential is regarded as the state in which the golfer 11 is stationary and regarded as the address image.

Thereafter the method of extracting the take-back shaft 9 o'clock image, the top image, the downswing shaft 9 o'clock image, the image previous to impact image, the impact image, the image subsequent to impact image, the follow-through shaft 3 o'clock image, and the finish image is described below.

The take-back shaft 9 o'clock image means a still image which is placed at a nine o'clock position at a take-back time, when the shaft is regarded as the needle of a clock. The top image is a still image placed at a top position at which the swing shifts from a take-back to a downswing. The downswing shaft 9 o'clock image means a still image placed at the nine o'clock position in the downswing, when the shaft is regarded as the needle of the clock. The image previous to impact image means a still image in a state immediately before the golf club head impacts the ball. The impact image means a still image at the time when the golf club head collides with the ball. The image subsequent to impact image means a still image in a state immediately after the golf club head impacts the ball. The follow-through shaft 3 o'clock image means a still image placed at the three o'clock position at a follow-through time when the shaft is regarded as the needle of the clock. The finish image means a still image when the swing has finished and the golf club stops moving.

Basically, the swing posture shown on each check-point image is judged by tracing the coordinates of the colored marks CM1 through CM3 of each frame. Thus initially, the method of automatically tracing the colored marks CM1 through CM3 is described below.

Figure 4:
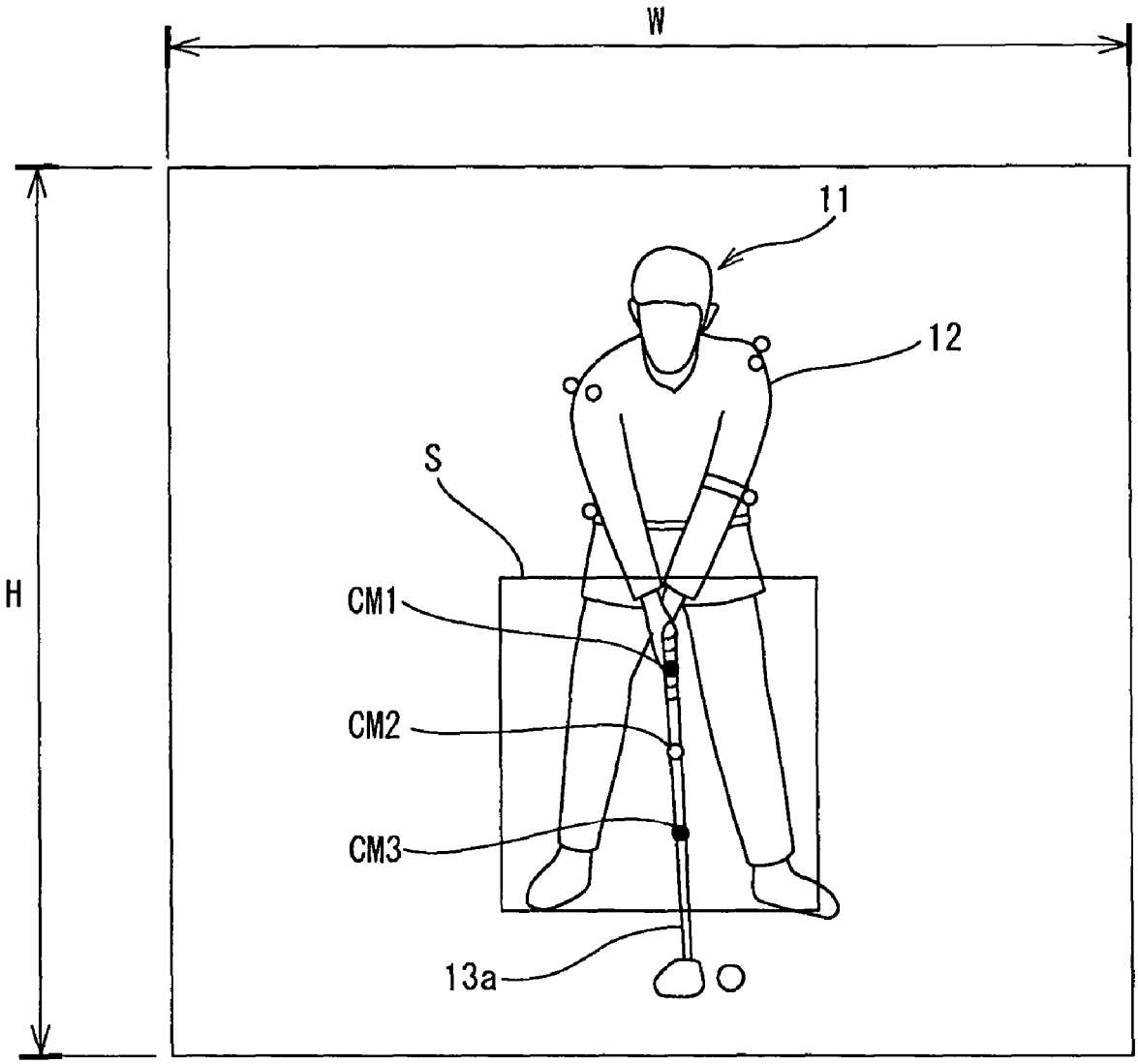
FIG. 4 is an explanatory view for explaining extraction of colored marks in an address image.

Binarizing processing for automatically recognizing the colored marks CM1 through CM3 is executed in the address image. The binarizing processing is executed for the entire frame in this embodiment. But the binarizing processing may be executed for only a region S in which the shaft 13*a* is considered present, when the region to be photographed is so limited that the golfer 11 is photographed in the vicinity of the center of the image, as shown in FIG. 4. Supposing that the width of the image is W and that the height thereof is H, the range of W/3 to 2W/3 is set as the width of the region S, and the range of H/2 to 4H/5 is set as the height of the region S.

As the method of executing the binarizing processing, the value of R, G, and B or Y, I, and Q may be used. In this embodiment, hue, saturation, lightness which allow the color of the colored marks CM1 through CM3 to be recognized to the highest extent are utilized. The binarizing processing is executed as follows: Initially, the value of R, G, and B of each pixel on the frame is obtained.

$$T=R+G+B \qquad \text{Equation 1}$$

Normalization of an equation 2 shown below is performed by using a stimulus sum T determined by the equation (1).

$$r=\frac{R}{T},\ g=\frac{G}{T},\ b=\frac{B}{T} \qquad \text{Equation 2}$$

When the color is expressed in 24 bits, the value of R, G, and B is in the range of 0 to 255.

The hue θ is computed by using equations 3 and 4 shown below.

$$\theta_1=\cos^{-1}\frac{2r-g-b}{\sqrt{6[(r-1/3)^2+(g-1/3)^2+(b-1/3)^2]}} \qquad \text{Equation 3}$$

Because $0 \leqq \theta_1 \leqq \pi$, the equation 4 is as shown below:

$$\theta=\begin{cases}\theta_1 & g \geq b\\ 2\pi-\theta_1 & g<b\end{cases} \qquad \text{Equation 4}$$

The saturation S is computed by using an equation 5 shown below.

$$S=1-3\min(r, g, b) \quad \text{Equation 5}$$

The lightness V is computed by using an equation 6 shown below.

$$U=\frac{R+G+B}{3} \quad \text{Equation 6}$$

When the value of the hue, saturation, lightness of a pixel (color information of pixel) obtained by using the equations 3 through 6 does not satisfy a predetermined condition (reference color information), the pixel is set to 0. When the value of the hue, saturation, lightness of a pixel satisfies the predetermined condition, the pixel is regarded as having the same color as that of the colored marks CM1 through CM3 and set to 1, and labeling processing of pixels set to 1 is executed sequentially.

As the predetermined condition of the hue, the saturation, and the lightness, a threshold having the hue θ=30° to 60°, the saturation S≧0.5, and the lightness V≧100 is set for the yellow colored marks CM1 and CM3. A threshold having the hue θ=320° to 360° or 0 to 10°, the saturation S=0.3 to 0.6, and the lightness V≧80 is set for the pink colored mark CM2. In this manner, pixels satisfying these predetermined conditions are regarded as having the same color as that of the colored marks.

There is actually only one pink colored mark CM2. When an unrelevant pink color is present in the image, there is a fear that two or more regions are extracted. In consideration of such a case, the area range of the colored mark CM2 is set in advance. A region having an area larger than the set area range is judged as not the colored mark CM2, whereas a region having an area smaller than the set area range is recognized as the colored mark CM2. In this embodiment, the area range recognized as that of the colored marks CM1 through CM3 is 5 to 60 pixels or 5 to 200 pixels.

When pixels recognized as the colored marks CM1 through CM3 in the above-described manner are set to 1, 2, and 3 respectively by labeling the colored marks CM1 through CM3, the color information of the colored marks and the coordinate of the center of gravity thereof are obtained from the pixels set to the respective numerical values. The color information of the colored mark means the information including an average color of pixels in the region, maximum and minimum values of the R, G, and B of each pixel, and the fluctuation width thereof.

By executing the above-described processing, it is possible to automatically and precisely extract the colored marks CM1 through CM3 attached to the shaft 13*a* of the golf club 13.

Processing of automatically tracing the colored marks CM1 through CM3 extracted automatically in the address image is executed for second and third images after the address image is obtained.

Figure 5:
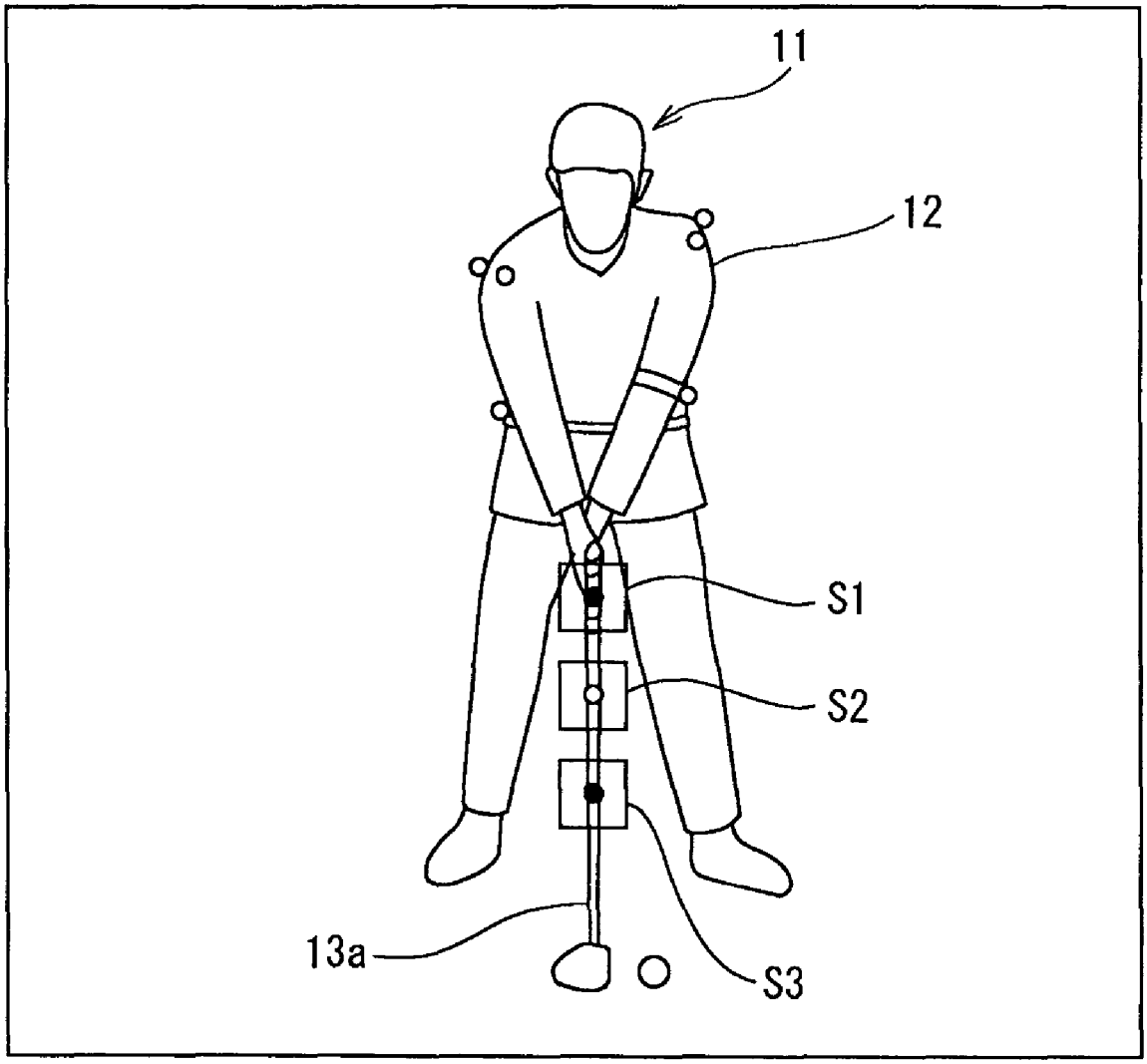
FIG. 5 is an explanatory view for explaining extraction of the colored marks in second and third images subsequent to the address image.

As shown in FIG. 5, square search ranges S1 through S3 are set on the colored marks CM1 through CM3 respectively, with the colored marks CM1 through CM3 disposed at the center thereof. The search ranges S1 through S3 mean the range of the image in which computations are performed to execute processing of detecting the colored marks CM1 through CM3. By introducing the concept of the search ranges S1 through S3, the processing of detecting the colored marks CM1 through CM3 is executed only within the search ranges S1 through S3, even if there is a portion having a color proximate to that of the colored marks CM1 through CM3 outside the search ranges S1 through S3. Therefore it is possible to prevent the portion from being erroneously recognized as the colored marks CM1 through CM3. It is also possible to make a computing period of time much shorter than that required in the case where binarizing processing is performed for all pixels. In this embodiment, in the search ranges S1 through S3, by default, a length×breadth (YX) range is set to 10×10 pixels with the colored marks CM1 through CM3 disposed at the center of the search ranges S1 through S3 respectively. The horizontal direction in each image is set as the X-axis. The vertical direction in each image is set as the Y-axis. The direction facing toward the right in each image is the positive direction of the X-coordinate. The direction looking downward in each image is the positive direction of the Y-coordinate. The shaft 13*a* hardly moves in the second image and the third image after the address image is obtained. Thus the search ranges S1 through S3 during the automatic tracing operation is determined by setting the colored marks CM1 through CM3 automatically recognized in the image one unit time previous to the current time as the central position of the search ranges S1 through S3 respectively.

Thereafter the color range is set.

The color range means an error-allowable range in which the color information of pixels of the image to be processed is the same as that of the colored marks CM1 through CM3 in recognizing the colored marks CM1 through CM3. In this embodiment, the numerical range of the half of the difference between a maximum width and a minimum width is set as the color range in which an average value of each of R (red), G (green), and B (blue) which are the color information of the colored marks CM1 through CM3 obtained in the address image is disposed at the center of the color range.

The automatic tracing processing to be described below is executed by tracing the colored marks CM1 through CM3 sequentially from the colored mark CM1, disposed nearest the grip, which moves at a speed lower than the other colored marks CM2 and CM3 during the swing to the colored mark CM2 and then to the colored mark CM3.

It is judged whether or not each of the R, G, and B of the differential pixel inside the search range S1 falls in the above-described color range. Pixels falling in the color range are regarded as the pixels indicating the colored mark M1, and the position of the center of gravity of the group of the extracted pixels is obtained. If this method of using the color range is incapable of tracing the colored marks, a color extraction may be performed to trace them by utilizing the color information (hue, saturation, lightness). These processing is executed for each of the search ranges S1 through S3 of the colored marks M1 through M3.

If a plurality of mark candidate regions is extracted inside the search range, differential processing is executed between the colored mark M1 and the background image in the search range S1. Thereby the background image is removed from the search range S1. Thus even though a color proximate to that of the colored mark M1 is present in the background image, the color is not erroneously recognized as that of the colored mark M1 in subsequent steps of recognizing the colored mark M1.

Description is made on the method of setting the central position of the search ranges S1 through S3 of the colored marks CM1 through CM3 in frames subsequent to the fourth frame with respect to the address image. In the case of the colored mark CM1 nearest the grip, a movement vector amount V1 between a first frame (address) and a second frame and a movement vector amount V2 between the second frame and a third frame are computed. In consideration of an increase amount V2-V1, a movement vector amount {V2+(V2−V1)} between the third frame and the fourth frame is estimated. A position to which the colored mark M1 is offset by the movement vector amount {V2+(V2−V1)} from the central position of the search range S1 at one unit time previous to the current time is set as the center of the search range S2 of the current-time image (fourth frame). The method of setting the central position of each of the search ranges S1 through S3 of the colored marks CM1 through CM3 in the fifth frame and those subsequent to the fifth frame is carried out similarly.

The method of setting the central position of each of the search ranges S2 and S3 of the colored marks CM2 and CM3 in the fourth frame is executed as follows: The colored marks CM2 and CM3 are offset from the central position of each of the search ranges S2 and S3 at one unit time previous to the current time by the movement vector amount {V2+(V2−V1)} obtained by utilizing the colored mark CM1 whose position has been decided. A shaft angle D1 between the first frame and the second frame and a shaft angle D2 between the second frame and third frame are computed. In consideration of an increase amount D2−D1, a shaft angle {D2+(D2−D1)} between the third frame and the fourth frame is estimated. Each of the colored marks CM2 and CM3 is rotated on the colored mark CM1 of the fourth frame by the shaft angle {D2+(D2−D1)}. The method of setting the central position of each of the search ranges S2 and S3 of the colored marks CM2 and CM3 in the fifth frame and those subsequent to the fifth frame is executed similarly.

Figure 6:
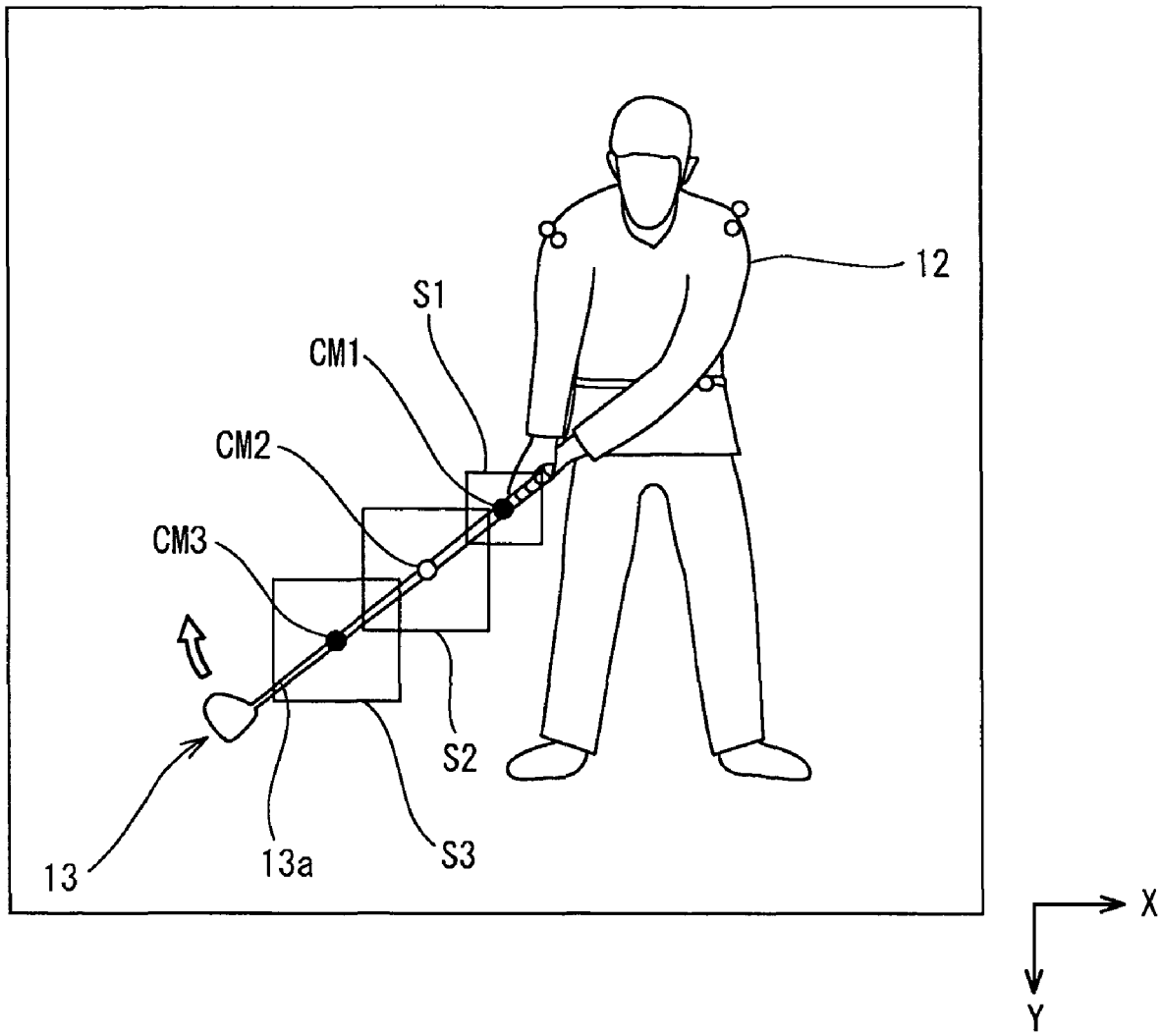
FIG. 6 is an explanatory view for explaining automatic tracing of the colored marks.

By deciding the central position of each of the search ranges S2 and S3 in combination of the offset movement and the rotation movement, it is possible to estimate the position of the shaft 13*a* considerably accurately, even when the shaft 13*a* moves fast in a downswing. Thus it is unnecessary to increase the area of the search ranges S2 and S3 while the positions of the colored marks CM1 through CM3 are being traced. As shown in FIG. 6, the area of each of the search ranges S2 and S3 is set to 20×20 pixels.

If a plurality of colored mark candidate regions is extracted in the search range, differential processing is executed between the image of the colored mark M1 and the background image inside the search range S1. Thereby the background image is removed from the search range S1. Thus even though a color proximate to that of the colored mark M1 is present in the background image, the color is not erroneously recognized as that of the colored mark M1 in subsequent steps.

When the positions of the colored marks CM1 through CM3 cannot be traced by the above-described method, binarizing processing is executed again by executing a method similar to the method by which the colored marks CM1 through CM3 are automatically extracted in the address image. That is, as the main conceivable reason the colored marks CM1 through CM3 cannot be found in the color range determined in the address image, the colored marks CM1 through CM3 present in a range darker than the address image is traced. Thus alteration of reducing the threshold of the saturation and lightness of the colored marks CM1 through CM3 is made to execute the binarizing processing again.

When the positions of the colored marks CM1 through CM3 cannot be still traced and when two of the three colored marks CM1 through CM3 can be recognized, the position of the remaining one mark is computed from the positional relationship between the two colored marks. Alternatively, the center of the search range in which the colored mark is offset by the above-described method may be regarded as the position thereof at the current time.

The coordinate data of the positions of all the colored marks CM1 through CM3 during the golfer's swing motion from the address till the finish can be obtained in the above-described manner.

The following check-point images are extracted in dependence on the coordinate data of the colored marks CM1 through CM3 obtained during the swing.

Take-Back 9 O'Clock Shaft Image

The angle of the shaft 13*a* is computed by using two of the colored marks CM1 through CM3 and by selecting an image in which the shaft 13*a* is nearest a horizontal direction (90°). Thereby the take-back shaft 9 o'clock image is extracted. Alternatively, when one of the colored marks CM1 through CM3 is used, the take-back shaft 9 o'clock image may be extracted by selecting an image in which an X-direction component of the movement vector of the colored mark is minimum. It is to be noted that the state in which the shaft 13*a* is 6 o'clock is 00 in its angle and that the clockwise direction is positive.

Top Image

The angle of the shaft 13*a* is computed by using two of the colored marks CM1 through CM3 and by selecting an image in which the shaft 13*a* has a largest angle. Thereby the top image is extracted. Alternatively, when one of the colored marks CM1 through CM3 is used, the take-back shaft 9 o'clock image may be extracted by selecting an image in which X-direction and Y-direction components of the movement vector of the colored mark are minimum respectively.

Downswing 9 O'Clock Shaft Image

The angle of the shaft 13*a* is computed by using two of the colored marks CM1 through CM3 and by selecting an image in which the shaft 13*a* is nearest the horizontal direction (90°) and which is subsequent to the top image in time. Thereby the downswing shaft 9 o'clock image is extracted. When one of the colored marks CM1 through CM3 is used, the downswing shaft 9 o'clock image is extracted by selecting an image in which the X-direction component of the movement vector of the colored mark is minimum and which is subsequent to the top image in time.

Impact Image

The angle of the shaft 13*a* is computed by using two of the colored marks CM1 through CM3 and by selecting an image in which the shaft 13*a* has an angle nearest 0°. Thereby the impact image is extracted. Alternatively, when one of the colored marks CM1 through CM3 is used, the impact image may be extracted by selecting an image in which the Y-direction component of the movement vector of the colored mark is minimum. The impact image may be also extracted by using an external trigger signal. The impact image may be also extracted by utilizing a sound generated when the ball impacts the head of the shaft.

Image Previous to Impact Image

The image previous to the impact image is extracted by selecting an image obtained by rewinding frames for a predetermined period of time (or predetermined number of frames) with respect to the time when the impact image is extracted.

Image Subsequent to Impact Image

The image subsequent to the impact image is extracted by selecting an image obtained by advancing frames for a predetermined period of time (or predetermined number of frames) with respect to the time when the impact image is extracted.

Follow-Through Shaft 3 O'Clock Image

The angle of the shaft 13*a* is computed by using two of the colored marks CM1 through CM3 and by selecting an image in which the shaft 13*a* has an angle nearest −90°. Thereby the follow-through shaft 3 o'clock image is extracted. When one of the colored marks CM1 through CM3 is used, the follow-through shaft 3 o'clock image is extracted by selecting an image in which the X-direction component of the movement vector of the colored mark is minimum and which is subsequent to the impact image.

Finish Image

The angle of the shaft 13*a* is computed by using two of the colored marks CM1 through CM3 and by selecting an image in which the angle of the shaft 13*a* is smallest. Thereby the finish image is extracted. When one of the colored marks CM1 through CM3 is used, the finish image is extracted by selecting an image in which the X-direction and Y-direction components of the movement vector of the colored mark are minimum and which is subsequent to the top image in time.

The method of extracting the take-back left arm horizontal image and the downswing left arm horizontal image are described below.

The take-back left arm horizontal image is a still image in which the golfer's left forearm is horizontal at the take-back time. The downswing left arm horizontal image is a still image in which the golfer's left forearm is horizontal at the downswing time.

To recognize the image in which the golfer's left arm is horizontal, a template having an image region including the left arm is formed and template matching processing is executed to set an image in which the angle of a matched template is horizontal as the take-back left arm horizontal image.

The golfer's contour is extracted to generate the template including the left arm in the still image, as described below.

Initially, an image in which the shaft 13*a* is in the 6 o'clock state determined in dependence on the angle of the shaft 13*a* obtained from the coordinate of the colored marks CM1 through CM3 is extracted. A vector between the colored mark CM1 nearest the grip and the colored mark CM2 adjacent to the colored mark CM1 is computed to decide the position of the grip. More specifically, the position of the grip is computed by the following equation:

$$\text{(Grip position)}=\text{(position of colored mark CM1)}-\alpha\times\text{(vector between colored marks)}$$

where $\alpha$ is the ratio of the distance between the colored mark CM1 and the grip to the distance between the colored marks CM1 and mark CM2. In this embodiment, $\alpha$ is 0.5.

Thereafter differential processing is executed between the background image (image in which the golfer 11 is not photographed) and the 6 o'clock shaft image to extract a golfer's silhouette. More specifically, let it be supposed that the value of the R, G, and B in the background image is r', g', and b' respectively and that the value of the R, G, and B of the pixel of the 6 o'clock shaft image is r, g, and b respectively. When the norm (square root of sum of squares of absolute values of difference between r of pixel of one image and r' of pixel of the other image, difference between g of pixel of one image and g' of pixel of the other image, and difference between b of pixel of one image and b' of pixel of the other image) shown by an equation 7 below is less than a predetermined threshold, binarizing processing of regarding the silhouette as not the golfer's silhouette and setting the pixels to 0 is executed. On the other hand, when the norm is not less than the predetermined threshold, binarizing processing of regarding the silhouette as the golfer's silhouette and setting the pixels to 1 is executed. Labeling of the pixels set to 1 are executed sequentially. In this embodiment, the threshold of the norm is set to 40. Differential processing may be executed between the background image and the 6 o'clock shaft image by using the hue, the saturation, the lightness. In this case, of labeling regions regarded as the golfer's silhouette, one or two regions of not less than 5000 or not less than 10000 are regarded as the golfer's silhouette.

$$\sqrt{(r-r')^2+(g-g')^2+(b-b')^2} \qquad \text{Equation 7}$$

Figure 7A:
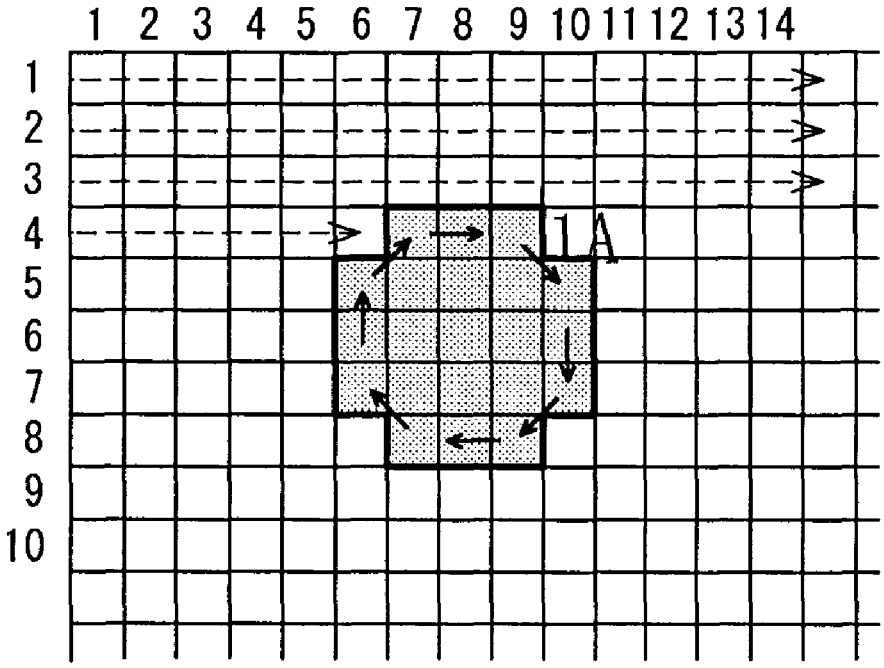
FIGS. 7A and 7B are explanatory views for explaining extraction of the contour of a golfer.
Figure 7B:
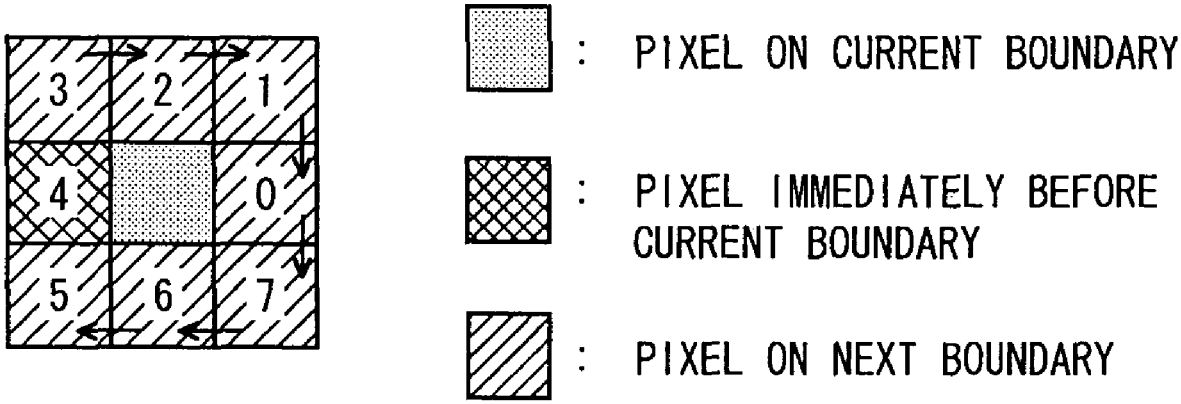

As shown in FIG. 7A, scanning processing is executed for the binarized image to execute extraction of the golfer's contour from portions corresponding to pixels of 1 or 2. In the contour extraction method, scanning processing is executed for the labeled image toward the right-hand direction and from top to bottom by using the pixel at the upper left of the frame as the starting point to search pixels of 1 or 2. More specifically, a pixel (4, 7) is initially found by the scanning processing. Thereafter as shown in FIG. 7B, seven pixels other than a pixel immediately before the pixel (4, 7) are examined clockwise from the upper left pixel. A pixel having the same label as that of the pixel (1 or 2) found initially is set as the next boundary. This processing is executed sequentially. The contour extraction terminates when the boundary returns to the pixel (4, 7). Noise remains in the as-extracted contour. Thus smoothing is executed by circularly executing movement average processing on the entire contour.

The movement average processing is executed by using an equation 8 shown below:

$$\text{bnd_pt_ido}(n) = \frac{1}{2k+1}\left\{\sum_{i=n-k}^{n+k} \text{bnd_pt}(i)\right\} \qquad \text{Equation 8}$$

where bnd_pt(n) is the coordinate of an n-th contour, k is the number of pixels utilized for calculations before and after the movement average processing is executed, and bnd_pt_ido(n) is the coordinate of the contour after the movement average processing is executed.

Let it be supposed that when the golfer's contour is present from a first pixel through a bnd_num-th pixel (last of contour number), a pixel for which the movement average processing is executed is an n-th pixel. When n<k, the movement average processing is executed by utilizing a bnd_num-(k-n)th pixel through a bnd_num-th pixel disposed near the last contour number. When bnd_num-n<k, the movement average processing is executed by utilizing a first pixel through a k-(bnd_num-n)th pixel disposed near the first contour number.

Figure 8:
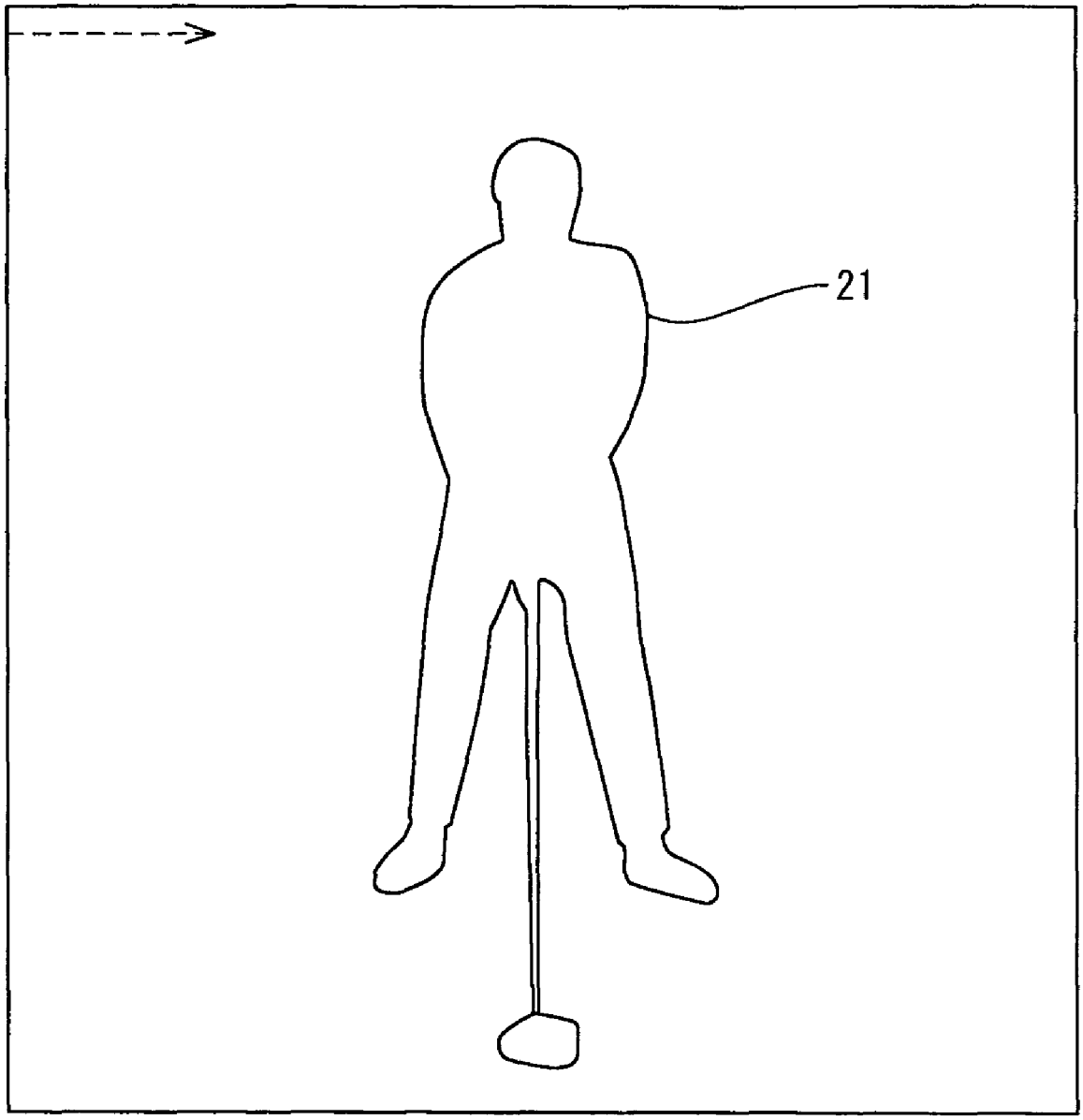
FIG. 8 shows an image in which the golfer's contour has been extracted.

The curvature of the contour is computed from the contour data obtained by the smoothing to obtain the position of the golfer's left shoulder. That is, a portion having a large curvature which appears first is recognized as the golfer's head in scanning an image including the contour data as shown in FIG. 8. A portion having a small curvature which appears thereafter is recognized as the golfer's neck. A portion having a large curvature which appears thereafter is recognized as the golfer's shoulder. In consideration of creases of the golfer's dress, the curvature of each of pixels of ±5 is computed. The average value of the curvatures should be set as the curvature of the central pixel.

The method of computing the curvature of the contour is described below.

Supposing that the length of a circular arc of a contour to be extracted is S and that the angle thereof is θ, the curvature C is expressed by an equation 9 shown below.

$$C = \frac{d\theta}{dS} \quad \text{Equation 9}$$

When computations are performed for only a pixel whose curvature is to be found and for points adjacent to the pixel, a correct value cannot be obtained because an obtained value has a large variation. Thus including a row consisting of dots, whose number is k, disposed at both sides of the pixel whose curvature is to be found, the curvature is computed by using an equation 10 shown below:

$$C = \frac{1}{k}\left\{\sum_{i=k+1}^{0} \tan^{-1}\left(\frac{y_{i-1}-y_i}{x_{i-1}-x_i}\right) - \sum_{i=0}^{k-1} \tan^{-1}\left(\frac{y_i-y_{i+1}}{x_i-x_{i+1}}\right)\right\} \quad \text{Equation 10}$$

Figure 10:
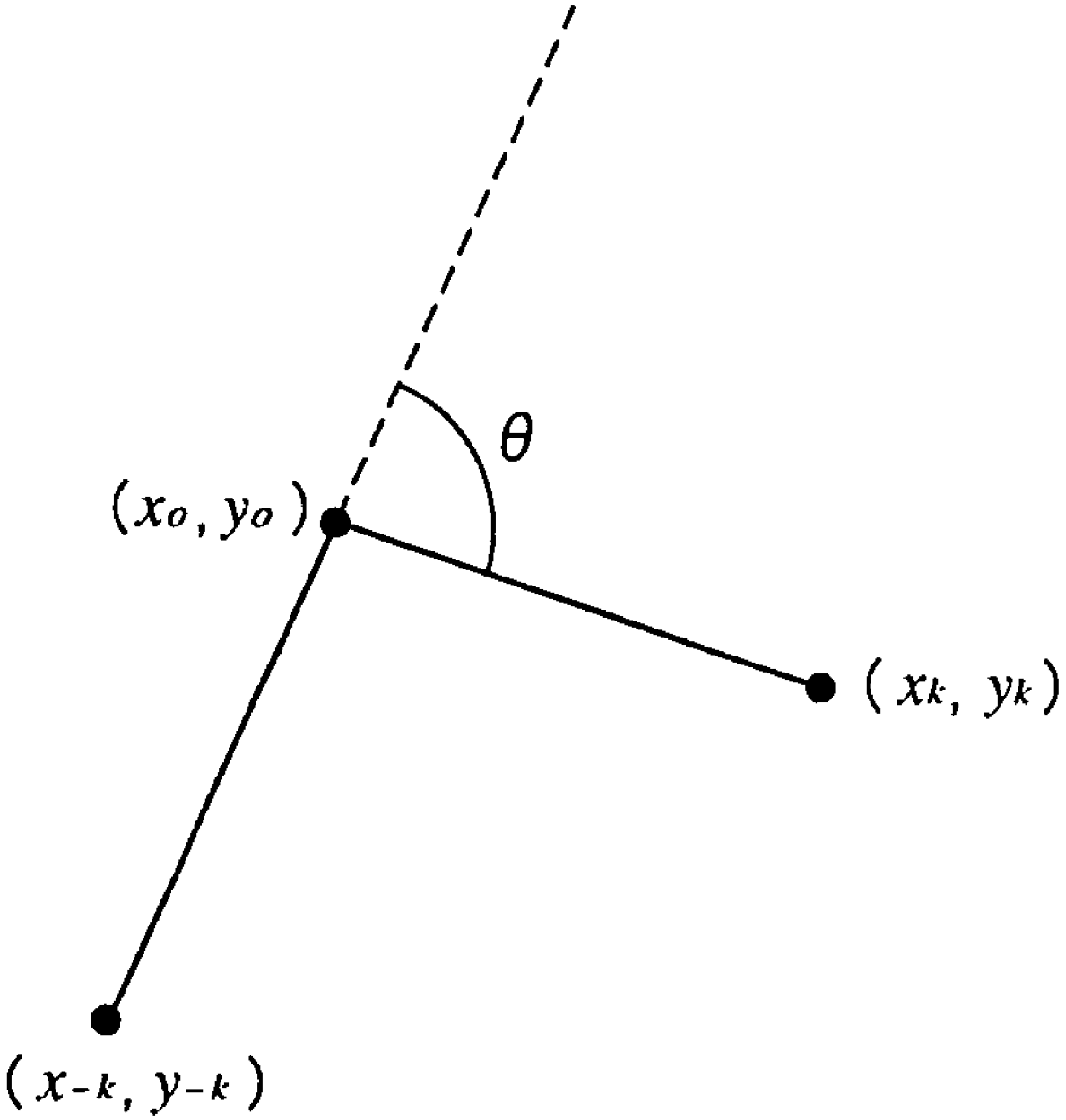
FIG. 10 is an explanatory view for explaining computation of a curvature.

In the equation 10, the length S of the circular arc of the contour in the equation 9 is abbreviated to simplify the equation 10. In this embodiment, to further simplify the equation 10, the curvature C is computed in an equation 11 by using both ends of the row of dots, as shown in FIG. 10.

$$C = \tan^{-1}\left(\frac{y_o-y_{-k}}{x_o-x_{-k}}\right) - \tan^{-1}\left(\frac{y_k-y_o}{x_k-x_o}\right) \quad \text{Equation 11}$$

Take-Back Left Arm Horizontal Image

Figure 9A:
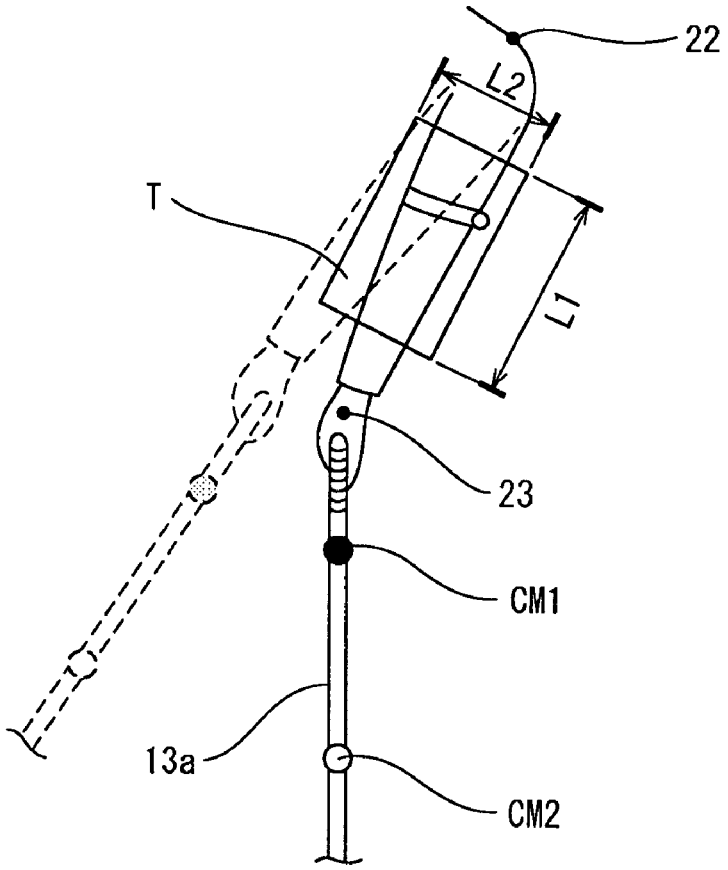
FIGS. 9A and 9B are explanatory views for explaining template matching.

As shown in FIG. 9A, a, rectangular template T is set in a region between a left shoulder 22 and a grip 23 both extracted in a manner similar to that described above. The length L1 of the longer side of the template T is set to the half of the length between the shoulder and the grip. The length L2 of the shorter side of the template T is set to such an extent (20 pixels in this embodiment) that the arm is included in the template T.

Figure 9B:
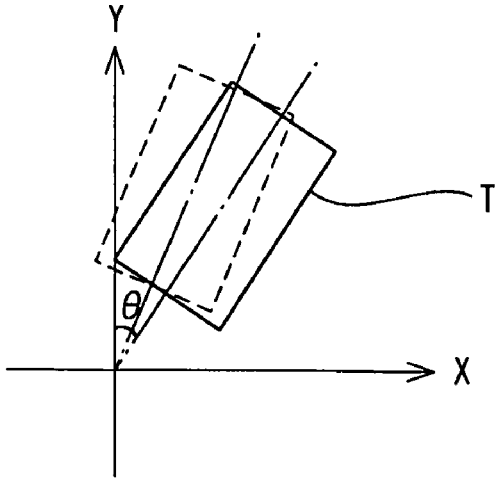

An image at the next time is read to obtain the position of the grip. Thereafter as in the case of the movement vector of the grip position, a parallel movement of the template T of the previous frame is performed. As shown in FIG. 9B, the template T is rotated clockwise on the grip position up to 10° at intervals of 1° to compute the angle of the template T at the time when the template T matches the take-back left arm horizontal image. That is, an image in which the angle of the template T is closest to 90° (horizontal) is regarded as the take-back left arm horizontal image and extracted. Matching processing may be executed by translating the template T in addition to rotating the template.

In the template matching processing, the value of the R, G, and B indicating the color information of pixels inside the template T is converted into a luminance Y for evaluation by using an equation 12 shown below. Although evaluation is made in terms of the luminance Y, the norm (see equation 7) of the R, G, and B may be used for evaluation.

$$Y = 0.299R + 0.587G + 0.114B \quad \text{Equation 12}$$

In the evaluation, the sum of the absolute values of the difference between the values of pixels is used. The sum is shown by an equation 13 shown below:

$$S(p, q, \theta) = \sum_{\theta=0}^{10}\sum_{j=0}^{m-1}\sum_{i=-\frac{n}{2}}^{n/2} |g_t(i_o+i+P,\ j_o+j+q,\ \theta+\alpha) - g_{t-1}(i_o+i,\ j_o+j,\ \alpha)| \quad \text{Equation 13}$$

where t is a current frame, t−1 is a frame previous by one frame to the current frame, (p, q) is a range in which parallel movement is executed, $(i_o, j_o)$ is the position of the grip, m is the number of pixels at the longer side of the template T, n is the number of pixels at the shorter side of the template, θ is the rotational angle of the template T, a is the angle of the template T found by one frame previous to the current frame, $g_t$ (x, y, θ) is a function indicating the luminance Y (or norm of R, G, B) of a pixel when the angle of the template T is θ at a coordinate (x, y).

The position and angle (p, q, θ) of the template T are changed in the above conditions to compute the length S (p, q, θ) of the circular arc of the contour. The template is regarded as matching the take-back left arm horizontal image to a highest extent at the position and angle making this value minimum. An image in which the value of θ of the position and angle (p, q, θ) is closest to 90° when the template matches the take-back left arm horizontal image is extracted as the take-back left arm horizontal image.

Downswing Left Arm Horizontal Image

The template including the left arm in the take-back left arm horizontal image obtained as described above is utilized to extract an image, subsequent to the top image, which matches the template to a highest extent as the downswing left arm horizontal image.

As apparent from the above description, considering the extraction order of the images of the swing, the downswing left arm horizontal image is extracted after the top image is extracted. Thus the template matching processing may be started from the top image. However, it takes much time to execute the template matching processing from the top image or the entire arm is not necessarily seen in the top image. Thus there is a possibility of an erroneous recognition.

Therefore in the embodiment, the downswing left arm horizontal image is extracted by extracting the downswing shaft 9 o'clock image initially and executing the template matching processing by putting back a clock. Thereby it is possible to shorten a computing period of time and prevent an erroneous recognition.

Take-Back Shaft 8 O'Clock Image

The method of extracting the take-back shaft 8 o'clock image is described below. The take-back shaft 8 o'clock image means a still image that is placed at an eight o'clock position at the take-back time, when the shaft is regarded as the needle of a clock.

The width (stance width) of the golfer's body is obtained by extracting the golfer's silhouette at the above-described shaft 6 o'clock image. Then an image at the time when a perpendicular passing through the right-hand edge of the right leg and the colored mark M1 intersect with each other is selected as the take-back shaft 8 o'clock image and extracted.

Figure 11:
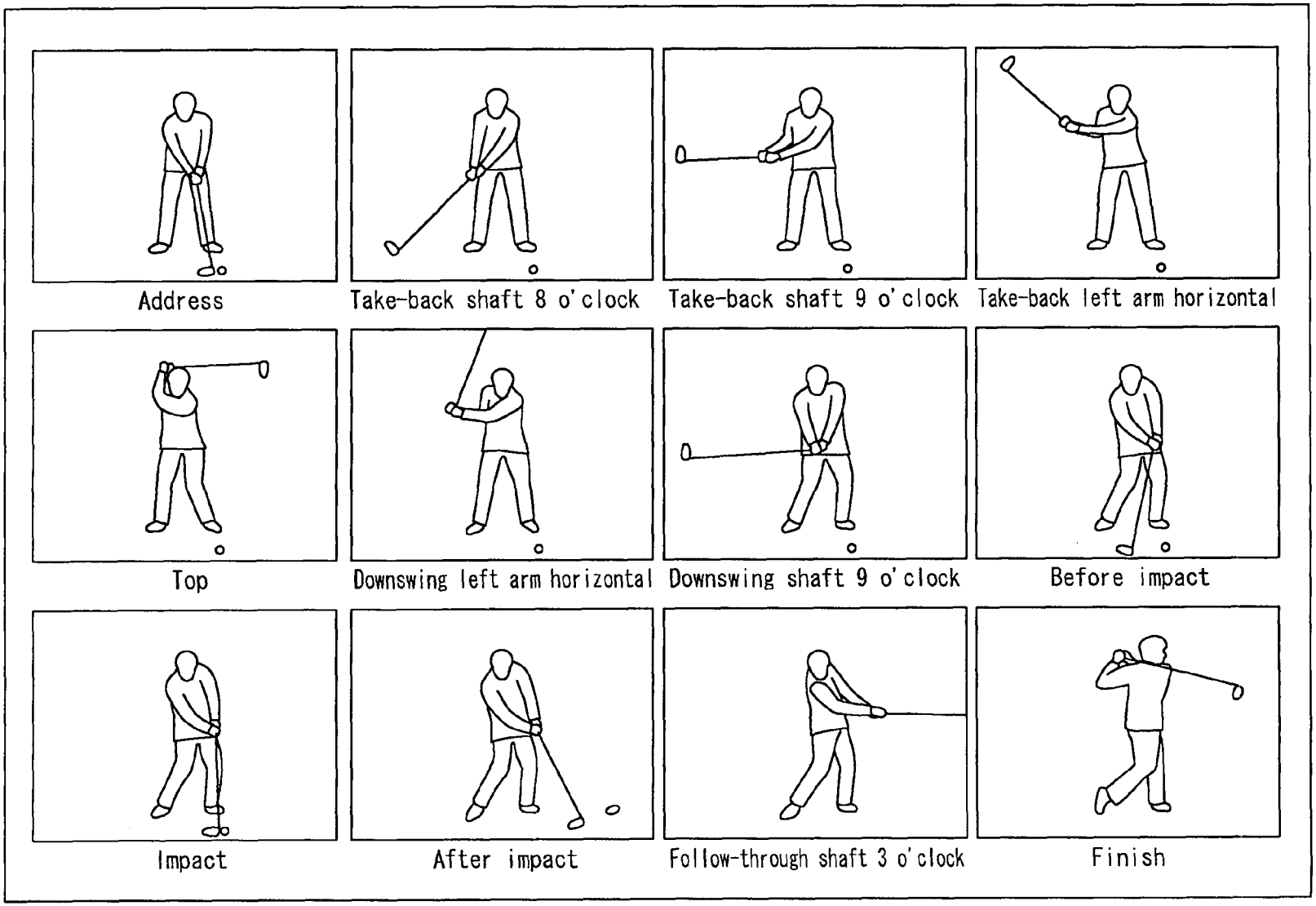
FIG. 11 shows check-point images viewed from a front side.
Figure 12:
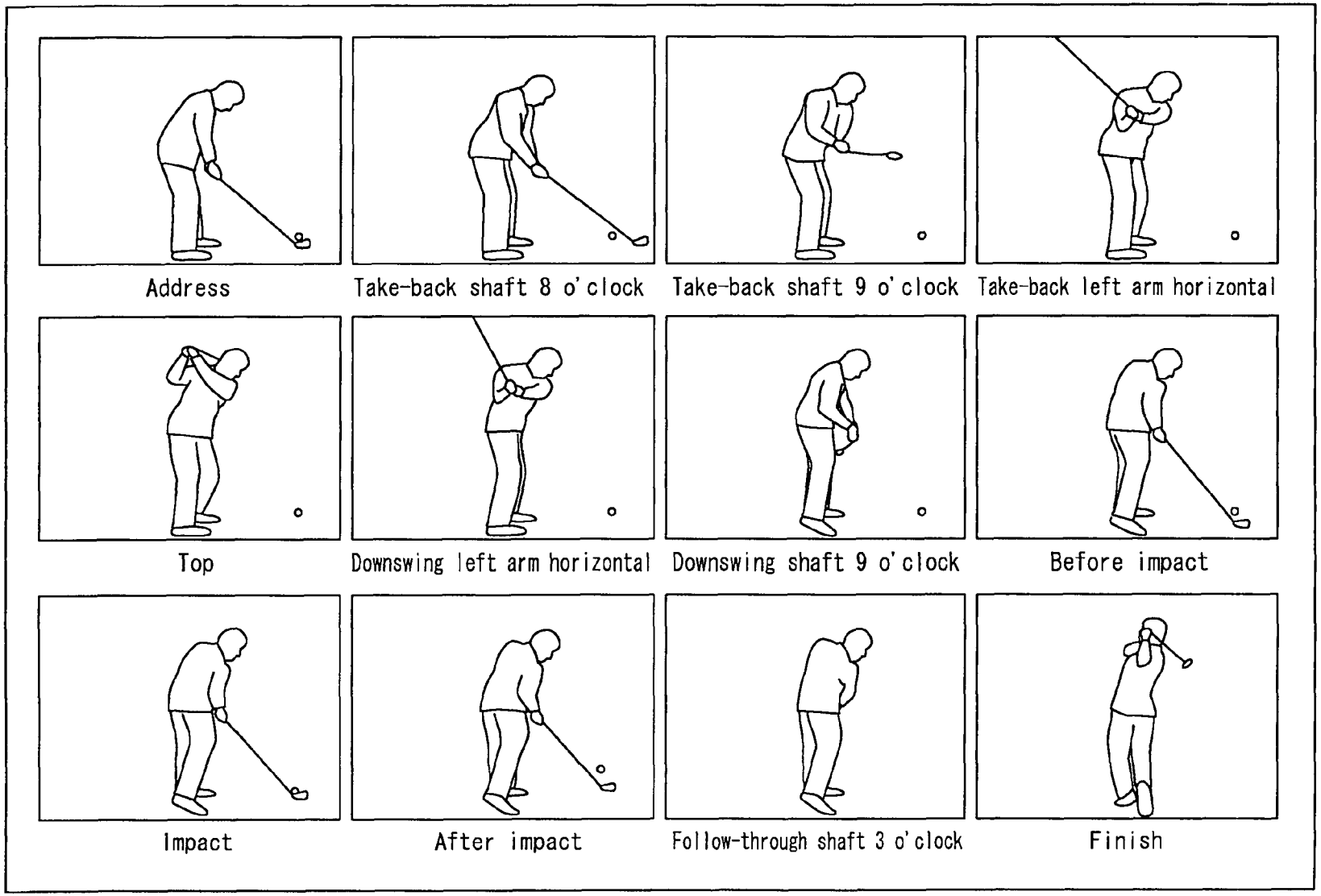
FIG. 12 shows check-point images viewed rearward (in side view) from the golfer in a ball fly line direction.

In the above-described manner, it is possible to extract the following check-point images shown in a front view in FIG. 11. The check-point images include the address image, the take-back shaft 8 o'clock image, the take-back shaft 9 o'clock image, the take-back left arm horizontal image, the top image, the downswing left arm horizontal image, the downswing shaft 9 o'clock image, the image previous to the impact image, the impact image, the image subsequent to the impact image, the follow-through shaft 3 o'clock image, and the finish image. The computer 16 synchronizes the photographing timing of the color CCD cameras 14 and 15 with each other. Therefore by selecting images synchronous with the check-point images in a front view, it is possible to extract check-point images viewed rearward (in side view) from the golfer in a ball fly line direction, as shown in FIG. 12.

The coordinates of the positions of the attention-focused points necessary for diagnosing the swing of the golfer 11 are obtained for each of the check-point images.

Figure 13:
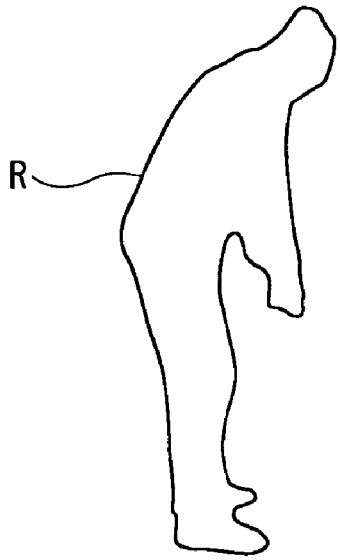
FIG. 13 shows the golfer's contour in a still image.
Figure 14:
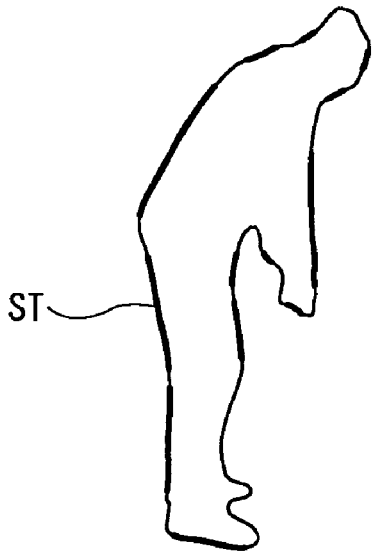
FIG. 14 shows a straight line portion extracted from the golfer's contour in the still image.

The silhouette of each check-point image is extracted to extract a contour R of the golfer 11, as shown in FIG. 13. The curvature of the contour R is obtained. As shown in FIG. 14, a straight line portion ST of the contour R is obtained. The method of obtaining the silhouette, the contour, and the curvature is as described above. The straight line portion ST is set in a portion where not less than five pixels having a curvature in the range from −10° to 10° are continuously present.

Thereafter the coordinate of the position of each of the colored marks M1 through M7 on the dress 12 worn by the golfer 11 is recognized by using the search range S. Thereby the coordinate of the position of each of the attention-focused points of the golfer 11 is obtained.

Figure 15:
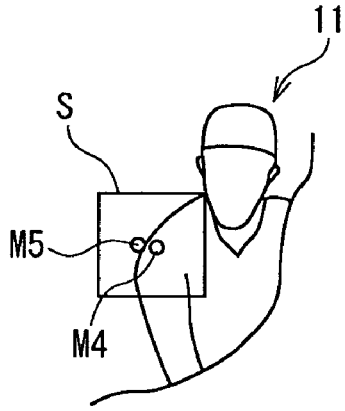
FIG. 15 is an explanatory view for explaining color extraction of an attention-focused point.

For example, the right shoulder of the address image (in front view) is extracted by examining the curvature of the contour R counterclockwise from the upper end (golfer's head) of the golfer 11. A pixel at which the curvature of the contour R has an extreme value is recognized as the right part of the neck of the golfer 11. As shown in FIG. 15, a range of 40 pixels in a negative direction of a Y-direction and 40 pixels in a positive direction of an X-direction is set as the search range S in which the right part of neck is set as the starting point disposed at an end of the search range S.

Within the search range S, differential processing is executed between the background image and the colored mark M4 (blue) disposed at the right shoulder or the colored mark M5 (red) also disposed at the right shoulder to judge whether R, G, and B of each differential pixel inside the search range S fall within the color range of the colored mark M4 or the colored mark M5. A pixel falling within the color range is regarded as the pixel displaying the colored mark M4 or the colored mark M5. As such, color extraction of the pixel is executed. Further the coordinate of the center of gravity of the pixel is obtained.

The conditions set on the color range of the colored marks M1 through M7 are as shown in table 1. A pixel satisfying one of the conditions is regarded as having the same color as that of one of the colored marks M1 through M7.

The area range of each of the colored marks M1 through M7 is set in advance. To improve recognition accuracy, a region having an area out of the set range is judged as not any one of the colored marks M1 through M7. On the other hand, a region having an area within the set range is recognized as one of the colored marks M1 through M7. In this embodiment, an area range having 5 to 60 pixels is recognized as one of the colored marks M1 through M7.

When recognition of the colored marks M1 through M7 executed by using the search range S has failed because the colored marks M1 through M7 are hidden or shaded or when an attention-focused point in which none of the colored marks M1 through M7 is present is desired to be recognized, the coordinate of the position of the attention-focused point is extracted by using the information of the contour (coordinate of contour R) of the golfer 11 or the curvature of the contour R.

Figure 16:
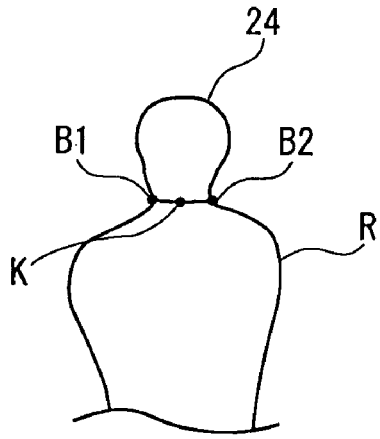
FIG. 16 is an explanatory view for explaining extraction of the attention-focused point executed by using the contour thereof.

For example, as shown in FIG. 16, as the method of extracting a head 24 in the address image and the impact image (in side view), a starting point in the extraction of the contour R is extracted as the head 24. That is, of pixels constructing the contour R, a pixel having a minimum value in a Y-coordinate is extracted as the head 24. As the method of extracting a neck K, curvatures of pixels are examined from the head 24 along the contour R. A midpoint between points B1 and B2 each having a maximum value in the curvature of the contour R is extracted as the neck K.

Figure 17:
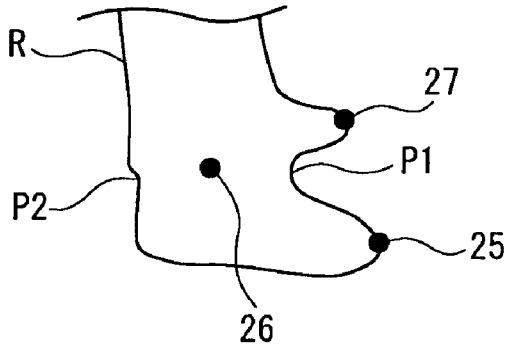
FIG. 17 is an explanatory view for explaining the extraction of the attention-focused point executed by using a curvature of the contour thereof.

As shown in FIG. 17, as the method of extracting a right toe 25 in the address image and the impact image (in side view), X-coordinates of pixels are examined counterclockwise from a lowermost point (maximum Y-coordinate value) of the contour R of the golfer 11. A pixel having a maximum X-coordinate value is extracted as the right toe 25.

As the method of extracting a right ankle 26, coordinates of pixels are examined counterclockwise from the right toe 25 along the contour R to extract a pixel P1 having a minimum X-coordinate value. Thereafter another pixel P2, disposed on the contour R, which has a Y-coordinate equal to that of the pixel P1 is found. The average of the coordinate of the pixel P1 and that of the pixel P2 is computed. Thereby the coordinate of the right ankle 26 is obtained.

As the method of extracting a left toe 27, coordinates of pixels are examined counterclockwise from the pixel P1 along the contour R. A pixel having a maximum X-coordinate value is extracted as the left toe 27.

When recognition of an attention-focused point executed by using the colored marks M1 through M7, the information of the contour R of the golfer 11 or the curvature of the contour R has failed, when an attention-focused point in which none of the colored marks M1 through M7 is present is desired to be recognized or when it is difficult to recognize an attention-focused point by using the curvature of the contour R, the coordinate of the position of the attention-focused

TABLE 1

| | | Hue | Saturation | Lightness |
|---|---|---|---|---|
| Colored mark M1 (left elbow) | Yellow | 30-60 | not less than 0.5 | not less than 100 |
| Colored mark M2 (left shoulder)<br>Colored mark M5 (right shoulder) | Red | not more than 30 or not less than 330 | not less than 0.4 | 20-150 |
| Colored mark M3 (left shoulder)<br>Colored mark M4 (right shoulder)<br>Colored mark M6 (right elbow) | Blue | 190-230 | not less than 0.5 | not less than 50 |
| Colored mark M7 (waist) | Red | 330-360 | not less than 0.4 | 20-150 |

point is extracted by using a straight line portion ST extracted on the contour R of the golfer 11.

Figure 18:
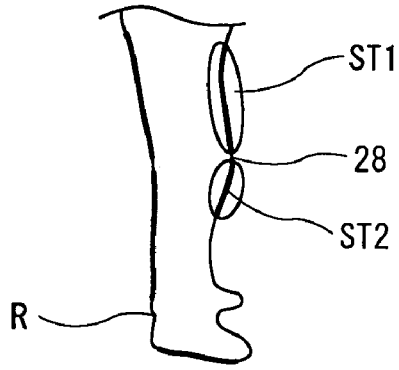
FIG. 18 is an explanatory view for explaining the extraction of the attention-focused point executed by using a straight line portion of the contour thereof.

For example, as shown in FIG. 18, as the method of extracting a right knee 28 in the address image and the impact image (in side view), a pixel disposed at the intersection of extensions of upper and lower straight line portions ST1 and ST2 in a region of the contour R where the right knee 28 is supposed to be present is specified as the coordinate of the position of the right knee 28. More specifically, a virtual knee region is set in an area located at 30% to 40% upward from the lower end of the contour R to examine whether the lower end of the straight line portion ST1 and the upper end of the straight line portion ST2 are present in the virtual knee region. If a plurality of straight line portions is found in the examination, a straight line portion near the virtual knee region is selected. The intersection of the extension of the straight line portion ST1 and that of the straight line portion ST2 obtained in the above-described manner or a point whose Y-coordinate is coincident with that of the contour R and which has a maximum X-coordinate value is set as the right knee 28. If the straight line portions ST1 and ST2 cannot be found because the knee is not bent or for some reasons, a pixel disposed in the virtual knee region and having a maximum X-coordinate in the contour R is set as the right knee 28.

Figure 19:
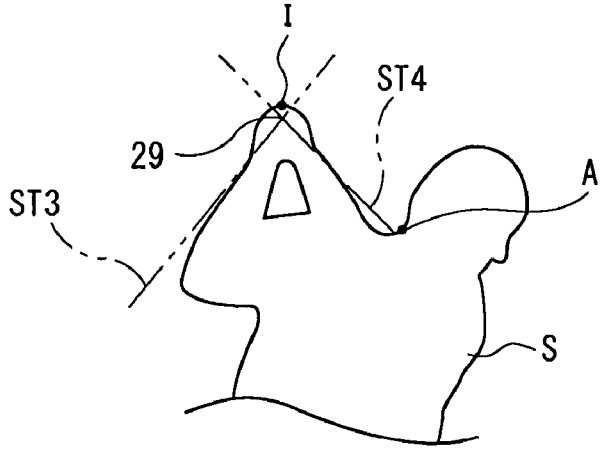
FIG. 19 is an explanatory view for explaining the extraction of the attention-focused point executed by using the straight line portion of the contour thereof.

As the method of extracting a wrist 29 in the top image (in side view) initially, an initial point I (initial pixel found when pixels are scanned from upper left toward upper right and from top to bottom) of the silhouette S of the golfer 11 is obtained, as shown in FIG. 19. It is judged whether the X-coordinate of the initial point I is smaller than the X-coordinate of a rear part A of the neck obtained in the method (described later) carried out to extract attention-focused points in the take-back left arm horizontal image. If the X-coordinate of the initial point I is smaller than the X-coordinate of the rear part A of the neck, straight line portions ST3 and ST4 are extracted. The straight line portion ST3 set as an imaginary wrist has an inclination of 90° to 180° with respect to the initial point I. The straight line portion ST4 has an inclination of −90° to −180° with respect to the initial point I. The intersection of the straight line portion ST3 and the straight line portion ST4 is set as the wrist 29. If the straight line portions ST3 and ST4 cannot be extracted, the initial point I is set as the wrist 29. As described above, the lateral direction in the image is set as the X-axis. The vertical direction in the image is set as the Y-axis. The direction facing toward the right in the image is set as the positive direction in the X-coordinate. The direction facing downward in the image is set as the positive direction in the Y-coordinate. The direction clockwise with respect to the negative X-direction is set as the positive angle. The direction counterclockwise with respect to the negative X-direction is set as the negative angle.

Figure 20:
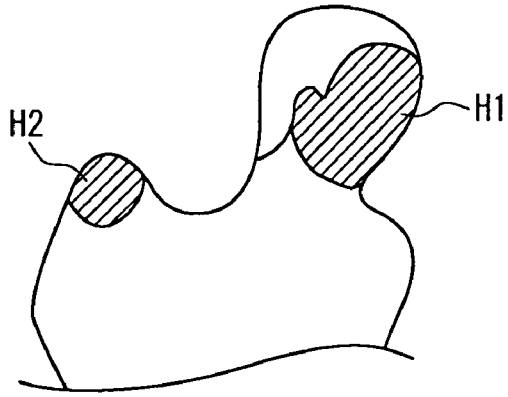
FIG. 20 is an explanatory view for explaining the extraction of the attention-focused point executed by using a skin extraction.

On the other hand, if the X-coordinate of the initial point I is larger than the X-coordinate of the rear part A of the neck, as shown in FIG. 20, skin color extraction which will be described later is executed to obtain a face H1 of the golfer 11. Thereafter extraction of the skin color of the golfer's hand is executed to set the center of a skin color region H2 as the wrist 29.

When it is difficult to specify an attention-focused point, for example, a right knee in the top image (in side view) by using the contour R because no colored marks are attached to the right knee and because the right knee is present inside the contour R, edge extraction is executed to obtain the line (including the inside of contour) of the golfer's body, based on a change of the brightness of pixels in the image. Thereby the position of the attention-focused point is recognized.

The procedure of extracting the coordinate of the position of the right knee in the top image (in side view) is described below. The basic flow of the extraction of the edge is as follows: generation of edge intensity image→generation of direction labeling image→generation of non-maximum value suppression labeling image.

Figure 21:
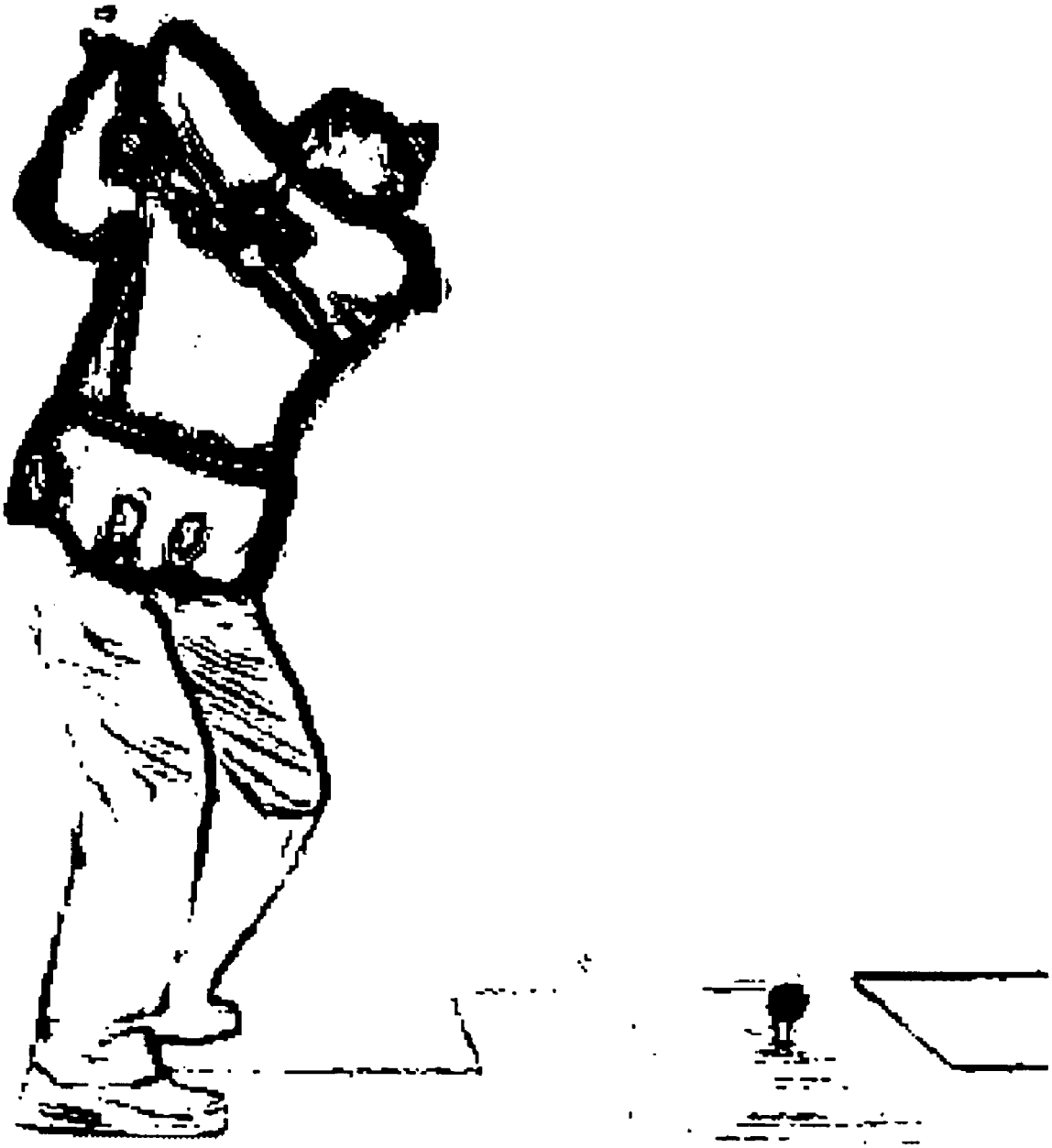
FIG. 21 shows an edge intensity image.

Initially an edge intensity image as shown in FIG. 21 is generated.

An edge intensity is extracted from the top image (in side view) by utilizing a Sobel operator.

The Sobel operator means a method of approximately finding a change of brightness by weighting brightness around a center to obtain a portion in an image where the brightness changes abruptly. Computations performed by utilizing the value of each of R, G, and B of a color image are shown below.

(1) Sobel Intensity of Color Image in X-Direction $$Rx = Ar + 2Dr + Gr - Cr - 2Fr - Ir \qquad \text{Equation 14}$$

$$Gx = Ag + 2Dg + Gg - Cg - 2Fg - Ig$$

$$Bx = Ab + 2Db + Gb - Cb - 2Fb - Ib$$

Figures 24, 25:
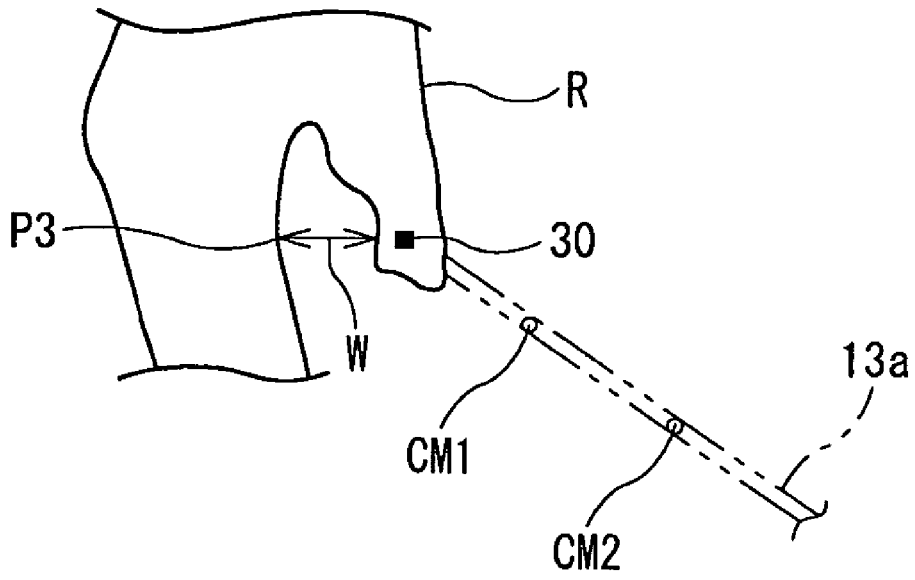
FIG. 24 is an explanatory view for explaining the definition of a positional relationship between adjacent pixels.
FIG. 25 is an explanatory view for explaining estimation of the attention-focused point executed by means of information of a silhouette.

With reference to FIG. 24, supposing that a current attention-focused pixel is E and that eight pixels on the periphery of the pixel E are denoted as A through D and F through I, Ar is the value of R (red) of the pixel A, Ag is the value of G (green) of the pixel A, and Ab is the value of B (blue) of the pixel A. This is also applicable to Br, Bg, Bb to Ir, Ig, Ib. The coefficient of each variable means weighting.

In the direction of the Sobel intensity, when Rx+Gx+Bx>0, sign=1, and when Rx+Gx+Bx<0, sign=−1.

The Sobel intensity Dx in X-direction is as shown below:

$$Dx = \frac{\text{sign}\sqrt{Rx^2 + Gx^2 + Bx^2}}{8} \qquad \text{Equation 15}$$

(2) Sobel Intensity of Color Image in Y-Direction is as Shown Below:

$$Ry = Ar + 2Br + Cr - Gr - 2Hr - Ir \qquad \text{Equation 16}$$

$$Gy = Ag + 2Bg + Cg - Gg - 2Hg - Ig$$

$$By = Ab + 2Bb + Cb - Gb - 2Hb - Ib$$

In the direction of the Sobel intensity, when Ry+Gy+By>0, sign=1, and when Ry+Gy+By<0, sign=−1.

The Sobel intensity Dx in Y-direction is as shown below:

$$Dy = \frac{\text{sign}\sqrt{Ry^2 + Gy^2 + By^2}}{8} \qquad \text{Equation 17}$$

(3) Sobel Intensity of Color Image

Thus the Sobel intensity (edge intensity) DD of the color image is found by using an equation 18 shown below:

$$DD = \sqrt{Dx^2 + Dy^2} \qquad \text{Equation 18}$$

A pixel having DD larger than a threshold (=10 in this embodiment) is set as the Sobel intensity (edge intensity). Pixels having a Sobel intensity DD not more than the threshold are set to zero. An edge intensity image whose edge intensity is indicated by the Sobel intensity of 256 gradations from 0 to 255 is obtained.

Figure 22:
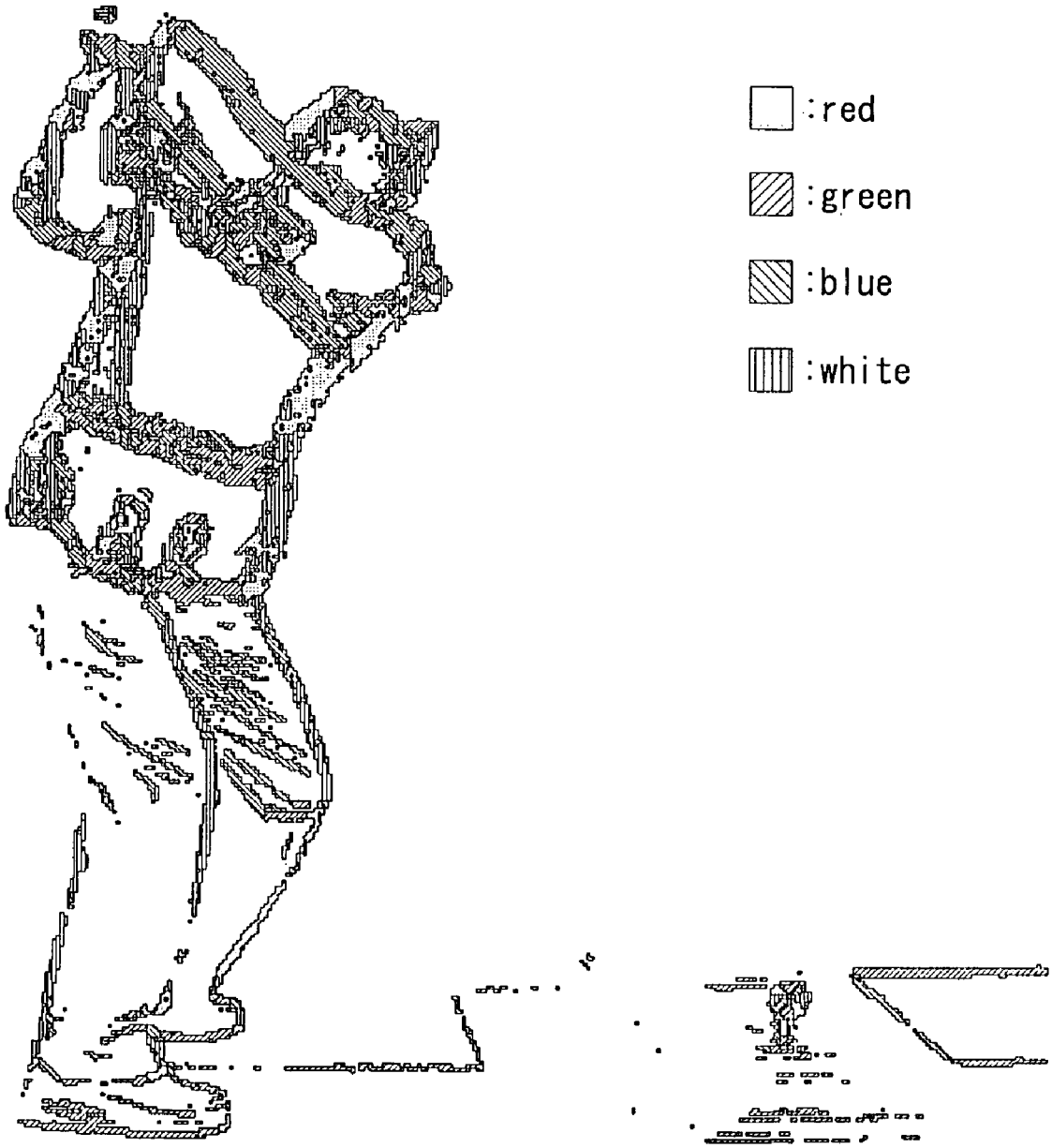
FIG. 22 shows a direction labeling image.

By using the edge intensity in each of the following four directions, the direction labeling image as shown in FIG. 22 is generated:

Supposing that tangent=dy/dx (dx is the Sobel intensity in the X-direction, and dy is the Sobel intensity in the Y-direction), When tangent <−tan(3/8π), the image is labeled as "3" and displayed in green.

When −tangent(3/8 π)≦tangent<−tan(1/8π), the image is labeled as "4" and displayed in red.

When −tangent(1/8π)≦tangent<tan(1/8π), the image is labeled as "1" and displayed in white.

When tangent<tangent (3/8π), the image is labeled as "2" and displayed in blue.

In other cases, the image is labeled as "3" and displayed in green. In this case, the direction labeling image shown in FIG. 22 is obtained.

Figure 23:
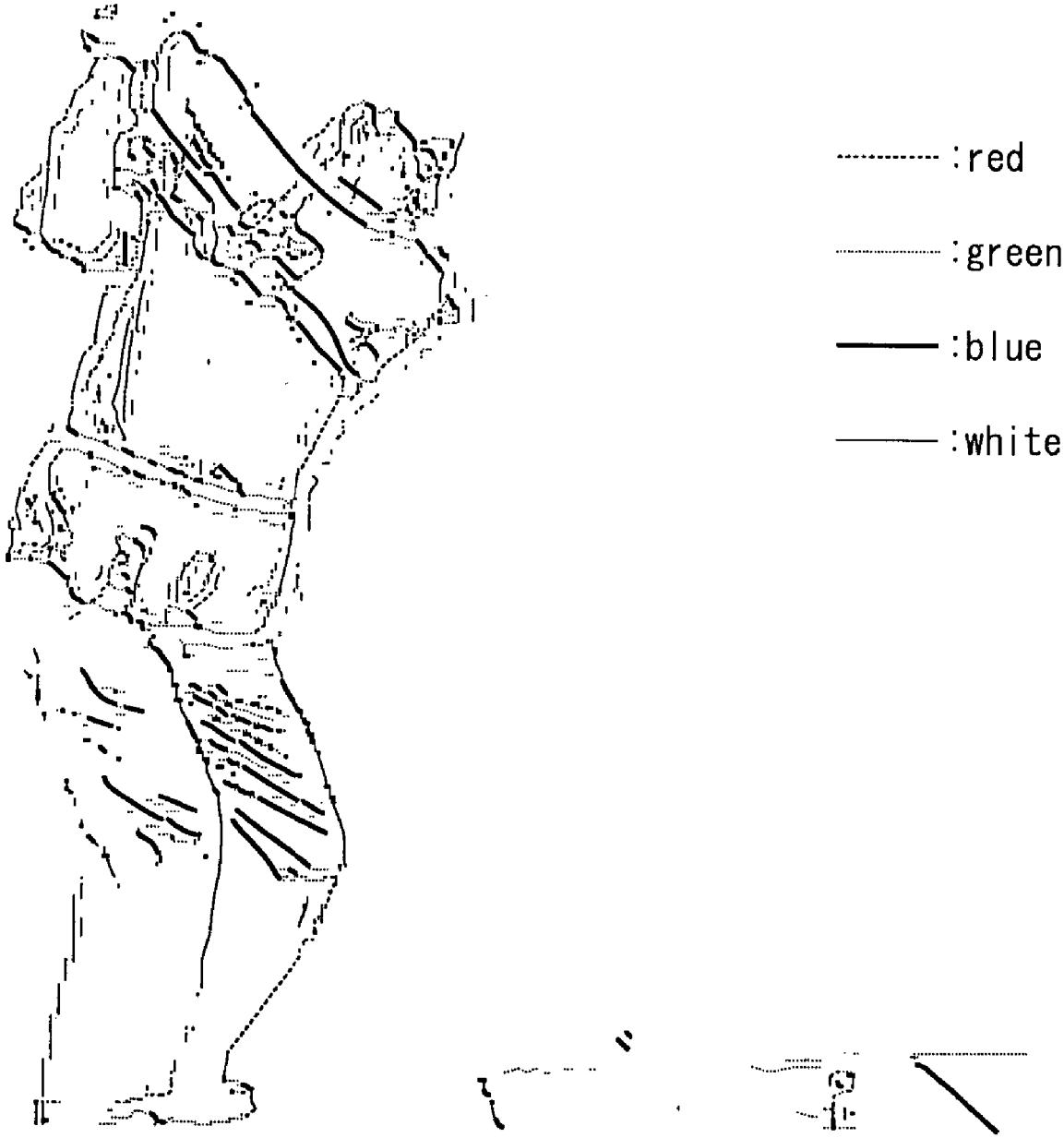
FIG. 23 shows a non-maximum value suppression labeling image.

By utilizing the above-described edge intensity image and direction labeling image, a non-maximum value suppression labeling image as shown in FIG. 23 is generated.

The non-maximum value suppression image means an image generated by extracting a portion thereof having a maximum intensity as an edge by utilizing the obtained edge intensity and a change direction of brightness.

To classify a non-maximum image into four directions, (1) When the Sobel intensity of a central pixel is larger than the Sobel intensities of pixels disposed in front of and behind the central pixel in the lateral direction (X-direction), the central position is regarded as a maximum position (white).

(2) When the Sobel intensity of the central pixel is larger than the Sobel intensities of the pixels disposed in front of and behind the central pixel in an oblique direction (upper left to lower right), the central position is regarded as a maximum position (red).

(3) When the Sobel intensity of the central pixel is larger than the Sobel intensities of the pixels disposed in front of and behind the central pixel in a vertical direction (Y-direction), the central position is regarded as a maximum position (green).

(4) When the Sobel intensity of the central pixel is larger than the Sobel intensities of the pixels disposed in front of and behind the central pixel in the oblique direction (lower left to upper right), the central position is regarded as a maximum position (blue).

The edge-extracted non-maximum value suppression labeling image shown in FIG. 23 is obtained in the manner described above.

As the final step in obtaining the coordinate of the position of the right knee, the intersection of a horizontal line passing through the position of the left knee obtained by using the straight line portions ST1 and ST2 of the contour R and the portion (white) of the non-maximum value suppression labeling image labeled as "1" is set as the right knee.

When it is difficult to recognize the attention-focused points by means of the colored marks M1 through M7, the contour information, the curvature or the edge extraction or when attention-focused points where no colored marks M1 through M7 are present are desired to be recognized, the coordinates of the positions of the attention-focused points are extracted by using silhouette information of the golfer 11.

As an example, as shown in FIG. 25, as the method of finding a grip width W which is the distance between the golfer's body and the grip in the address image (in side view), a grip position 30 is found from a vector passing through the position of the colored marks CM1 and CM2. Further a pixel P3, disposed on the contour R, whose Y-coordinate is equal to that of the grip position 30 is found. In this method, it is necessary that the X-coordinate of the pixel P3 is smaller than that of the right toe. The distance between the grip position 30 and the pixel P3 is set as the grip width W.

The above-described coordinate of the position of the attention-focused point present on the golfer' body 11 in each check-point image is stored in the memory of the computer 16. In the above-described manner, similar computations are performed until all the attention-focused points necessary for diagnosing the swing are extracted. That is, the coordinates of the positions of all the attention-focused points present on the golfer' body are not extracted in the check-point images, but only the attention-focused points necessary for diagnosing the swing are extracted in each check-point image. Thus the computing period of the time can be reduced.

The attention-focused points are extracted not in dependence on one image processing algorithm but in combination of a plurality of algorithms. Therefore irrespective of the form and swing motion of the golfer 11, the golf swing-diagnosing system is capable of recognizing the coordinate of the position of each attention-focused point present on the golfer' body 11 at a high percentage by making the most of all the attention-focused point extraction methods. In recognizing attention-focused points such as a knee of the lower half of the golfer's body, the golf swing-diagnosing system recognizes each attention-focused point not by the color extraction to be executed by using color marks but extracts the coordinate of the position of each attention-focused point by utilizing the above-described contour information, the edge or the like. Therefore the golf swing-diagnosing system has an advantage that it is unnecessary for the golfer 11 to wear dress for measuring her/his golf swing on the lower half of the golfer 11.

Extraction of Attention-Focused Point in Take-Back Left Arm Horizontal Image (in Side View)

As an example of extracting attention-focused points by combining a plurality of algorithms with one another in one check-point image, extraction of the coordinate of the position of each attention-focused point in the take-back left arm horizontal image (in side view) is described below representatively.

Figure 26:
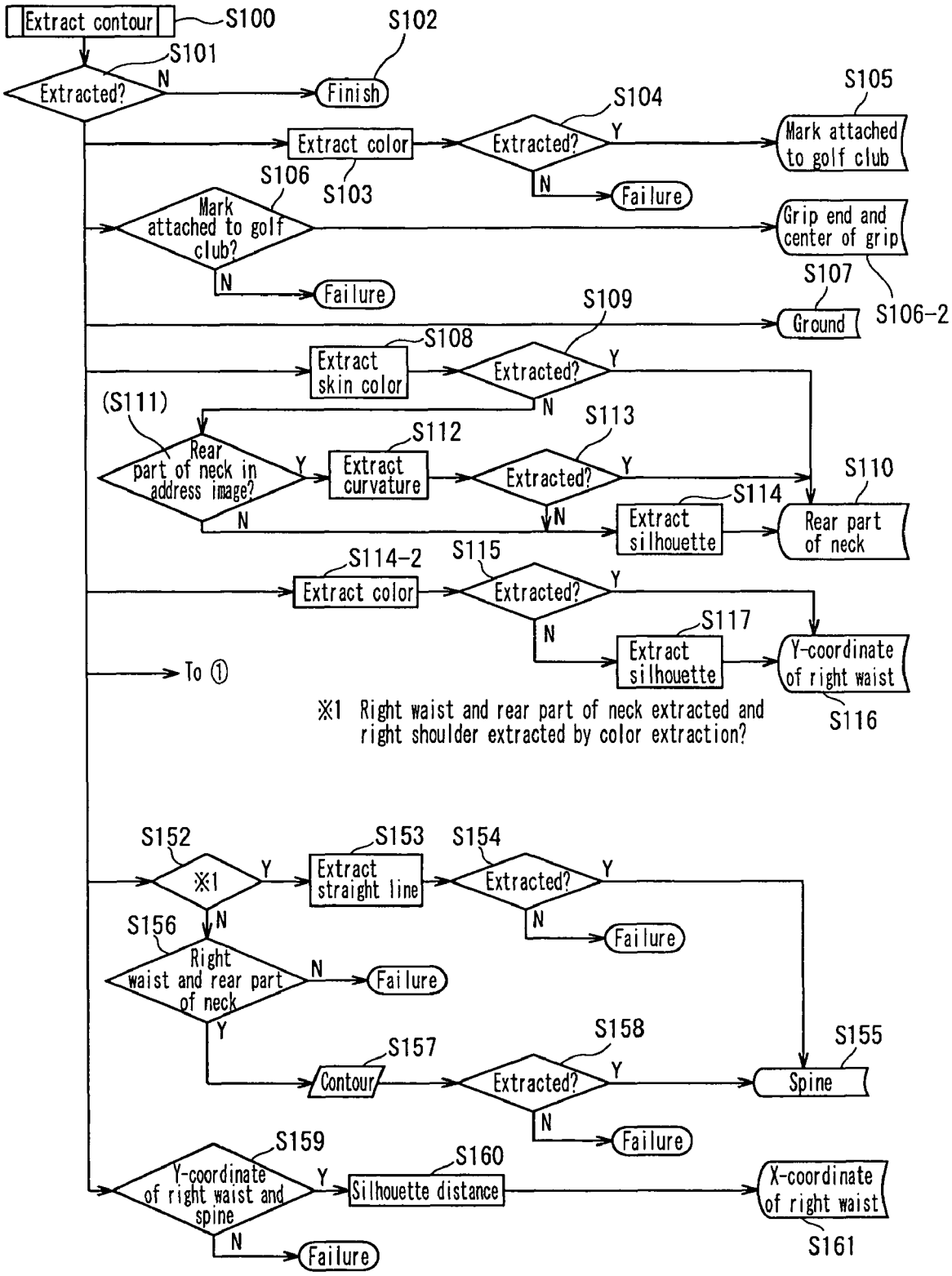
FIG. 26 is a flowchart showing the procedure of extracting the attention-focused point in a take-back left arm horizontal image.

As shown in FIG. 26, initially, processing of extracting the contour is executed (step S100). When the extraction of the contour R has failed (step S101), processing of the check-point image terminates (step S102). Description is made in detail below on the case where the extraction of the contour R has succeeded.

Golf Club

The color of the colored marks CM1 through CM3 is extracted by using the search range S to obtain the coordinate of the position thereof. If the extraction of the color of the colored marks CM1 through CM3 has failed (step S104), the processing is determined as failure. If the extraction of the color of the colored marks CM1 through CM3 has succeeded, the coordinate of the position of each of the colored marks CM1 through CM3 is stored (step S105).

Grip End and Center of Grip

If the extraction of the color of the colored marks CM1 through CM3 has failed at step S104, the processing is determined as failure (step S106). If the extraction of the color of the colored marks CM1 through CM3 has succeeded, a vector passing through the position of the CM1 nearest to the grip and the position of the colored mark CM2 adjacent to the colored mark CM1 is found to decide the position of the grip end and that of the center of the grip (step S106-2). More specifically, the coordinate of the position of the grip end and that of the center of the grip are computed by the following equations:

$$\text{Grip end}=(\text{position of colored mark CM1})-A\times(\text{vector between marks})$$

$$\text{Center of grip}=\{(\text{position of colored mark CM1})+(\text{grip end})\}/2$$

where A is the ratio of the distance between the colored mark CM1 and the grip end to the distance between the colored marks CM1 and CM2.

Ground

The coordinate of the position of the lowermost pixel of the contour R is regarded as the ground (step S107).

Rear Part of Neck

Figure 28A:
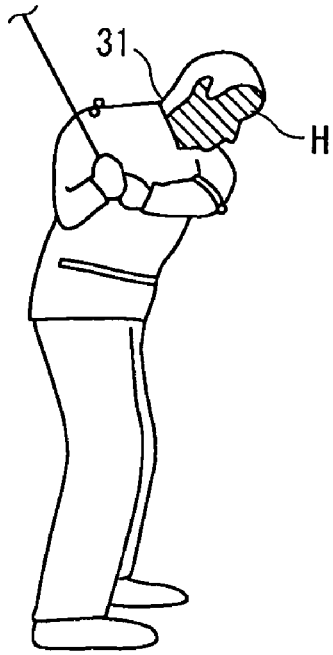
FIGS. 28A and 28B are explanatory views for explaining skin extraction.
Figure 28B:
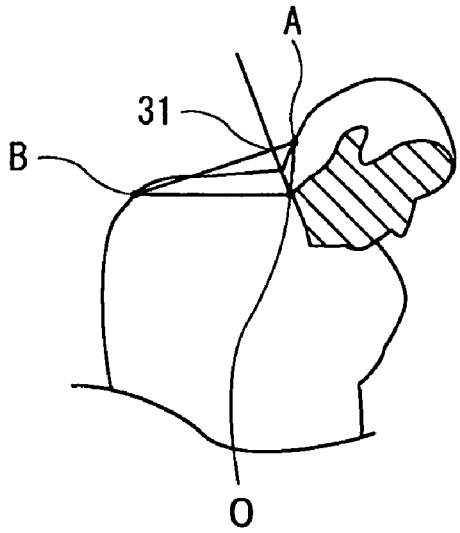

A region in which the golfer's head is present is narrowed from the silhouette region of the golfer 11. In the region, differential processing is executed by using the background image. Thereafter an aggregated region of pixels satisfying the following conditions is regarded as the skin (step S108). The conditions are as follows: hue=0 to 30, R=20 to 240, G=20 to 180, and B=not more than 180. The threshold of the area is set to the range of 30 to 1400 pixels when the aggregated region is regarded as the skin. As shown in FIGS. 28A and 28B, in an extracted skin color region H, a contour point of a face region whose X-coordinate is minimum is denoted as O. A contour point having an X-coordinate equal to that of the contour point O and having a minimum Y-coordinate is denoted as A. A contour point having a Y-coordinate equal to that of the point O and having a minimum X-coordinate is denoted as B. The intersection of a straight line vertical to the inclination of a straight line AB and passing through the point O and the contour is specified as a rear part 31 of the neck (step S110).

When extraction of the skin color has failed (step S109) and when the coordinate of the position of the rear part 31 of the neck has been obtained in the address image (in side view, step S111), the intersection of the X-coordinate of the position of the rear part 31 of the neck in the address image (in side view) and the contour R in the take-back left arm horizontal image is computed. Curvatures of 10 pixels in front of and behind a pixel, disposed on the contour R, which has a smallest Y-coordinate are extracted from the intersection (step S112). A pixel having a curvature which is not more than zero and is minimum is specified as the rear part 31 of the neck (steps S113, S110).

When extraction of the rear part 31 of the neck has failed (step S111) or when extraction of the rear part 31 of the neck by using the curvature (step S113) has failed, a pixel disposed on the contour R, which is spaced by 90% of the height of the golfer's silhouette above the lower end thereof in its Y-coordinate and has a minimum X-coordinate is extracted as the rear part 31 of the neck (steps S114, S110).

Y-coordinate of Right Waist

Initially, the search range S is set in a range of −40 to 40 pixels in the X-direction and −60 to 20 pixels in the Y-direction. An average value (Y) of heights of the golfer's silhouette above the ground and the center of gravity of the silhouette are set as start points of the search range S. Thereafter the color of the belt-shaped colored mark M7 is extracted to obtain the Y-coordinate of the right waist (steps S114-2, S115, S116).

When color extraction of the colored mark M7 has failed, a position spaced by 60% of the length of the golfer's silhouette above the lowermost end thereof is regarded as the Y-coordinate of the right waist (step S117).

Figure 27:
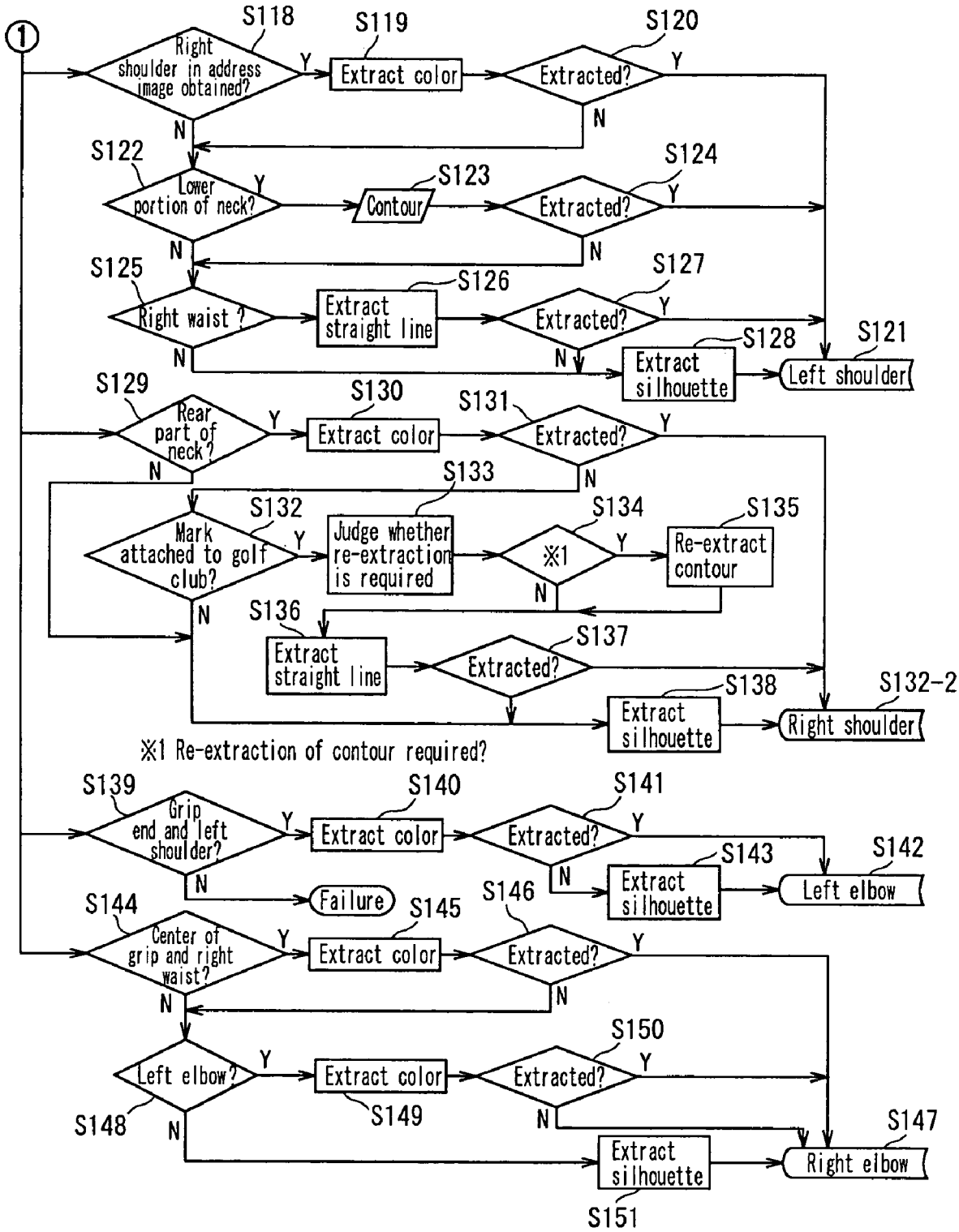
FIG. 27 is a flowchart showing a subroutine of a part of the flowchart of FIG. 26.

Extraction of left and right shoulders and left and right elbows is executed by calling a subroutine shown in FIG. 27.

Left Shoulder

Figure 29A:
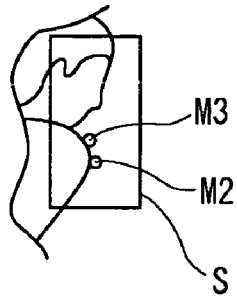
FIG. 29A shows extraction of the left shoulder by color extraction.

When the right shoulder in the address image (in side view) has been obtained (step S118), as shown in FIG. 29A, the search range S is set in a range of +40 pixels in the X-direction and ±40 pixels in the Y-direction with respect to the position of the right shoulder to execute color extraction of the colored mark M2 on the left shoulder (step S119). When the extraction of the colored mark M2 has succeeded, the coordinate thereof is stored as the left shoulder (steps S120, S121).

Figure 29B:
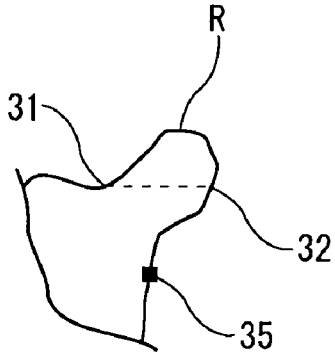
FIG. 29B shows extraction of the left shoulder by contour extraction.

When the extraction of the left shoulder in the address image (in side view, step S118) has failed and when the color extraction has failed (step S120), a pixel, disposed on the contour R, which has a Y-coordinate equal to the Y-coordinate of the rear part 31 of the neck is extracted as a lower portion 32 of the neck (step S122), as shown in FIG. 29B. Thereafter by using the information of rise and fall of the contour R obtained from the lower portion 32 of the neck, the left shoulder is decided (step S123).

More specifically, the contour R is examined clockwise from the lower portion 32 of the neck. When a mountain (maximum point) is found initially, the coordinate of the position of the left shoulder 35 is obtained as follows: a mountain within 30 pixels in the direction clockwise from the lower portion 32 of the neck→a valley (minimum point) within 30 pixels in the direction clockwise from the mountain→a mountain within 20 pixels in the direction clockwise from the valley.

When a valley (minimum point) is found initially in examining the contour R clockwise from the lower portion 32 of the neck, the coordinate of the position of the left shoulder 35 is obtained as follows: a valley within 30 pixels in the direction clockwise from the lower portion 32 of the neck→a mountain within 20 pixels in the direction clockwise from the valley (steps S124, 121).

Figure 29C:
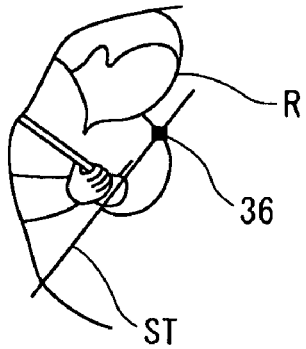
FIG. 29C shows extraction of the left shoulder by using a straight line portion.

When the extraction of the lower portion 32 of the neck has failed (step S122) or when the extraction by using the rise and fall of the contour R has failed (step S124), the straight line portion ST of the contour R is extracted at step S126 in a region from a right waist (step S125) to (Y-coordinate of right waist) to (Y-coordinate of right waist −30 pixels) in the Y-direction, as shown in FIG. 29C. The intersection of the straight line portion ST and the contour R is regarded as the left shoulder 36 (steps S127, S121). A pixel at the intersection is disposed at a position spaced by 80% to 90% of the length of the golfer's silhouette above the lowermost end thereof and has a minimum Y-coordinate. If extraction of the straight line portion has failed, the contour of (Y-coordinate of right waist) to (Y-coordinate of right waist −30 pixels) is used to extract a straight line by using the method of least square.

Figure 29D:
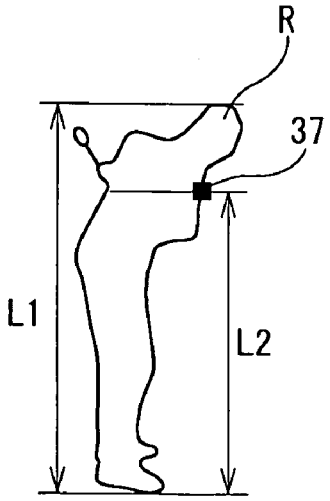
FIG. 29D shows extraction of the left shoulder by silhouette information.

When the right waist has not been found (step S125) or when the left shoulder has not been found at a position spaced by 80% to 90% of the length of the golfer's silhouette above the lowermost end thereof, as shown in FIG. 29D, a pixel having a maximum X-coordinate and disposed on the contour R at a position thereof spaced by 85% (L2/L1=0.85) of the length of the golfer's silhouette above the lowermost end thereof is stored as the coordinate of the position of the left shoulder 35 (steps S128, S121).

Right Shoulder

When extraction of the rear part 31 of the neck has succeeded (step S129), the search range S is set in a range of −50 pixels in the X-direction and ±20 pixels in the Y-direction by setting the position of the rear part 31 of the neck as a start point to execute color extraction of the colored mark M4 on the right shoulder (step S130). When the extraction of the colored mark M4 has succeeded, the coordinate thereof is stored as the right shoulder (steps S131, S132-2).

When the color extraction has failed (step S131) and when the extraction of the colored marks CM1 through CM3 has succeeded (step S132), it is judged (step S133) whether or not it is necessary to execute contour re-extraction processing of removing the contour of the shaft 13*a* intersecting with the contour R. If the contour of the shaft 13*a* is in intersection with that of the golfer's body (step S134), the contour re-extraction processing of removing the contour of the shaft 13*a* from the information of the contour is executed (step S135). If the shaft 13*a* does not appear on the contour, the contour re-extraction processing is not executed but straight line extraction processing is executed (step S136).

It is judged whether the straight line portion ST having an inclination of 190° to −180° is present on the contour R in the take-back left arm horizontal image at a position within +10 from the Y-coordinate of the rear part of the neck in the take-back left arm horizontal image (in side view). It is also judged whether two straight line portions each having a downward inclination of 90° to 180° is present between the rear part of the neck and the Y-coordinate of the right waist. If the two straight line portions are found, the intersection thereof is stored as the right shoulder (steps S137, S132-2).

When the rear part of the neck cannot be found (step S129), when the colored marks CM1 through CM3 cannot be extracted (step S132), and when the two straight line portions have not been extracted (step S137), a pixel disposed on the contour R at a position thereof spaced by 80% of the length of the golfer's silhouette above the lowermost end thereof and having a minimum X-coordinate is stored as the right shoulder (steps S138, 132).

Left Elbow

When extraction of the grip end and the left shoulder has failed (step S139), the processing is determined as failure. When the extraction of the grip end and the left shoulder have succeeded, the search range S is set in the range from the grip end to the left shoulder in the X-direction and in the range from the left shoulder to (grip end+40 pixels) in the Y-direction to extract the color of the colored mark M1 on the left elbow (step S140). If the extraction of the colored mark M1 has succeeded, the coordinate thereof is stored as the left elbow (steps S141, S142). If the extraction of the colored mark M1 has failed, the midpoint between the left shoulder and the grip end is extracted by regarding it as the left elbow (steps S143, S142)

Right Elbow

When the extraction of the center of the grip and the right waist in the address image (in side view) has succeeded (step S144), the search range S is set in the range of ±50 pixels in the X-direction and ±50 pixels in the Y-direction by setting the position of the center of the grip as the starting point to execute color extraction (step S145) of the colored mark M6 mounted on the right elbow after excluding the extracted skin color portion, a portion in the vicinity of the shaft, and a region below the right waist in the address image (in side view) from the search range S. When the extraction of the colored mark M6 has succeeded, the coordinate thereof is stored as that of the right elbow (steps S146, S147).

When the extraction of the center of the grip and the right waist in the address image (in side view) have failed (step S144) or the color extraction has failed (step S146), the search range S is set in a range of ±25 pixels in the X-direction and ±25 pixels in the Y-direction by setting contour points whose Y-coordinate are equal to that of the left elbow and whose X-coordinates are minimum as starting points to execute color extraction of the colored mark M6 mounted on the right elbow (step S149). When the extraction of the colored mark M6 has succeeded, the coordinate thereof is obtained as the coordinate of the position of the right elbow (step S150).

When the extraction of the left elbow has failed (step S148), a contour point which has a minimum X-coordinate and is disposed on the contour R at a position thereof spaced by 65% of the length of the golfer's silhouette above the lowermost end thereof in −Y direction is set as the right elbow (steps 151, 147). When the color extraction has failed (step S150), the starting point of the search range used in the second color extraction is set as the right elbow (step S147).

Spine Axis

With reference to the flowchart shown in FIG. 26, when the extraction of the right waist and the rear part 31 of the neck has succeeded and when the color extraction of the right shoulder has succeeded (step S152), an offset movement is executed in such a way that the straight line portion ST passes through the rear part 31 of the neck with the angle of the straight line portion kept, supposing that the straight line portion ST is present on the contour R between the right shoulder and the right waist (step S153). Thereby a spine axis (line connecting center between right and left parts of waist and neck to each other) can be obtained (steps S154, S155).

When the color extraction of the right shoulder has failed (step S152) and when the extraction of the right waist and the rear part of the neck has failed (step S156), the processing is determined as failure. When the extraction of the right waist and the rear part of the neck has succeeded, the contour R between the rear part of the neck and a contour point intersecting with the Y-coordinate of the right waist and having a minimum X-coordinate is used to obtain the spine axis by performing the method of least square of the straight line portion (steps S157, S158, S155).

X-Coordinate of Right Waist

When the extraction of the Y-coordinate of the right waist and the spine axis has failed (step S159), the processing is determined as failure. On the other hand, when the extraction thereof has succeeded, a pixel having a Y-coordinate equal to that of the right waist is specified on the spine axis. Thereby the X-coordinate of the right waist can be obtained (steps S160, S161).

As described above, it is possible to obtain the coordinate of the position of the attention-focused points of the take-back left arm horizontal image (in side view) by making the most of a plurality of image processing algorithms, as shown in the flowcharts of FIGS. 26 and 27.

With reference to FIG. 3, based on information obtained by a ball motion measuring apparatus 20, the behavior of a golf ball is computed by using the computer 16 (step S16).

More specifically, the hitting speed-measuring sensor 24 detects the passage of the golf club 13 hit by the golfer 11 between the light-projecting device 25 and the light-receiving device 26 and outputs a trigger signal. Upon receipt of the trigger signal, the CCD camera 21 opens and closes the multiple shutter 22 successively. Synchronously with the opening and closing of the multiple shutter 22, each stroboscope 23 emits light sequentially. Thereby a plurality of balls B which fly is photographed in one image frame. By using a method similar to that disclosed in Japanese Patent Application No. 2001-264016, the deviation angle (angle formed by ball trajectory to right or left with respect to predetermined progress direction (straight) thereof) of the ball B and the sidespin amount (rotational amount) thereof are computed.

Based on the obtained sidespin amount and deviation angle, the trajectory pattern is computed (step S17) by using a classifying method shown in table 2. For example, when the amount of the left sidespin is not less than 200 rpm, and the deviation angle is two degrees to the left, the trajectory pattern is judged as "pull hook".

When the deviation distance of the drop point of a hit ball to the right or the left with respect to a straight direction is not more than five yards, the trajectory pattern is set as "straight (draw)" in the embodiment. The deviation distance to the right or the left with respect to the straight direction means the distance between the drop point of the hit ball and the straight line computed from the sidespin amount and the deviation angle by utilizing trajectory computations. For example, when the deviation angle is four degrees and the amount of the left sidespin is 500 rpm, the trajectory pattern is judged as "push hook" in the classification shown in table 2. However, when computations for finding the trajectory indicates that the ball has flied almost in the middle, the trajectory pattern is classified as the "straight (draw)" pattern.

TABLE 2

| Sidespin (pm) | | Deviation angle (deg) | | Trajectory pattern | | Remarks |
|---|---|---|---|---|---|---|
| Left | Not less than 200 rpm | Left | Not less than 2 degrees | A | Pull hook | |
| Left and right | less than 200 rpm | Left | Not less than 2 degrees | B | Pull | |
| Right | Not less than 200 rpm | Left | Not less than 2 degrees | C | Pull slice | |
| Left | Not less than 200 rpm | Left and right | Less than 2 degrees | D | Straight hook | |
| Left and right | less than 200 rpm | Left and right | Less than 2 degrees | E | Straight | |
| — | — | — | — | E | Straight | Deviated distance within 5 yards |
| Right | Not less than 200 rpm | Left and right | Less than 2 degrees | F | Straight slice | |
| Left | Not less than 200 rpm | Right | Not less than 2 degrees | G | Push hook | |
| Left and right | less than 200 rpm | Right | Not less than 2 degrees | H | Push | |
| Right | Not less than 200 rpm | Right | Not less than 2 degrees | I | Push slice | |

Based on the trajectory pattern obtained in the above-described manner (step S17) and coordinate data (step S14) of the attention-focused points in each check-point image, the swing form is diagnosed (step S18). That is, diagnosis items that will be described below are prepared for each trajectory pattern.

How the ideal value of each of the diagnosis items prepared for each check-point image is set is described below with reference to tables 3 and 4.

Diagnosis of Front-View Image

Initially the diagnosis item for each of the front-view check-point images is described below.

TABLE 3

(Diagnosis in front view)

Figure 32:
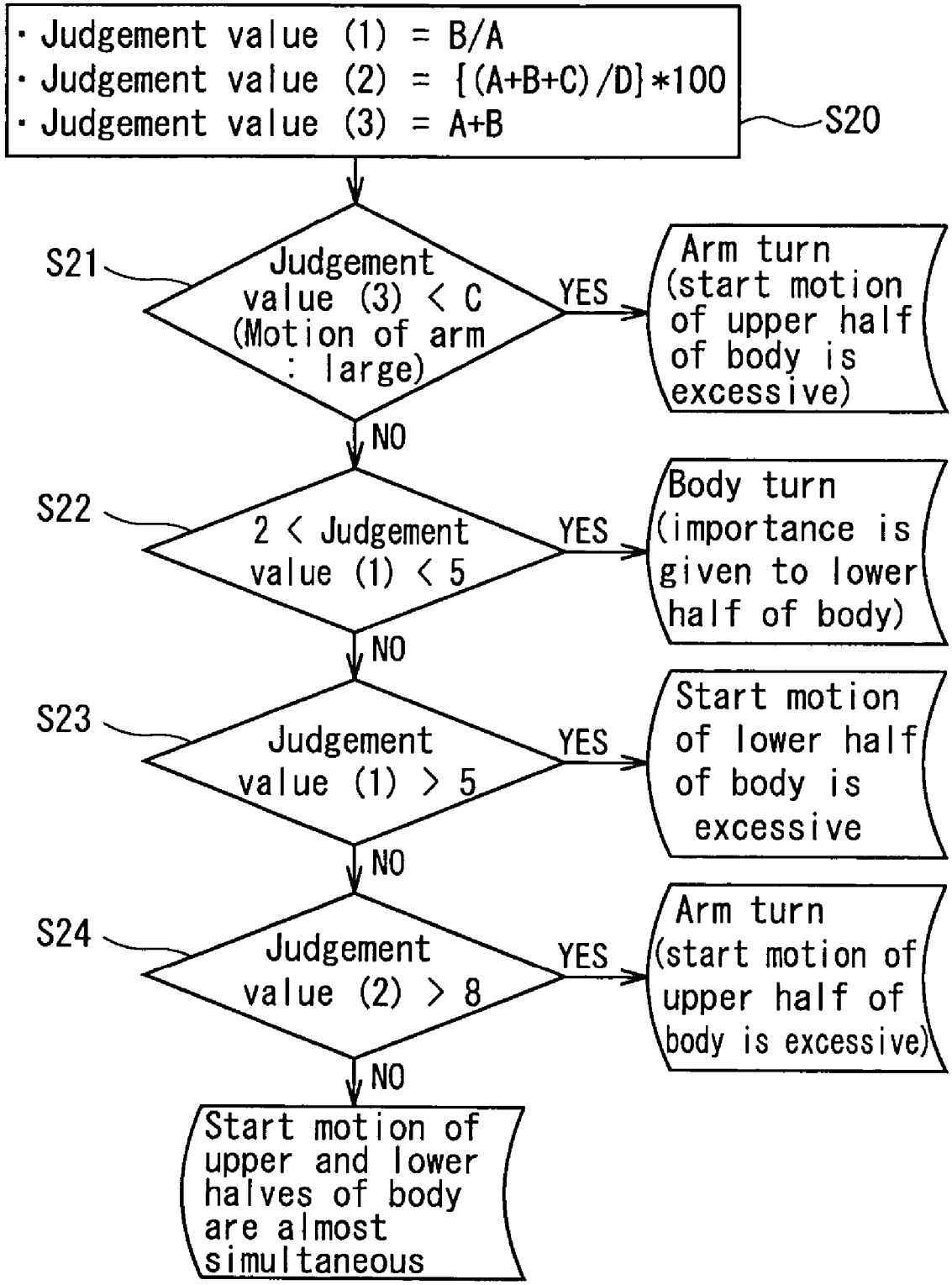
FIG. 32 is a flowchart of diagnosing a conversion from backswing to forward swing made at the top state which is performed from the top state.

| Diagnosis point | No | Diagnosis item | Not less than judgement value | | Result of diagnosis | Not more than judgement value | | Result of diagnosis | Mark |
|---|---|---|---|---|---|---|---|---|---|
| Address | 1 | Position of ball | 5 | cm | Ball is outside | −5 | cm | Ball is inside | 3 |
| | 2 | Length of stance | 1.80 | — | Stance is long | 1.05 | — | Stance is short | 3 |
| | 3 | Balance of upper half of golfer's body | 3 | cm | Shoulder deviates to left | −6 | cm | Shoulder deviates to right | 3 |
| | 4 | Balance of lower half of golfer's body | 3 | cm | Knee deviates to left | −3 | cm | Knee deviates to right | 3 |
| Take-back shaft 8 o'clock | 5 | Orientation of grip end | 10 | cm | shaft is held inappropriately by hands | −10 | cm | Head goes slow | 2 |
| | 6 | Angle of shaft with respect to ideal shaft line | 20 | deg | Position of hand is too high (ball is hit by applying excessive force to hands) | −20 | deg | Shaft is held inappropriately by hands | 1 |
| | 7 | Movement amount of right shoulder with respect to movement amount thereof in address state | 10 | cm | Right part of waist is disposed rearward | — | | — | 1 |
| Take-back arm horizontal | 8 | Wrist angle | 140 | deg | Cocking operation is slow | — | | — | 1 |
| Top | 9 | Over-swing | 300 | deg | Over-swing | — | | — | 2 |
| | 10 | swing direction change-over motion made at the top state (area ratio) | Refer to FIG. 32 | | | | | | 2 |
| | 11 | Movement amount toward left and right (right contour point - right edge of right foot) | Value of Address | cm | Weight does not shift | 0 | cm | Golfer sways excessively | 1 |
| | 12 | Position of right knee | — | | — | 0 | cm | Right knee is bent excessively | 1 |
| | 13 | Warping of upper half of body | 90 | deg | Upper half of body warps | — | | — | 2 |
| Downswing shaft 9 o'clock | 14 | Change of amount of wrist angle | 60 | deg | Cocking operation is released early | — | | — | 2 |

TABLE 3-continued (Diagnosis in front view)

| Diagnosis point | No | Diagnosis item | Not less than judgement value | | Result of diagnosis | Not more than judgement value | | Result of diagnosis | Mark |
|---|---|---|---|---|---|---|---|---|---|
| Impact | 15 | Shift amount toward left and right (left contour point - left edge of left foot) | 0 | cm | Golfer sways | Address (left-hand contour point - navel) | cm | Weight does not shift | 2 |
| | 16 | Vertical shift amount | 10 | cm | Position of waist is high | −10 | cm | Position of waist is at low level | 2 |
| | 17 | Distance between head and ball | — | | — | 0 | cm | Golfer sways considerably | 2 |
| | 18 | Rotational amount of shoulder | 1.6 | — | Shoulder rotates excessively | 1.1 | — | Shoulder does not rotate | 2 |
| | 19 | Inclination of spine axis | — | | — | 70 | deg | Vertically moves | 2 |
| | 20 | Angle of left elbow | — | | — | 170 | deg | Left elbow is positioned rearward | 3 |
| | | | | | | | | Total of marks in front view | 40 |
| | | | | | | | | Total of marks in side view | 60 |
| | | | | | | | | Total of marks | 100 |

Address State

As shown in table 3, in the address state, the following diagnosis items are provided when the golfer 11 is viewed in a direction forward therefrom: No. 1: position of ball, No. 2: length of stance, No. 3: balance of upper half of golfer's body (shoulder), and No. 4: balance of lower half of golfer's body (waist).

The judgement value of each of the diagnosis items No. 1 through No. 4 is as described below.

No. 1: (the X-coordinate of the position of the ball B)−(the X-coordinate of the left heel)=−5 to 5 cm No. 2: (the length between both feet)/(the width between the right and left shoulders)=1.05 to 1.80

No. 3: (the midpoint between the right and left shoulders)−(the midpoint between the right and left heels)=−6 to 3 cm No. 4: (the midpoint (navel) between the right and left parts of the waist)−(the midpoint between the right and left heels)=−3 to 3 cm Take-Back Shaft 8 O'Clock State In the take-back shaft 8 o'clock state, the following diagnosis items are provided when the golfer 11 is seen in the direction forward therefrom: No. 5: orientation of grip end, No. 6: angle of shaft with respect to ideal shaft line, and No. 7: movement amount of right shoulder with respect to position thereof in address state.

The judgement value of each of the diagnosis items No. 5 through No. 7 is as follows:

No. 5: (the X-coordinate of the intersection of the shaft line and a straight line connecting the right and left parts of the waist to each other)−(the X-coordinate of the midpoint (navel) of the right and left parts of the waist in the address state)=−10 to 10 cm.

No. 6: (the angle formed between the shaft line and the Y-axis)−60 degrees=−20 to 20 degrees No. 7: (the Y-coordinate of the right shoulder)−(the Y-coordinate of the right shoulder in the address state)=not more than 10 cm Take-Back Left Arm Horizontal State In the take-back left arm horizontal state, the following diagnosis item is provided when the golfer 11 is viewed in the direction forward therefrom: No. 8: angle of wrist.

As the judgement value of the diagnosis item No. 8, the angle between the shaft line and the center line of the template T which has extracted the take-back left arm horizontal state is not more than 140 degrees.

Top State

In the top state, the following diagnosis items are provided when the golfer 11 is viewed in the direction forward therefrom: No. 9: over-swing, No. 10: swing direction change-over motion at top state, No. 11: movement amount toward left and right, No. 12: position of right knee, and No. 13: warping of upper half of golfer's body.

The judgement value of each of the diagnosis items No. 9 through No. 11 is as follows:

No. 9: The angle between the shaft line and the Y-axis≦300 degrees

No. 10: Will be described later.

No. 11: When the value of (the X-coordinate of a right-hand contour point of a navel line)−(the X-coordinate of the right foot) is larger than the value of (the X-coordinate of the right-hand contour point of the navel line in the address state)−(the X-coordinate of the right edge of the right foot), it is judged that a weight shift has not occurred. When the above subtraction is less than 0, it is judged that the upper half of the golfer's body has swayed excessively.

No. 12: The value of (the X-coordinate of a contour point having the height of the right knee)−(the X-coordinate of the right edge of the right foot)>0

No. 13: The average value of inclinations of straight portions extracted from a region from a right-hand contour point having the height of the navel line to −50 pixels along a contour is set to less than 90 degrees. The method of extracting the straight portions is similar to that of the above-described method of extracting the straight portion ST. If the extraction of the straight portions has failed, a linear interpolation is executed for the contour present between the right-hand contour point having the height of the navel line and −50 pixels.

Downswing Shaft 9 O'Clock State

In the downswing shaft 9 o'clock state, the following diagnosis item is provided when the golfer 11 is viewed in the direction forward therefrom: (No. 14): change of wrist angle from downswing left arm horizontal state till downswing shaft 9 o'clock state.

As the judgement value of the diagnosis item No. 14, the value of (the angle between the shaft line in the downswing left arm horizontal state and the center line of the template T which has extracted the downswing left arm horizontal state)−(the angle between the shaft line in the downswing shaft 9 o'clock and a straight line connecting the wrist and the left shoulder to each other)<60 degrees.

More specifically, when the difference between the wrist angle in the downswing unskillful arm horizontal image and the wrist angle in the downswing shaft 9 o'clock image is not less than 60 degrees, it is diagnosed that the golfer 11 has performed a cock motion. It is possible to judge that the golfer 11 has performed a cock motion when the wrist angle in the downswing left arm horizontal state or in the downswing shaft 9 o'clock image is not less than a predetermined value.

Impact State

In the impact state, the following diagnosis items are provided when the golfer 11 is viewed in the direction forward therefrom: (No. 15): movement amount toward left and right, No. 16: vertical movement amount, No. 17: distance between golfer's head and ball, No. 18: rotational amount of shoulder, No. 19: inclination of spine axis, and No. 20: angle of left elbow.

The judgement value of each of the diagnosis items No. 15 through No. 20 is as follows:

No. 15: If the value of (the X-coordinate of a left-hand contour point having the height of the navel in the impact state)−(the X-coordinate of the left edge of the left foot in the impact state) is less than 0, the movement amount of the golfer's body toward the left and right is allowed. If the value obtained by the above subtraction is smaller than the value of (the X-coordinate of the left-hand contour point in the address state)−(the X-coordinate of the navel in the address state), it is judged that the golfer's weight has not shifted.

No. 16: The value of (the Y-coordinate of the navel in the address state)−(the Y-coordinate of the navel in the impact state)=−10 to 10 cm.

No. 17: The value of (the X-coordinate of the ball)−(the X-coordinate of the golfer's head)>0.

No. 18: The value of (the distance between the right and left shoulders in the X-direction in address state)/(the distance between the right and left shoulders in the X-direction in the top state)=1.1 to 1.6.

No. 19: The angle formed between a line connecting the head and the navel to each other and a straight line connecting the right-hand contour point having the height of the navel and the navel to each other>70 degrees.

No. 20: The angle between a line connecting the left shoulder and the left elbow and a straight line connecting the left elbow and the grip end to each other >170 degrees.

The diagnosis items to be used to judge the conversion from backswing to forward swing made at the top state (No. 10) are described below.

Figure 31A:
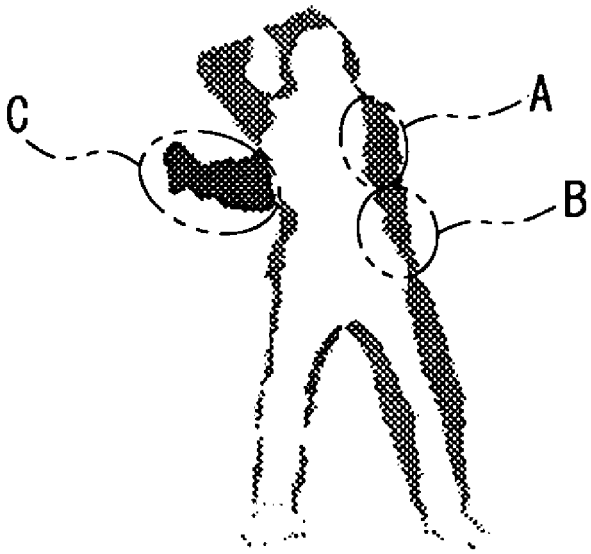
FIG. 31A shows a differential silhouette.
Figure 31B:
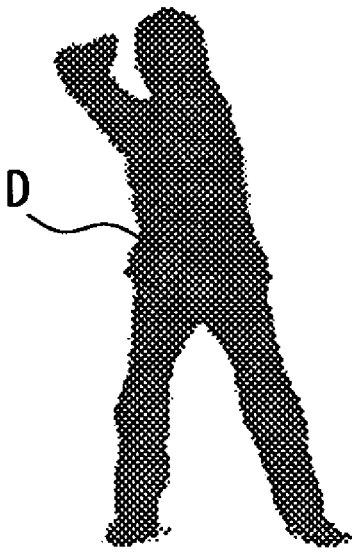
FIG. 31B shows a golfer's silhouette in a top state.

FIG. 31A shows a differential silhouette obtained by executing differential processing between the frame of the top image and the frame of an image obtained after an elapse of a predetermined period of time (in this embodiment, 80 msec) from the time when the top image is obtained. FIG. 31B shows a silhouette of the golfer 11 in the top image.

With reference to FIG. 31A, the area of the differential silhouette in the vicinity of the left shoulder is denoted by A. The area of the differential silhouette in the vicinity of the left waist is denoted by B. The area of the differential silhouette in an arm region is denoted by C. The area of the silhouette of the golfer 11 in the top image shown in FIG. 31B is denoted by D.

A conversion from backswing to forward swing which is performed after the top state is diagnosed with reference to the flowchart in FIG. 32. The definition of a judgement value is as follows:

Judgement value (1)=B/A

Judgement value (2)={(A+B+C)/D} 100

Judgement value (3)=A+B

When the judgement value (3)<C (step S31), it is diagnosed that the arm motion is large and that the upper half of the golfer's body has started to move excessively (arm turn). When the condition of step S31 has not been satisfied and 2<the judgement value (1)<5, it is diagnosed at step S32 that the golfer 11 has turned her/his body by giving importance to the lower half of the golfer's body. When the condition of step S32 has not been satisfied and the judgement value (1)>5 (step S33), it is diagnosed that the lower half of the golfer's body has started to move excessively (body turn). When the condition of step S34 has not been satisfied and the judgement value (2)>8 (step S34), it is diagnosed that the upper half of the golfer's body has started to move excessively (arm turn). When the condition of step S34 has not been satisfied, it is diagnosed that the upper half of the golfer's body and the lower half thereof have started to move almost simultaneously.

That is, the predetermined judgement values are set by considering the area of the differential silhouette as the motion amount of the golfer's body in the conversion from backswing to forward swing that is performed at the top state. Thereby the golfer's conversion from backswing to forward swing made at the top state can be diagnosed.

Diagnosis in Side-View Image (Rearward in Ball Fly Line Direction)

The diagnosis item for each of the check-point side-view images is described below.

TABLE 4

(Diagnosis in side view)

| Diagnosis point | No | Diagnosis item | Not less than judgement value | Result of diagnosis | Not more than judgement value | Result of diagnosis | Mark |
|---|---|---|---|---|---|---|---|
| Address | 1 | Right shoulder is disposed on thenar | 10 cm | shoulder is present forward from line | −10 cm | Shoulder is disposed rearward from line | 3 |
| | 2 | Right knee is disposed on thenar | 3 cm | Knee is present forward from line | −3 cm | Knee is disposed rearward from line | 3 |

TABLE 4-continued (Diagnosis in side view)

| Diagnosis point | No | Diagnosis item | Not less than judgement value | | Result of diagnosis | Not more than judgement value | | Result of diagnosis | Mark |
|---|---|---|---|---|---|---|---|---|---|
| | 3 | Position of grip | 30 | cm | Grip is far | 10 | cm | Grip is near | 3 |
| | 4 | Spine angle | 130 | deg | Almost erect | 100 | deg | Excessively stooped | 3 |
| Take-back shaft 8 o'clock | 5 | Angle with respect to original shaft line | 10 | deg | Take back inward | −10 | deg | Take back outward | 1 |
| | 6 | Distance from original shaft line | 10 | cm | Hands are at high level | −10 | cm | Hand is excessively low | 1 |
| Take-back arm horizontal | 7 | Intersection of shaft and ball line | 1 | — | Horizontally deviated | 0.66 | — | Vertically deviated | 1 |
| | 8 | Difference between level of right elbow and level of left elbow | 10 | cm | Left elbow is at high level | −10 | cm | Right elbow is at high level | 1 |
| | 9 | Position of shaft (right or left with respect to judgement line) | Right | — | Shaft is held forward | Left | — | Shaft is held rearward | 1 |
| | 10 | Position of shoulder | 100 | deg | Spine is bent excessively | 80 | deg | Spine is almost erect | 1 |
| Top | 11 | Movement distance of right knee | — | | — | −3 | cm | Right knee is positioned excessively rearward | 1 |
| | 12 | Movement distance of left knee | 20 | cm | Left elbow is positioned excessively forward | — | | — | 1 |
| | 13 | Parallelism of forearm with spine line | 30 | deg | Flying elbow | — | | — | 2 |
| | 14 | Position of wrist | 15 | cm | Wrist is excessively forward | −15 | cm | Wrist is excessively rearward | 2 |
| | 15 | Parallelism of shaft line with target direction | 20 | cm | Shaft is inward | −20 | cm | Shaft is outside | 1 |
| | 16 | Difference between level of right elbow and level of left elbow | 10 | cm | Left elbow is at high level | −10 | cm | Right elbow is at high level | 1 |
| | 17 | Level of grip | 60 | deg | Grip position is at high level | 45 | deg | Grip position is low | 1 |
| | 18 | Distance between shoulder and wrist | — | | — | 15 | cm | The distance of wrist and shoulder is short. | 2 |
| Downswing shaft arm horizontal | 19 | Angle with respect to original shaft line | 15 | deg | Shaft is upward (outside-to-inside) | −15 | deg | Shaft is downward (inside-to-outside) | 5 |
| | 20 | Distance from original shaft line | 30 | cm | Excessively upward from swing plane | 0 | cm | Excessively downward from swing plane | 3 |
| Downswing shaft 9 o'clock | 21 | Whether head is present on shaft line | 10 | cm | Outside-to-inside swing orbit | −10 | cm | Inside-to-outside swing orbit | 3 |
| Impact | 22 | Angle with respect to original shaft line | 5 | deg | Upward | −5 | deg | Downward | 2 |
| | 23 | Amount of change of spine angle | 10 | deg | Almost erect | −10 | deg | Excessively stooped | 3 |
| | 24 | Amount of change of knee angle | 10 | deg | Knee is stretched | −25 | deg | Knee is bent | 2 |
| | 25 | Rotational amount of waist | 1.5 | — | Waist rotates excessively | 1.1 | — | Waist does not rotate | 2 |
| | 26 | Distance between grip and golfer's body | 15 | cm | Grip position is too far | 5 | cm | Grip position is excessively near | 3 |
| | 27 | Front-to-back motion of spine | 5 | cm | Weight is applied to toe | −5 | cm | Weight is applied to heel | 3 |
| | 28 | Swing orbit | 10 | deg | Inside-to-outside swing orbit | −5 | deg | outside-to-inside swing orbit | 5 |

Address State

As shown in table 4, in the address state, the following diagnosis items are provided when the golfer 11 is seen in a side view: No. 1: Whether right shoulder is present over thenar, No. 2: Whether right knee is present over thenar, No. 3: position of grip, and No. 4: spine knee angle.

The judgement value of each of the diagnosis items No. 1 through No. 4 is as follows:

No. 1: The value of (the X-coordinate of the position of the right shoulder)−(the X-coordinate of the thenar of the right foot)=−10 to 10 cm No. 2: The value of (the X-coordinate of the right knee)−(the X-coordinate of the thenar of the right foot)=−3 to 3 cm.

No. 3: The value of (the X-coordinate of the grip end)−(the X-coordinate of the intersection of a horizontal line passing through the grip end and the silhouette)=10 to 30 cm No. 4: The angle between a line (spine axis) connecting the rear part of the neck and the right part of the waist to each other and a line connecting the right knee and the right part of the waist to each other=100 to 130 degrees Take-Back Shaft 8 O'Clock State In the take-back shaft 8 o'clock state, the following diagnosis items are provided when the golfer 11 is seen in a side view: No. 5: angle between original shaft line in address state and shaft line in take-back shaft 8 o'clock state, and No. 6: distance between original shaft line and shaft line in take-back shaft 8 o'clock state.

The judgement value of each of the diagnosis items No. 5 and No. 6 is as follows:

No. 5: The value of (the shaft angle with respect to the X-axis in the address state)−(the shaft angle with respect to the X-axis in the take-back shaft 8 o'clock state)=−10 to 10 degrees No. 6: The distance from the grip end to the shaft line in the address state=−10 to 10 mm.

Take-Back Left Arm Horizontal State

In the take-back left arm horizontal state, the following diagnosis items are provided when the golfer 11 is seen in a side view: No. 7: intersection of shaft and ball line, No. 8: difference between height of right elbow and height of left elbow, No. 9: position of shaft, and No. 10: position of shoulder.

The judgement value of each of the diagnosis items No. 7 and No. 10 is as follows:

No. 7: The value of (the X-coordinate of the intersection of the shaft line and a ball line (a line connecting the ball and the toe of the left foot to each other))−(the X-coordinate of the toe of the left foot)/(the X-coordinate of the ball)−(the X-coordinate of the toe of the left foot)=0.66 to 1 cm.

No. 8: The value of (the Y-coordinate of the right elbow)−(the Y-coordinate of the left elbow)=−10 to 10 cm No. 9: When the X-coordinate of the colored mark CM1 nearest to the golfer's hand is larger than the X-coordinate of the toe of the right-hand foot, it is judged that the shaft is held forward. On the other hand, when the X-coordinate of the colored mark CM1 nearest to the golfer's hand is smaller than the X-coordinate of the toe of the right-hand foot, it is judged that the shaft is held rearward.

No. 10: The angle between a line connecting the right shoulder and the left shoulder to each other and the spine axis=80 to 100 degrees.

Top State

In the top state, the following diagnosis items are provided when the golfer 11 is seen in a side view: No. 11: movement distance of right knee, No. 12: movement distance of left knee, No. 13: parallelism of forearm with spine line, No. 14: position of wrist, No. 15: parallelism of shaft line with target direction, No. 16: difference between height of right elbow and that of left elbow, No. 17: height of grip, and No. 18: distance between shoulder and wrist.

The judgement value of each of the diagnosis items No. 11 and No. 18 is as follows:

No. 11: The value of (the X-coordinate of the right knee in the address state)−(the X-coordinate of the right knee in the top state)>−3 cm.

No. 12: The value of (the X-coordinate of the left knee in the address state)−(the X-coordinate of the left knee in the top state)<20 cm.

No. 13: The value of (the angle between a line connecting the wrist and the right elbow to each other and the Y-axis)−(the angle between a line connecting the right part of the waist and the rear part of the neck to each other and the Y-axis)<30 degrees.

No. 14: The value of (the X-coordinate of the wrist)−(the X-coordinate of the right shoulder)=−15 to 15 cm.

No. 15: The value of (the X-coordinate of the colored mark CM1)−(the X-coordinate of the wrist)=−20 to 20 cm.

No. 16: The value of (the Y-coordinate of the left elbow)−(the Y-coordinate of the right elbow)=−10 to 10 cm.

No. 17: The average value of (the angle formed between a line connecting the wrist and the left elbow to each other and the X-axis) and (the angle formed between a line connecting the wrist and the left shoulder to each other and the X-axis)=45 to 60 degrees.

No. 18: The value of (the Y-coordinate of the left shoulder)−(the Y-coordinate of the wrist)>15 cm.

Downswing Arm Horizontal State

In the downswing left arm horizontal state, the following diagnosis items are provided when the golfer 11 is viewed in a side view: No. 19: angle between shaft line and original shaft line (shaft line in address state) and No. 20: distance between original shaft line shaft line and grip end.

The judgement value of each of diagnosis items No. 19 and No. 20 is as follows:

No. 19: The angle formed between the shaft line in the address state and the shaft line in the downswing left arm horizontal state=−15 to 15 degrees.

No. 20: The distance between the grip end and the shaft line in the address state=0 to 30 cm.

Downswing Shaft 9 O'Clock State

In the downswing shaft 9 o'clock state, the following diagnosis item is provided when the golfer 11 is viewed in a side view: No. 21: Whether head is present on shaft line.

The judgement value of the diagnosis item No. 21 is as follows:

No. 21: The shortest distance between the shaft line in the address state and the head in the downswing shaft 9 o'clock state=−10 to 10 cm.

Impact State

In the impact state, the following diagnosis item is provided when the golfer 11 is viewed in a side view: No. 22: angle between original shaft line and shaft line in impact state, No. 23: amount of change of spine angle, No. 24: amount of change of knee angle, No. 25: rotational amount of waist, No. 26: distance between grip and golfer's body, No. 27: front-to-back motion of spine, and No. 28: swing orbit before and after impact state.

The judgement value of each of the diagnosis items No. 22 and No. 27 is as follows:

No. 22: The value of (the angle formed between the shaft and the X-axis in the address state)−(the angle between the shaft and the X-axis in the impact state)=−5 to 5 degrees.

No. 23: The value of (the angle formed between the spine axis and a line connecting the right-hand part of the waist and the right-hand part of the knee to each other in the impact state)−(the angle between the spine axis and the line connecting the right-hand part of the waist and the right-hand part of the knee to each other in the address state)=−10 to 10 degrees.

No. 24: The value of (the angle formed between the line connecting the right-hand knee and the right-hand part of the waist to each other and a line connecting the right-hand knee and the right-hand ankle to each other in the impact state)−(the angle formed between the line connecting the right-hand knee and the right-hand part of the waist to each other and the line connecting the right-hand knee and the right-hand ankle to each other in the address state)=−25 to 10 degrees. No. 25: The value of (the distance between the left and right contour points having the height of the navel in the impact state)/(the distance between the left and right contour points having the height of the navel in the address state)=1.1 to 1.5

No. 26: The value of (the X-coordinate of the grip end)−(the X-coordinate of the intersection of a horizontal line passing through the grip end and the silhouette)=5 to 15 cm.

No. 27: The average value of (the shortest distance between the spine axis in the impact state with respect to the spine axis in the address state) and (the shortest distance between the spine axis in the address state with respect to the spine axis in the impact state)=−5 to 5 cm.

The diagnosis item No. 28 is described in detail below. The coordinate of the position of the head 13*b* of the golf club 13 in the actual space is grasped by utilizing the front-view image and the side-view image. Thereby the swing orbit before and after the impact state is examined.

(1) Estimation of Position of Golf Club Head in Front-View Image and Side-View Image The coordinate of the position of the head 13*b* is estimated from the colored marks CM1 through CM3 by utilizing the front-view image and the side-view image (three-dimensional coordinate in actual space is hereinafter expressed by capital letters X, Y, Z, whereas plane coordinate of position of head 13*b* in images is expressed by small letters x, y). That is:

$$\text{The } X-\text{coordinate of the head } 13b = (x \text{ of mark } CM2) + n\cdot\{(x \text{ of mark } CM3) - (x \text{ of mark } CM2)\} = (1-n)\cdot(x \text{ of mark } CM2) + n\cdot(x \text{ of mark } CM3)$$

$$\text{The } Y-\text{coordinate of head } 13b = (y \text{ of mark } CM2) + n\cdot\{(y \text{ of mark } CM3) - (y \text{ of mark } CM3)\} = (1-n)\cdot(y \text{ of mark } CM2) + n\cdot(y \text{ of mark } CM3)$$

By using the X-coordinate and Y-coordinate of the head 13*b*, the (x-y) coordinate of the head 13*b* is computed for each of the front-view image and the side-view image. In the above equation, n is a constant and 2.1 is used in the front-view image and 1.8 is used in the side-view image.

Figure 33:
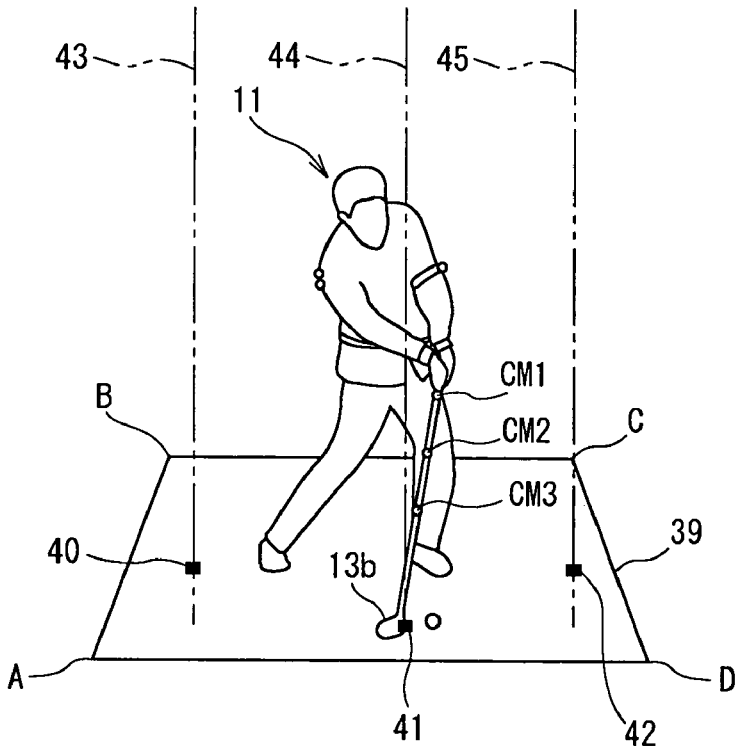
FIG. 33 is a front view used to find a swing orbit.
Figure 34:
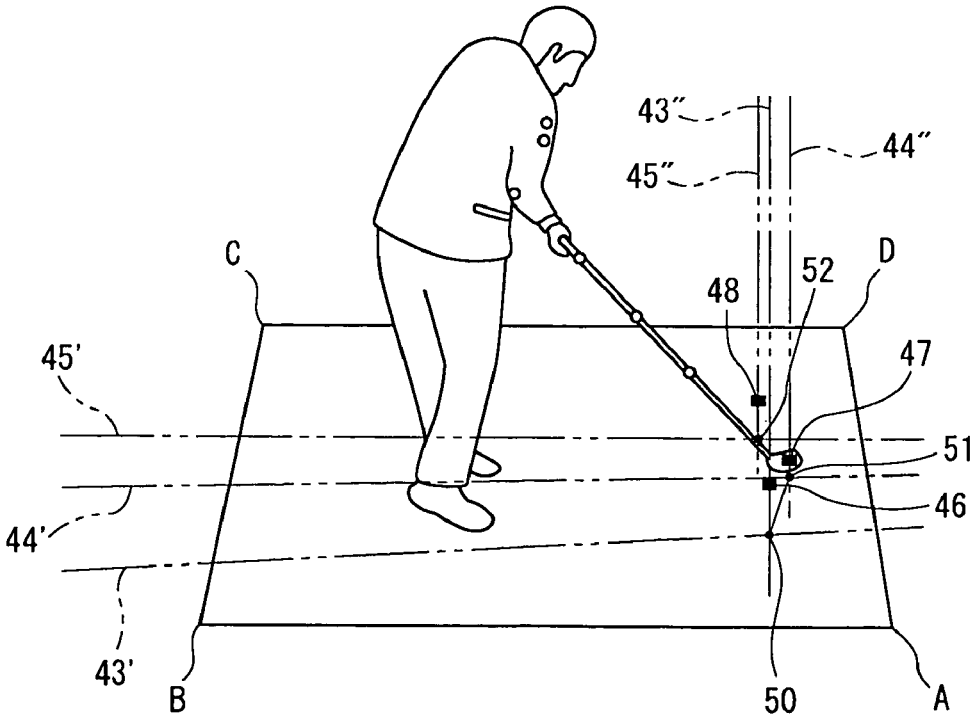
FIG. 34 is a side view used to find a swing orbit.

By using the computed coordinate of the position of the front-view image of the head 13*b* shown in FIG. 33, it is possible to specify the position 40 of the head 13*b* before the impact state, its position 41 in the impact state, and its position 42 after the impact state.

By displaying vertical lines 43 through 45 passing through the positions 40 through 42 respectively on the front-view image, it is possible to recognize the lines 43 through 45 in which points of the head 13*b* projected onto the ground are present before the impact state, in the impact state, and after the impact state.

(2) Assumption

In estimating the three-dimensional coordinate of the head 13*b*, the following items are assumed:

Assumption 1: The X-axis (abscissa axis) of the coordinate system of an image photographed by a camera is almost parallel with a ground surface.

Assumption 2: The optical axis of the camera is almost parallel with the ground surface.

Assumption 3: The optical-axis directions of two cameras form not less than 45 degrees and preferably almost 90 degrees therebetween.

Assumption 4: The position of the head 13*b* in a three-dimensional space is present on vertical lines including the position of the head 13*b* in a two-dimensional image when the head 13*b* is projected onto the ground.

Assumption 5: The above-described vertical lines overlap in the X-axis and the Y-axis in the three-dimensional space.

Assumption 6: The transformation rate of coordinates of positions of lines or the like on a plane vertical to a depth direction is constant.

(3) Identification of Projective Transformation Matrix 3.1 Obtaining of Control Point The data of the xy coordinate of four apexes A through D of a frame 39 is obtained by setting the four apexes A through D as control points in such a way that the front-view image is correspondent to the side-view image. It is preferable to obtain the xy coordinate in a background image (image in which golfer is not photographed). But it is possible to obtain the control points A through D from an image in which the golfer swings.

3.2 Computation of Projective Transformation Matrix

By utilizing the control points A through D, a matrix (projective transformation matrix) of transforming a straight line present on the ground in the front-view image into the side-view image is computed. At this time, the four control points A through D are present on the same plane. Thus by setting the camera in the manner as described in the assumptions 1 through 3, the number of parameters of simultaneous equations is reduced to eight (normally, 11). Thus when there are four groups of correspondent points x, y or more, it is possible to derive the projective transformation matrix. In this embodiment, there are four groups of correspondent points x, y for each of the four control points A through D, including the front-view image and the side-view image. Thus the projective transformation matrix can be derived. More specifically, supposing that the projective transformation matrix is P, that the coordinate of the correspondent point x in the front-view image is x ($x_1$, $x_2$), that the coordinate of the correspondent point y in the side-view image is y ($y_1$, $y_2$), and that a scale factor is s, the relationship indicated by a matrix of an equation 19 establishes.

$$Sy=Px \qquad \text{Equation 19}$$

Because there are four groups of the correspondent points x, y for each of the four control points A through D, the equation 19 can be expressed by an equation 20 shown below.

$$(P_{31\times1}+P_{32\times2}+P_{33})\begin{pmatrix} y_{i1} \\ y_{i2} \end{pmatrix} = \begin{pmatrix} P_{11\times i1}+P_{12\times i2}+P_{13} \\ P_{21\times i1}+P_{22\times i2}+P_{23} \end{pmatrix} \qquad \text{Equation 20}$$

In the above $x_{ij}$, $y_{ij}$, x is the side-view image, y is the front-view image, i=1 through 4 corresponds to the four control points A through D, j=1 is an X-coordinate in an image, and j=2 is a Y-coordinate in the image. That is, $x_{11}$ indicates the X-coordinate of the control point A in the side-view image.

Therefore in the case of four correspondent points, the equation 20 can be expressed as a linear equation 21 of the projective transformation matrix P shown below:

$$\begin{pmatrix} x_{11} & x_{12} & 1 & 0 & 0 & 0 & -x_{11}y_{11} & -x_{12}y_{11} & -y_{11} \\ 0 & 0 & 0 & x_{11} & x_{12} & 1 & -x_{11}y_{12} & -x_{12}y_{12} & -y_{12} \\ x_{21} & x_{22} & 1 & 0 & 0 & 0 & -x_{21}y_{21} & -x_{22}y_{21} & -y_{21} \\ 0 & 0 & 0 & x_{21} & x_{22} & 1 & -x_{21}y_{22} & -x_{22}y_{22} & -y_{22} \\ x_{31} & x_{32} & 1 & 0 & 0 & 0 & -x_{31}y_{31} & -x_{32}y_{31} & -y_{31} \\ 0 & 0 & 0 & x_{31} & x_{32} & 1 & -x_{31}y_{32} & -x_{32}y_{32} & -y_{32} \\ x_{41} & x_{42} & 1 & 0 & 0 & 0 & -x_{41}y_{41} & -x_{42}y_{41} & -y_{41} \\ 0 & 0 & 0 & x_{41} & x_{42} & 1 & -x_{41}y_{42} & -x_{41}y_{42} & -y_{42} \end{pmatrix} \quad \text{Equation 21}$$

$$\begin{pmatrix} P_{11} \\ P_{12} \\ P_{13} \\ P_{21} \\ P_{22} \\ P_{23} \\ P_{31} \\ P_{32} \\ P_{33} \end{pmatrix} = Aip = 0$$

The projective transformation matrix P is computed from the above relational expression by utilizing the method of least square.

Thereafter all points on the lines 43 through 45 in the front-view image found by using FIG. 33 and having the assumption 5 are transformed from equation 22 by using the projective transformation matrix P. Thereby it is possible to divide the lines 43 through 45 into lines 43' through 45' and lines 43" through 45".

$$\begin{pmatrix} x_1 \\ x_2 \end{pmatrix} = \begin{pmatrix} P_{11} - P_{31}y_1 & P_{12} - P_{32}y_1 \\ P_{21} - P_{31}y_2 & P_{22} - P_{32}y_2 \end{pmatrix}^{-1} \begin{pmatrix} P_{33}y_1 - P_{13} \\ P_{33}y_2 - P_{23} \end{pmatrix} \quad \text{Equation 22}$$

(4) Estimation of Ground Position (Swing Orbit) of Head 13*b* in Side-View Image From the assumption 4, the intersections 50 through 52 of the vertical lines 43" through 45" passing through the head positions 46 through 48 respectively before the impact state, in the impact state, and after the impact state in the side-view image and the lines 43' through 45' transformed from the front-view image are positions 50 through 52 of the head 13*b* projected onto the ground in the side-view image.

Thereafter the projective transformation matrix is found in a principle similar to that of the above-described item (3) in the side-view image by utilizing the coordinate of the position of each of the four points A through D of the frame 39 and the coordinate of the position of each of the four points A through D in the actual space. By utilizing the obtained projective transformation matrix, the obtained ground positions 50 through 52 of the head 13*b* in the image are transformed into the ground positions of the head 13*b* in the actual space.

Figure 35:
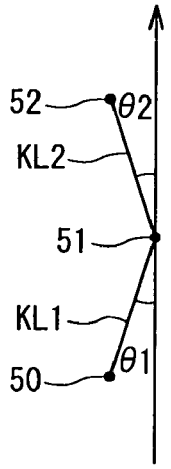
FIG. 35 is an explanatory view for diagnosing the swing orbit.

By utilizing the ground position of the head 13*b* obtained by the above-described transformation, the trajectory of the swing (head) can be found. For example, as shown in FIG. 35, it is possible to diagnose that the swing orbit is an outside-to-inside pattern, a straight trajectory pattern or an inside-to-outside trajectory pattern by examining an angle θ 1 between a first trajectory line KL1 connecting a transformed ground position 70 of the head before the impact time and a ground position 71 thereof at the impact time to each other and a ball fly line HL and an angle θ 2 between a second trajectory line KL2 connecting a ground position 72 thereof after the impact time and the ground position 71 thereof at the impact time and the ball fly line HL to each other.

More specifically, when the value of θ 1-θ 2 is not more than −5 degrees, the swing orbit is diagnosed as the outside-to-inside pattern. When the value of θ 1-θ 2 is not more than −5 degrees nor more than 10 degrees, the swing orbit is diagnosed as the straight pattern. When the value of θ 1-θ 2 is not less than 10 degrees, the swing orbit is diagnosed as the inside-to-outside pattern.

Figure 36A:
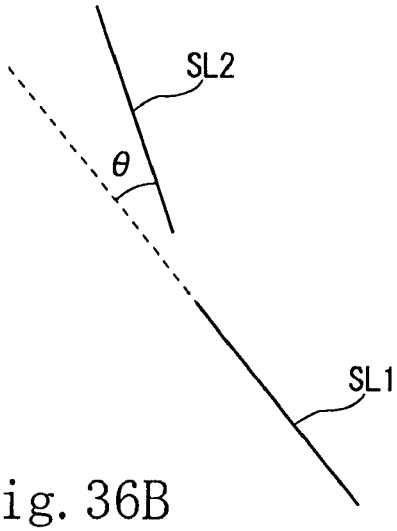
FIGS. 36A and 36B are explanatory views for explaining a diagnosis in a side view of a conversion from backswing to forward swing made at the top state.
Figure 36B:
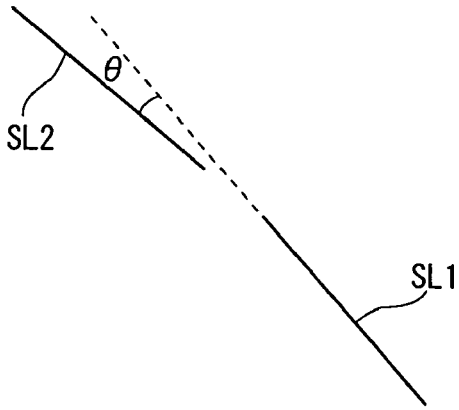

As shown in FIG. 31, when the silhouette cannot be extracted in the front view and hence the conversion from backswing to forward swing made at the top state cannot be diagnosed sufficiently, another method can be used to diagnose the swing direction change-over motion made at the top state as shown in FIGS. 36A and 36B. This method uses the line of the shaft 13*a* of the golf club 13 when the golfer 11 is seen in a view obtained by photographing the golfer 11 laterally and rearward therefrom in a ball fly line direction.

More specifically, an angle difference θ between a shaft line SL1 (original shaft line) in the address image and a shaft line SL2 in the downswing unskillful arm horizontal image is computed. When the angle θ is upward from the shaft line SL1 as shown in FIG. 36A, it is diagnosed that the start motion of the upper half of the golfer's body is great (arm turn). When the angle θ is downward from the shaft line SL1 as shown in FIG. 36B, it is diagnosed that the start motion of the lower half of the golfer's is great (body turn). Ideally, when the two shaft lines SL1 and SL2 are parallel with each other, the start motion of the upper half of the golfer's body and that of the lower half thereof are well balanced.

As described above, the numerical data obtained from the golfer's swing in each of the check-point images and the judgement value (ideal value) of the diagnosis item prepared for each check-point image are compared with each other to diagnose whether or not each of the numerical data is suitable to the above-described judgement value. When the numerical data is not less than or not more than the judgement value, results of a diagnosis and marks as shown in tables 3 and 4 are outputted.

Figure 37:
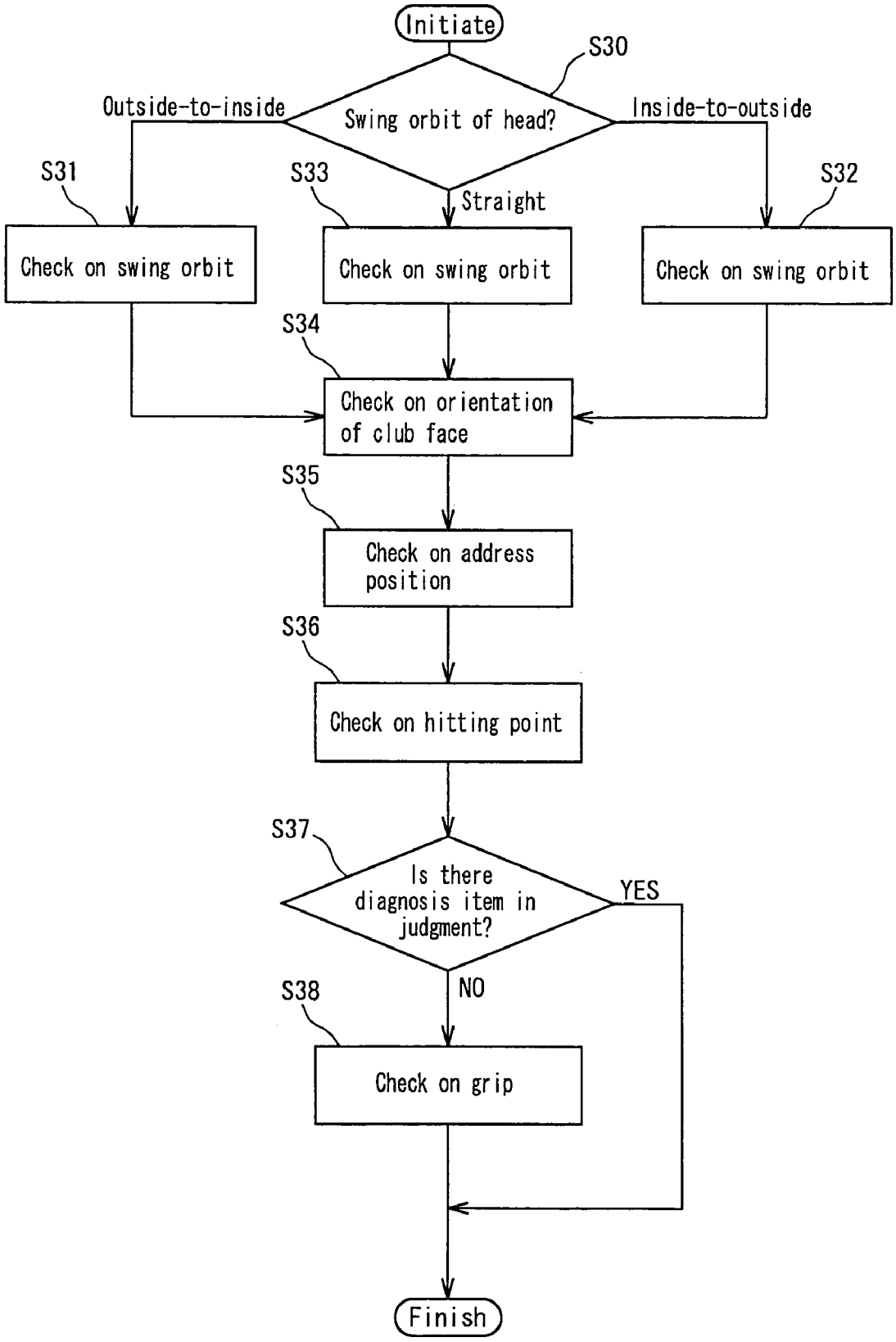
FIG. 37 is a flowchart of a diagnosis to be executed after a trajectory pattern is classified.

More specifically, FIG. 37 shows a schematic flow of the diagnosis in the swing orbit pattern. The swing form is diagnosed by appropriately selecting diagnosis items necessary for checking the swing form from among all the above-described diagnosis items. If the numerical data does not satisfy the ideal value (judgement value), a comment on the result of the diagnosis is outputted. On the other hand, if the numerical data satisfies the ideal value (judgement value), predetermined marks of respective diagnosis items are added to each other, and the total of the marks is outputted. It is preferable that the golfer can compare a mark obtained in a current-time diagnosis and a mark obtained in a previous-time diagnosis with each other.

The mark set for each diagnosis item is as shown in tables 3 and 4. Weighting of the mark is varied according to diagnosis items by taking the degree of importance of each diagnosis item into consideration. More specifically, because the posture in the address state affects all the diagnosis items (swing orbit at impact time, swing orbit of club face, hitting point, and so on), the diagnosis items of the address state have three points. The swing orbit at the impact time and the original shaft line in the downswing in the side-view image affect the swing orbit at the impact time and hence have three to five points. The swing direction change-over motion and the left elbow at the impact time in the side view affect the hitting point in the impact time and thus have three points. The spine angle and the distance between the grip and the golfer's body at the impact time affect the hitting point in the impact state and thus have three points. The downswing state affects more than the take-back state in the swing orbit, the angle of the club face, and the hitting point at the impact time. Therefore the diagnosis item for the downswing state have two points.

The total of the marks is set to 100 points (40 points in front-view image, 60 points in side view).

As the judging method, it is possible to adopt a method of giving or not giving the marks shown in tables 3 and 4. But it is possible to set judgement values stepwise to give the marks stepwise.

For example, regarding the diagnosis item having five points, by using the difference value SA between a minimum judgement value and a maximum judgement value, (minimum judgement value −0.5×SA) and (maximum judgement value+0.5×SA) are additionally set as intermediate thresholds. When a diagnosis item satisfies the intermediate thresholds although it does not satisfy the judgement value shown in tables 3 and 4, three points may be added thereto.

As examples of setting the marks stepwise, five points, three points or zero point is given to five-point diagnosis items. Three points, two points or zero point is given to three-point diagnosis items. One point, 0.5 points or zero point is given to one-point diagnosis items.

It is preferable to display the level of the golfer by outputting the total of marks. If the golfer is given 90 points or more out of possible 100 points, the golfer has skill of a professional class. If the golfer is given 80 to 90 points out of possible 100 points, the golfer has skill of a high class. If the golfer is given 60 to 80 points out of possible 100 points, the golfer has skill of an average class. If the golfer is given 60 points or less out of possible 100 ill points, the golfer has skill of a beginner.

Thereafter an advice drill serving as a practicing method for overcoming the golfer's defect is outputted in accordance with the result of the diagnosis. The computer 16 stores a data base in which the list of the advice drill, shown in table 5, which serves as the practicing method for improving the swing form is registered.

TABLE 5

| No. | Name of drill | Basic effect | Simple explanation |
|---|---|---|---|
| 1 | Posture | Learn formation of proper posture | Follow procedure to set up |
| 2 | Club on back | Learn body rotation | Rotate body with club on your back |
| 3 | Tee | Learn wrist cock | Half swing with tee put at grip end |
| 4 | Left hand | How to shift weight and use left hand in leading club | Swing by holding club with left hand |
| 5 | Right hand | Learn how to hit ball | Hit ball by holding club with right hand |
| 6 | Make sound by swinging | Learn how to increase velocity of club | Hold club upside down and make sound thr0ugh air by swinging club |
| 7 | Pigeon-toe | Learn how to refrain from moving waist excessively and twist upper half of body | Swing with both toes turned inward by 20 degrees |
| 8 | Tennis racket | Learn how to control club face | Check orientation of club face by using tennis racket |
| 9 | Swing of baseball bat | Learn feeling of swinging till finish | Swing baseball bat horizontally |
| 10 | Six balls | Learn rhythm and balance | Arrange six balls and hit them successively |
| 11 | Pump up | Form image of downswing | Stop at top position and swing down club by reaction |
| 12 | Full cock | Learn feeling of making top state by rotating body | Start swing after finishing cock in address state |
| 13 | Crisscross | Learn how to rotate body | Rotate body by imagining that club is on your back |
| 14 | Keep legs separate | Learn how to perform the conversion from backswing to forward swing | Practice swing direction change-over motion with club sandwiched between legs |
| 15 | Keep heel upward from ground | Learn how to fix right knee and twist | Swing with right heel up |
| 16 | Split hand | Form image of returning to address state from impact state | Grip club by spacing left and right hands and swing |
| 17 | Contact of grip with navel | Learn how to control club face by rotation of body | Form image before and after impact time with grip in contact with navel |
| 18 | Closed stance | Golfer hitting sliced ball should practice to hit ball at proper position | Hit ball in closed stance |
| 19 | Towel | Refrain from excessively spacing upper arms from body | Swing with towel put under upper arms |
| 20 | Swing from 9 o'clock state | For golfer unstable in backswing | Start swing after forming 9 o'clock state |
| 21 | Kick and go | Learn how to form posture before raising club | Start swing after forming impact state for a moment |
| 22 | Preset | Form image of top swing | Form top state in stationary state |
| 23 | Check level of both elbows | Learn position of both elbows before and after "top" | Check top swing by putting club on both elbows |
| 24 | Keep toe of club up | Swing from 9 o'clock state to 3 o'clock state to control club face | Reciprocate swinging between 9 o'clock state and 3 o'clock state |
| 25 | Swing with hips in contact with wall | Learn how to perform pivoting motion | Practice backswing without moving right hip rearward |
| 26 | Form posture of impact state | Form image of impact state | Press club against pillar or the like from address state |

TABLE 5-continued

| No. | Name of drill | Basic effect | Simple explanation |
|---|---|---|---|
| 27 | Swing club horizontally | Learn how to swing arms | Stand erect and swing arms horizontally |
| 28 | Swing on chair | Learn how to twist body and control club face | Swing racket on chair |
| 29 | Swing from 4 o'clock state | Stabilize rhythm and swing orbit | Bring club to 4 o'clock state before starting backswing |
| 30 | Two mats | Alter blow angle | Put on the place of 30 cm in the opposite direction to the direction of the fly |
| 31 | Put forehead on wall | Stabilize spine axis | Swing with forehead in contact with wall |
| 32 | Close left golfer's toe | Correct swaying | Swing with left toe turned inward by 20 degrees |
| 33 | Close right golfer's toe | Correct warping of upper half of body | Swing with right toe turned inward by 20 degrees |
| 34 | Place sofa alongside leg | Correct swaying of right knee in take-back | Place sofa alongside right knee |
| 35 | Drill by using soccer ball | Learn how to perform swing direction change-over motion | Sandwich soccer ball between thighs |
| 36 | Form image of impact | Form image of impact | Form image of impact with grip in contact with left side of body |
| 37 | Drill for stable backswing | Form image of backswing | Bring club to 9 o'clock position before starting swinging |

For example, if the trajectory pattern is "pull hook", the swing orbit of the golf club head before and after the impact state (diagnosis item No. 28) is diagnosed in the side-view image (step S30).

When it is diagnosed that the swing orbit is the outside-to-inside pattern, the swing checking on the swing orbit (step S31) is executed accordingly. For example, when it is diagnosed that the spine axis is almost erect as a result of checking on "amount of change of spine angle" (diagnosis item No. 23) in the impact state in side-view image or when knee is stretched as a result of checking on "amount of change of knee angle" (diagnosis item No. 24), the basic effect and the simple explanation of drill No. 31 "put forehead on wall" of the list of drill shown in table 5 are outputted to display the advice drill as a practicing method to the golfer.

When it is diagnosed that the swing orbit is the "inside-to-outside pattern" (step S32), the simple explanation about "left hand" of drill No. 4 and the basic effect are outputted to display the advice drill as a practicing method to the golfer.

When the swing orbit is the "straight" pattern, it is diagnosed that the orientation of the club face with respect to the trajectory is close (step S33). For example, the basic effect and the simple explanation about "left hand" of drill No. 4 are outputted to display the advice drill as a practicing method to the golfer.

Thereafter swing check on the orientation of the club face is executed (step S34). When it is diagnosed that the golfer's body weight has not shifted as a result of checking on "movement amount to left and right" in the impact state (diagnosis item No. 15) in the front view, the basic effect and the simple explanation "swing with hips in contact with wall" of the drill No. 25 are outputted.

Thereafter swing check on the address position is executed (step S35). When it is diagnosed that the club face is open at the impact time because the ball is disposed outside as a result of checking on "position of ball" (diagnosis item No. 1) in the front-view address image, the basic effect and the simple explanation "posture" of the drill No. 1 are outputted.

Thereafter swing check on the hitting point is executed (step S36). For example, when it is diagnosed that the upper half of the body is rearward because the golfer's weight is applied to the heel at the impact time as a result of checking on the diagnosis item No. 27 in the side-view impact image, the basic effect and the simple explanation of "Form posture of impact state" of the drill No. 26 are outputted.

When there is a diagnosis item for which an advice drill is required to be outputted as a result of the above-described judgement, the diagnosis finishes. On the other hand, when no advice drill is outputted as a result of the above-described judgement, swing check on the grip is executed (step S38). For example, a message of "check your hands for square grip" is outputted.

Figure 38:
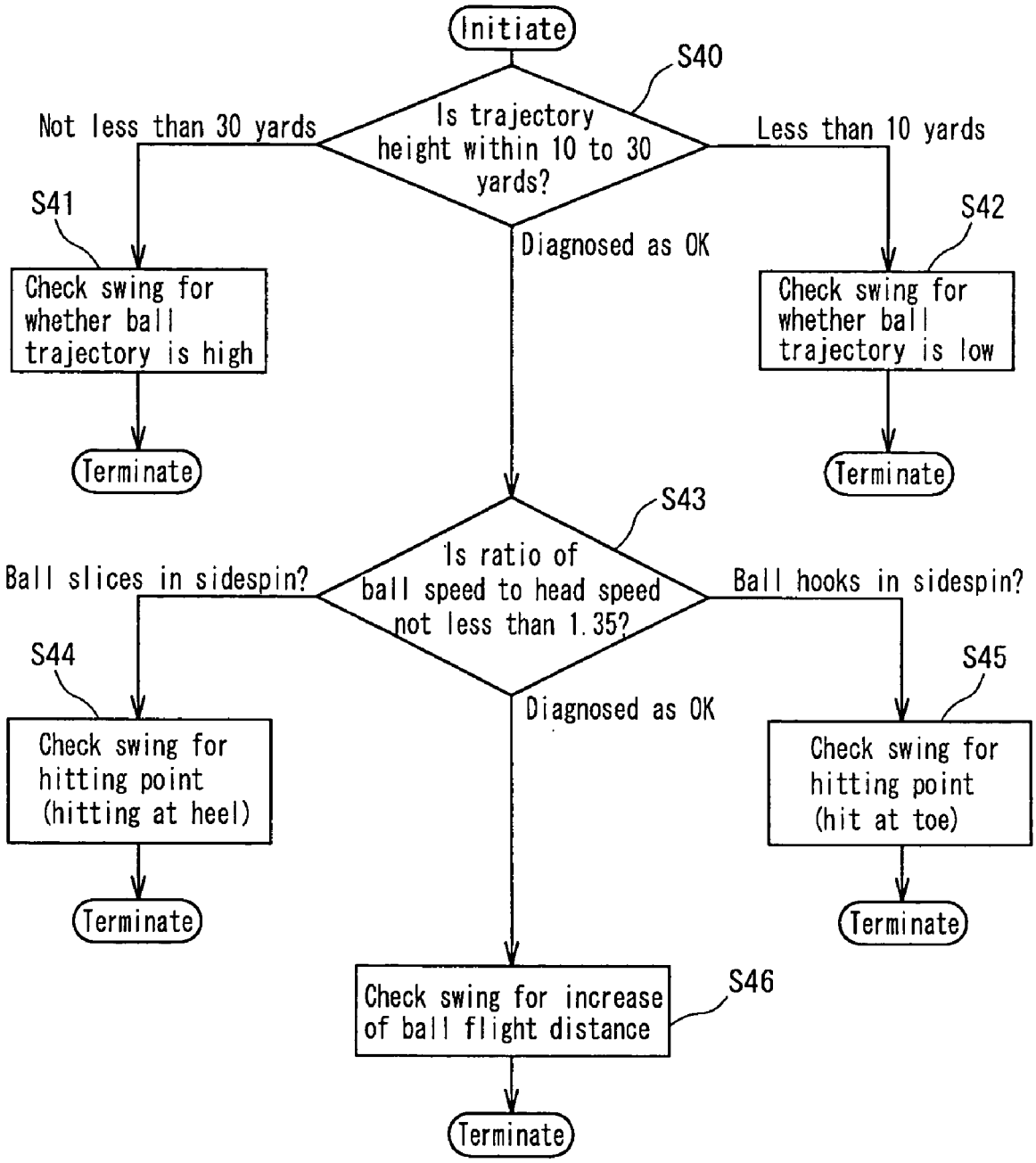
FIG. 38 is a flowchart of a diagnosis based on the behavior of a ball.

A diagnosis may be executed from various amounts regarding the behavior of the ball obtained by the ball motion measuring apparatus 20, as shown in FIG. 38.

For example, the height of the ball trajectory is obtained from the ball motion measuring apparatus 20 to judge whether the height thereof falls in the range of 10 to 30 yards (step S40). If the height of the ball trajectory is not less than 30 yards, it is diagnosed that the ball trajectory is high. Therefore the computer executes swing check as to whether the ball has a high trajectory, thus displaying the advice drill accordingly (step S41).

When the height of the ball trajectory is not more than 10 yards, it is diagnosed that the ball trajectory is low. Therefore the computer executes the swing check as to whether the ball has a low trajectory, thus displaying the advice drill accordingly (step S42).

When the height of the ball trajectory falls in the range of 10 to 30 yards, it is judged at step S43 whether the ratio of a ball speed to a head speed is not less than 1.35 (step S43).

When the above-described ratio is not more than 1.35, and hence when it is judged that the ball slices in its sidespin, the golfer is diagnosed that she/he hits the ball at the heel. Therefore the swing check is executed on the hitting point and the advice drill corresponding to the hitting point is displayed (step S44).

When the above-described ratio is not more than 1.35, and hence when it is judged that the ball hooks in its sidespin, the golfer is diagnosed that she/he hits the ball at the toe. Therefore the swing check is executed on the hitting point and the advice drill corresponding to the hitting point is displayed (step S45).

When the above-described ratio is not less than 1.35, the golfer is diagnosed that she/he hits the ball properly. Therefore the computer executes the swing check so that the golfer hits the ball a longer distance, thus displaying the advice drill accordingly (step S46).

EXAMPLES

Table 6 shows results of a test conducted for 10 testers by using the golf swing-diagnosing system.

For each tester, the data of the behavior of a ball B including the deviation angle of the ball B, the sidespin amount, the deviation distance of the drop point of the hit ball B to the right or the left with respect to the straight direction, the trajectory height, the ratio of the ball speed to the head speed was obtained. The trajectory pattern was decided from the sidespin amount and the deviation angle. The results of the diagnoses made on the diagnosis items prepared for the decided trajectory pattern and the advice drill for overcoming defects were displayed for the testers.

TABLE 6

| Tester | Deviation angle (degree) | Sidespin (rpm) | Deviation to left or right (yard) | Trajectory height (yard) | Ball speed/ head speed | Trajectory | Diagnosis and advice |
|---|---|---|---|---|---|---|---|
| A | 4.5 to left | 459 to left | 23.5 to left | 20 | 1.34 | pull hook | The trajectory pattern of a ball you hit is pull hook. The swing orbit pattern of the club is outside-to-inside because the orientation of the club face with respect to the swing orbit is close.<br>The spine axis is warped at the impact time. Practice with reference to "Put forehead on wall" (drill 31).<br>The upper half of your body starts to move excessively in a swing direction change-over motion. Practice with reference to "Keep legs separate" (drill 14).<br>Because the club is disposed outside (rearward) and the back of your wrist is bent, the club face is close at the impact time. Practice with reference to "Preset" (drill 22). |
| B | 5 to left | 34 to right | 14.3 to left | 34 | 1.43 | pull | The trajectory pattern of a ball you hit is pull because the swing orbit pattern of the club is outside-to-inside.<br>The left elbow is at a higher level than the right elbow in the top state. Practice with reference to "Check level of both elbows" (drill 23). |
| C | 3.5 to left | 705 to right | 11.2 to left | 32 | 1.22 | Pull slice | The trajectory pattern of a ball you hit is pull slice. The swing orbit of the club is outside-to-inside because the orientation of the club face with respect to the swing orbit is open.<br>Your right knee sways in a take-back. Practice with reference to "Close right toe" (drill 33).<br>You bend the upper half of your body rearward. So, the club face is open at the impact time and you are liable to hit a ball at the heel. In practicing with reference to "Club on back" (drill 2). you should dispose the left shoulder above the right knee.<br>Because a ball is disposed to the right with respect to the your left heel, the club face is open at the impact time. Practice with reference to "Posture" (drill 1).<br>Because your spine is almost erect, you hit a ball at the heel of the club at the impact time. Practice with reference to "Form posture of impact state" (drill 26). |
| D | 4.5 to left | 548 to left | 15.5 to left | 14 | 1.32 | Straight hook | The trajectory pattern of a ball you hit is straight hook. The swing orbit pattern of the club is straight because the orientation of the club face with respect to the swing orbit is a little close.<br>Because the back of your wrist is bent, the club face is close at the impact time. Practice with reference to "Keep toe of club up" (drill 24). |
| E | 0.5 to right | 108 to left | 1 to right | 25 | 1.42 | Straight | The trajectory pattern of a ball you hit is straight.<br>To increase the ball flight distance, rotate your waist more in a downswing. Practice with reference to "Form posture of impact state" (drill 26). |
| F | 4 to right | 1201 to right | 11.9 to right | 44 | 1.45 | Straight slice | The trajectory pattern of a ball you hit is straight slice. The swing orbit pattern of the club is straight because the orientation of the club face with respect to the swing orbit is a little open. |

TABLE 6-continued

| Tester | Deviation angle (degree) | Sidespin (rpm) | Deviation to left or right (yard) | Trajectory height (yard) | Ball speed/ head speed | Trajectory | Diagnosis and advice |
|---|---|---|---|---|---|---|---|
| | | | | | | | Because you dispose your left elbow rearward and thrust the right hand forward at the impact time, the face is open. Practice with reference to "Form posture of impact state" (drill 26). Because you dispose the upper half of your body to the right, there is a possibility that the club face is open at the impact time. Practice with reference to "Posture" (drill 1). |
| G | 3 to right | 1200 to left | 23.2 to right | 33 | 1.42 | Push hook | The trajectory pattern of a ball you hit is push hook. The swing orbit pattern of the club is outside-to-inside because the orientation of the club face with respect to the swing orbit is considerably close. The upper half of your body starts to move in the downswing. Because the rotation amount of the waist is small, shoulder is low position at the impact time. Practice with reference to "Form posture of impact state" (drill 26) and "Keep legs separate" (drill 14). Because you dispose the upper half of your body rearward at the impact time, you hit a ball at the toe of the club at the impact time. Practice with reference to "Form posture of impact state" (drill 26) |
| H | 2.5 to right | 150 to right | 21.1 to right | 26 | 1.13 | Push | The trajectory pattern of a ball you hit is push. The swing orbit pattern of the club is outside-to-inside because the orientation of the club face with respect to the swing orbit is considerably open. Because the position of the grip is at a low level and your wrist rolls in the top state, the club face is open at the impact time. Practice with reference to "Preset" (drill 22). Because the grip is disposed far from your body at the impact time, you hit a ball at the heel of the club at the impact time. Practice with reference to "Form posture of impact state" (drill 26). |
| I | 5 to right | 1030 to right | 39.3 to right | 31 | 1.42 | Push slice | The trajectory pattern of a ball you hit is push slice. The swing orbit pattern of the club is inside-to-outside because the orientation of the club face with respect to the swing orbit is open. The lower half of your body starts to move excessively in a swing direction change-over motion. Practice with reference to "Pigeon-toe" (drill 7). Because of flying elbow in the top state, the back of your wrist is bent in the top state and the club face is open at the impact time. Practice with reference to "Preset" (drill 22). |
| J | 3.5 to left | 470 to right | 3 to left | 25 | 1.44 | Straight | The trajectory pattern of a ball you hit is draw. To increase the ball flight distance, shift the weight of your body more in the take-back. Practice with reference to "Shift weight" (drill 37). |

The results of the diagnoses on the swing and the advice drill presented to the golfer are transmitted from the computer 16 to the server 100 to store them in the data base as the swing information of the golfer 11.

The swing information obtained in the past by the diagnosis executed by using the computer 16 is stored in time series in the data bases by relating the swing information to the golfer 11. Therefore it is possible to read the swing information by executing a plurality of swing diagnoses by using different computer 16 installed at different golf shops or by accessing the server 100 by means of one personal computer 200 or the portable telephone 300 through the internet N.

The swing information to be transmitted to the server 100 from the computer 16 and stored in the data base includes the above-described check-point images (FIGS. 11, 12), contents of inquiry inputted before hitting the ball, the decided trajectory of the ball, results of the diagnosis on the swing, the presented advice drill, a moving image sample of the advice drill, optimum shaft information, and optimum loft angle information.

Regarding the result of the diagnosis on the swing direction change-over motion made at the top state shown in FIG. 32, it is preferable to store the differential silhouette image shown in FIG. 31 in the data base so that it can be read.

The moving image sample of the advice drill means a moving image of a trainer carrying out the content of the advice drill. Watching the motion of the sample moving image displayed on the screen of the personal computer 200 or the portable telephone 300, the golfer 11 can practice to improve her/his swing form.

As optimum shaft information, it is preferable to recommend a golf club shaft having an optimum flexural rigidity obtained based on the result of the diagnosis on the swing direction change-over motion made at the top state executed by using the diagnosis item No. 10 in the front-view image or the diagnosis item No. 19 in the side-view image and the result of the diagnosis on the wrist angle executed by using the diagnosis item No. 14. More specifically, an optimum golf club shaft is presented, based on classification of (1) arm turn and cock motion, (2) arm turn and no cock motion, (3) body turn and cock motion, and (4) body turn and no cock motion.

In the case of the above (1), a golf club shaft having a low rigidity is presented.

In the case of the above (2), a golf club shaft having a low rigidity at its grip side is presented.

In the case of the above (3), a golf club shaft having a high rigidity at its grip side is presented.

In the case of the above (4), a golf club shaft having a rigidity that becomes gradually higher from its head toward its grip end is presented.

It is preferable to display an EI distribution regarding the flexural rigidity of the golf club shaft on the screen of the personal computer 200 or the portable telephone 300.

The information of the optimum loft angle of the golf club head is presented based on the angle of elevation of the ball and the trajectory height thereof measured by the ball motion measuring apparatus 20. More specifically, when it is judged that the measured angle of elevation of the ball and the measured trajectory height thereof are smaller than a predetermined angle of elevation and a predetermined trajectory height respectively, a golf club having a large loft angle is recommended. On the other hand, when it is judged that the measured angle of elevation of the ball and the measured trajectory height thereof are larger than the predetermined angle of elevation and the predetermined trajectory height respectively, a golf club having a small loft angle is recommended.

For example, supposing that the ratio of the ball speed to the head speed is not less than 1.4, the angle of elevation is eight degrees, the trajectory height is 10 yards, and the backspin amount is 1200 rpm when the ball B is hit by using a golf club having a loft angle of 10 degrees, as the optimum loft angle information, "It is preferable to use a golf club having a loft angle a little higher." is presented.

What is claimed is:

1. A golf swing-diagnosing system to permit a adjustment of a golf swing comprising a computer for capturing a golf swing colored moving image and for capturing a number of still frames from the colored moving image in which a golfer swinging by gripping a golf club is photographed, wherein said computer comprises:

an extraction means for selectively extracting one or more individual still images each individual still image showing a swing posture as a check-point image, wherein the one or more individual still check-point images are selected from the group consisting of an address image, a take-back shaft 8 o'clock image, a take-back shaft 9 o'clock image, a take-back unskillful arm horizontal image, a top image, a downswing unskillful arm horizontal image, a downswing shaft 9 o'clock image, an impact image, a follow-through shaft 3 o'clock image, and a finish image from a large number of still images constituting said color moving image;

means for extracting a plurality of different colored marks attached to the golfer or the golfer's golf club or a plurality of attention-focused points from each individual still check-point image sufficient to diagnose the golfer's swing;

means for obtaining a coordinate of a position of each of a plurality of different colored marks attached to a golfer or a golf club, and/or of a plurality of attention-focused points comprising a golfer's silhouette, contour of the golfer's silhouette, the curvature of the contour of a golfer's silhouette, a straight line associated with the contour of a golfer's silhouette, edge extraction characteristics of a golfer's silhouette, a color of a golfer's garment, and a golfer's skin color, which operate, in each of said individual still check-point images, while said golfer is swinging, wherein sufficient different colored marks and/or attention-focused points are used to diagnose the golfer's swing;

a means for diagnosing a swing form of said golfer by setting a plurality of diagnosis items each including a swing posture and a shaft angle for each trajectory pattern and by comparing numerical data generated from data of said coordinate of said position of each of said attention-focused points in each of said check-point images with a judgement value which is an ideal value inputted to said computer in advance; and a means for outputting an advice drill corresponding to a result of each of said diagnosis from a data base in which a plurality of advice drills prepared as a practicing method for improving a swing form is registered.

2. The golf swing-diagnosing system according to claim 1, wherein said trajectory pattern is divided into a pull hook, a pull, a pull slice, a straight hook, a straight, a straight slice, a push hook, a push, and a push slice.

3. The golf swing-diagnosing system according to claim 1, further comprising a ball motion measuring apparatus for measuring a behavior of a golf ball hit by said golfer so that said trajectory pattern is obtained according to a side spin amount of said golf ball measured by said ball motion measuring apparatus and a deviation angle thereof measured thereby.

4. The golf swing-diagnosing system according to claim 1, wherein a differential silhouette is obtained by executing differential processing between a top image in which a swing posture of a top state is photographed and an image obtained at a predetermined time period after said top image so that a conversion from backswing to forward swing which is made at said top state is diagnosed by using an area of said differential silhouette.

5. The golf swing-diagnosing system according to claim 1, wherein a conversion from backswing to forward swing made at the top state is diagnosed based on a difference of an angle formed between a shaft line in a downswing unskillful arm horizontal image and a shaft line in an address image when a golfer is seen rearward therefrom in a ball fly line direction.

6. The golf swing-diagnosing system according to claim 1, wherein it is judged that said golfer has a cock motion when a difference between a wrist angle in a predetermined swing posture and a wrist angle in another swing posture is not less than a predetermined value or when said wrist angle in said predetermined swing posture is not less than a predetermined value.

7. The golf swing-diagnosing system according to claim 1, wherein when a mark set in each of a plurality of diagnosis items satisfies or does not satisfy a judgement value which is an ideal value, said marks are added to each other.

8. The golf swing diagnosing system of claim 1, wherein the number of individual still check-point images is twelve.

9. The system of claim 1, further comprising means for executing differential processing between the plurality of colored marks and a colored background image to remove background colors proximate to that of the colored mark present in the background image to reduce erroneous recognition of the colored mark, and wherein the golfer swinging by gripping a golf club is photographed to achieve a reduction of an erroneous recognition ratio of attention-focused points for diagnosing the swing of the golfer.

10. The system of claim 1, wherein the number of check-point images is limited to no more than twelve.

11. The golf swing-diagnosing system according to claim 3, wherein said computer has an inquiry means through which said golfer inputs a trajectory pattern said golfer desires to be diagnosed before said golfer hits a golf ball so that when a trajectory pattern obtained from an actual behavior of said golf ball measured by said ball motion measuring apparatus conforms to or similar to said trajectory pattern inputted through said inquiry means, said computer outputs results of said diagnosis and an advice drill.

12. The golf swing-diagnosing system according to claim 7, wherein said marks outputted for said respective diagnosis items are added to each other; and a total of said marks is outputted as a result of a diagnosis.

13. A golf swing-diagnosing system comprising:

a computer for (1) extracting one or more individual still images each showing posture as check-point images selected from the group consisting of an address image, a take-back shaft 8 o'clock image, a take-back shaft 9 o'clock image, a take-back unskillful arm horizontal image, a top image, a downswing unskillful arm horizontal image, a downswing shaft 9 o'clock image, an impact image, a follow-through shaft 3 o'clock image, and a finish image from a large number of still colored images by capturing a colored image in which a golfer swinging by gripping a club is photographed; (2) obtaining a coordinate of each of attention-focused points, which operate, in each of only said check-point images, while said golfer is swinging; and (3) diagnosing a swing form of said golfer by setting a plurality of diagnosis items each including a swing posture and a shaft angle for each trajectory pattern; and a server connected with said computer through a communication network and receiving swing information having results of a diagnosis on a swing form from said computer, and a terminal information apparatus connected to said communication network for providing said swing information to said golfer.

14. The golf swing-diagnosing system according to claim 13, wherein past swing information is stored in time series in a data base of said server by relating said past swing information to said golfer.

15. The golf swing-diagnosing system according to claim 13, wherein said swing information has a result of a trajectory of a golf ball hit by said golf club.

16. The golf swing-diagnosing system according to claim 13, wherein said swing information has a plurality of advice drills which is prepared in correspondence to each of said diagnosis items as a practicing method for improving a swing form and is selected appropriately in correspondence to a result of a diagnosis on said swing form from a data base in which said advice drills are registered.

17. The golf swing-diagnosing system according to claim 13, wherein said swing information has contents of inquiry inputted before hitting a golf ball.

18. The golf swing-diagnosing system according to claim 13, wherein results of diagnosis on said swing form have a result of a diagnosis on a conversion from backswing to forward swing at said top state which is diagnosed by using an area of a differential silhouette which is obtained by executing differential processing between a top image in which a swing posture of a top state is photographed and an image obtained at a predetermined time period after said top image.

19. The golf swing-diagnosing system according to claim 13, wherein results of a diagnosis on said swing form have a result of a diagnosis on a conversion from backswing to forward swing made at the top state which is diagnosed based on a difference of an angle formed between a shaft line in a downswing unskillful arm horizontal image and a shaft line in an address image when a golfer is seen rearward therefrom in a ball fly line direction.

20. The golf swing-diagnosing system according to claim 13, wherein said swing information has information of a loft angle of a golf club head selected according to an angle of elevation of a golf ball and a trajectory height thereof measured by a ball motion measuring apparatus.

21. The golf swing diagnosing system of claim 13, wherein the number of individual still images each showing posture as check-point images is twelve.

22. The system of claim 13, wherein a plurality of different colored marks are attached to the golfer or the golfer's golf club to comprise a plurality of attention-focused points from each individual still check-point image sufficient to diagnose the golfer's swing, and a processor for performing differential processing between the plurality of different colored marks and a colored background image is employed to remove background colors proximate to that of the colored mark present in the background image to reduce erroneous recognition of the colored mark.

23. The system of claim 13, wherein the number of check-point images is limited to no more than twelve.

24. The golf swing-diagnosing system according to claim 16, wherein each of said advice drills has a sample moving image for explaining a practicing method.

25. The golf swing-diagnosing system according to claim 18, wherein results obtained by diagnosing said swing form includes a wrist angle; and said swing information has information of an optimum golf club shaft chosen from said results obtained by diagnosing said swing direction change-over motion made at the top state and said wrist angle.

26. A method of diagnosing a golf swing to permit a adjustment of a golf swing comprising a computer for capturing a golf swing colored moving image and for capturing a number of still frames from the colored moving image in which a golfer swinging by gripping a golf club is photographed, comprising:

selectively extracting one or more individual still images each individual still image showing a swing posture as a check-point image, wherein the one or more individual still check-point images are selected from the group consisting of an address image, a take-back shaft 8 o'clock image, a take-back shaft 9 o'clock image, a take-back unskillful arm horizontal image, a top image, a downswing unskillful arm horizontal image, a downswing shaft 9 o'clock image, an impact image, a follow-through shaft 3 o'clock image, and a finish image from a large number of still images constituting said color moving image;

extracting a plurality of different colored marks attached to the golfer or the golfer's golf club or a plurality of attention-focused points from each individual still check-point image sufficient to diagnose the golfer's swing;

obtaining a coordinate of a position of each of a plurality of different colored marks attached to a golfer or a golf club, and/or of a plurality of attention-focused points comprising a golfer's silhouette, contour of the golfer's silhouette, the curvature of the contour of a golfer's silhouette, a straight line associated with the contour of a golfer's silhouette, edge extraction characteristics of a golfer's silhouette, a color of a golfer's garment, and a golfer's skin color, which operate, in each of said individual still check-point images, while said golfer is swinging, wherein sufficient different colored marks and/or attention-focused points are extracted to diagnose the golfer's swing;

diagnosing a swing form of said golfer by setting a plurality of diagnosis items each including a swing posture and a shaft angle for each trajectory pattern and by comparing numerical data generated from data of said coordinate of said position of each of said attention-focused points in each of said check-point images with a judgement value which is an ideal value inputted to said computer in advance; and outputting an advice drill corresponding to a result of each of said diagnosis from a data base in which a plurality of advice drills prepared as a practicing method for improving a swing form is registered.

27. The method of diagnosing a golf swing of claim 26, wherein the number of individual check-point images is twelve.

28. The method of claim 26, further comprising:

executing differential processing between the plurality of colored marks and a colored background image to remove background colors proximate to that of the colored mark present in the background image to reduce erroneous recognition of the colored mark.

29. The method of claim 26, wherein the number of check point images is limited to no more than twelve.

30. The method of claim 26, further comprising recognizing an image using a template and template matching processing.

* * * * *